US010053967B2

(12) United States Patent
Deutch et al.

(10) Patent No.: US 10,053,967 B2
(45) Date of Patent: Aug. 21, 2018

(54) HIGH POWER LASER HYDRAULIC FRACTURING, STIMULATION, TOOLS SYSTEMS AND METHODS

(71) Applicants: Paul D. Deutch, Houston, TX (US); Fred C. Kellermann, Sugar Land, TX (US); Tom Zimmerman, Pearland, TX (US); John Yearwood, Houston, TX (US); Mark S. Zediker, Castle Rock, CO (US); Ronald A. De Witt, Katy, TX (US); Brian O. Faircloth, Evergreen, CO (US); John Ely, Montgomery, TX (US)

(72) Inventors: Paul D. Deutch, Houston, TX (US); Fred C. Kellermann, Sugar Land, TX (US); Tom Zimmerman, Pearland, TX (US); John Yearwood, Houston, TX (US); Mark S. Zediker, Castle Rock, CO (US); Ronald A. De Witt, Katy, TX (US); Brian O. Faircloth, Evergreen, CO (US); John Ely, Montgomery, TX (US)

(73) Assignee: Foro Energy, Inc., Houston, TX (US)

( * ) Notice: Subject to any disclaimer, the term of this patent is extended or adjusted under 35 U.S.C. 154(b) by 506 days.

(21) Appl. No.: 14/082,026

(22) Filed: Nov. 15, 2013

(65) Prior Publication Data

US 2015/0129203 A1 May 14, 2015

Related U.S. Application Data

(63) Continuation-in-part of application No. 13/782,869, filed on Mar. 1, 2013, now Pat. No. 9,719,302, and a (Continued)

(51) Int. Cl.

| | |
|---|---|
| ***E21B 43/26*** | (2006.01) |
| ***E21B 43/11*** | (2006.01) |
| ***E21B 43/119*** | (2006.01) |

(52) U.S. Cl.
CPC ..... *E21B 43/26* (2013.01); *E21B 43/11* (2013.01); *E21B 43/119* (2013.01)

(58) Field of Classification Search
CPC ..... E21B 43/26; E21B 43/119; E21B 43/11; E21B 7/15; E21B 33/12; E21B 49/006
See application file for complete search history.

(56) References Cited

U.S. PATENT DOCUMENTS

| | | | |
|---|---|---|---|
| 4,199,034 | A | 4/1980 | Winfield et al. |
| 4,533,814 | A | 8/1985 | Ward |

(Continued)

FOREIGN PATENT DOCUMENTS

| | | |
|---|---|---|
| GB | 1284454 | 8/1972 |
| WO | 2011/041390 | 4/2011 |

OTHER PUBLICATIONS

Muto, et al., "Laser cutting for thick concrete by multi-pass technique," *Chinese Optics Letters* May 31, 2007, vol. 5, pp. S39-S41.

(Continued)

*Primary Examiner* — Jennifer H Gay
(74) *Attorney, Agent, or Firm* — Glen P. Belvis; Belvis Law, LLC.

(57) ABSTRACT

There are provided high power laser perforation, hydraulic fracturing systems, tools and methods for the stimulation and recovery of energy sources, such as hydrocarbons, from a formation. These systems, tools and methods provide predetermined laser beam energy patterns, to provide for the down hole volumetric removal of custom geometries of materials, sealing of perforations, reperforations, refractures and other downhole actives.

91 Claims, 41 Drawing Sheets

Related U.S. Application Data continuation-in-part of application No. 13/222,931, filed on Aug. 31, 2011, now abandoned, application No. 14/082,026, which is a continuation-in-part of application No. 13/210,581, filed on Aug. 16, 2011, now Pat. No. 8,662,160, and a continuation-in-part of application No. 12/543,986, filed on Aug. 19, 2009, now Pat. No. 8,826,973.

(60) Provisional application No. 61/798,875, filed on Mar. 15, 2013, provisional application No. 61/786,687, filed on Mar. 15, 2013, provisional application No. 61/727,096, filed on Nov. 15, 2012, provisional application No. 61/378,910, filed on Aug. 31, 2010, provisional application No. 61/153,271, filed on Feb. 17, 2009, provisional application No. 61/106,472, filed on Oct. 17, 2008, provisional application No. 61/102,730, filed on Oct. 3, 2008, provisional application No. 61/090,384, filed on Aug. 20, 2008.

(56) References Cited

U.S. PATENT DOCUMENTS 5,503,370 A * 4/1996 Newman ..... E21B 17/206 254/134.3 FT
5,573,225 A * 11/1996 Boyle ..... H02G 1/086 254/134.4
5,599,004 A * 2/1997 Newman ..... E21B 17/206 254/134.3 FT
5,615,052 A 3/1997 Doggett
5,699,974 A * 12/1997 Jenkins ..... B65H 49/08 242/129
5,773,791 A 6/1998 Kuykendal
5,813,465 A 9/1998 Terrell et al.
5,862,862 A 1/1999 Terrel
5,902,499 A 5/1999 Richerzhagen
5,909,306 A 6/1999 Goldberg et al.
5,938,954 A 8/1999 Tsutomuoma et al.
5,946,788 A * 9/1999 Griffioen ..... G02B 6/4457 242/470
5,950,298 A * 9/1999 Griffioen ..... H02G 1/08 242/470
6,409,155 B1 * 6/2002 Brown ..... G02B 6/4464 254/134.3 R
6,426,479 B1 7/2002 Bischof
6,661,815 B1 12/2003 Kozlovsky et al.
6,820,702 B2 11/2004 Niedermayr et al.
7,617,873 B2 * 11/2009 Lovell ..... E21B 47/123 166/250.01
8,464,794 B2 * 6/2013 Schultz ..... E21B 29/02 166/250.1
3,998,281 A1 7/2013 Salisbury et al.
8,662,160 B2 * 3/2014 DeWitt et al. ..... E21B 7/14 166/65.1
8,826,973 B2 * 9/2014 Moxley ..... E21B 7/14 166/242.2
2003/0000741 A1 1/2003 Rosa
2003/0056990 A1 3/2003 Oglesby
2003/0094281 A1 5/2003 Tubel
2003/0132029 A1 7/2003 Parker
2003/0174942 A1 9/2003 Murshid et al.
2003/0226826 A1 12/2003 Kobayashi et al.
2004/0026382 A1 2/2004 Richerzhagen
2004/0112642 A1 6/2004 Krueger et al.
2004/0195003 A1 10/2004 Batarseh
2004/0206505 A1 10/2004 Batarseh
2004/0244970 A1 12/2004 Smith
2004/0256103 A1 12/2004 Batarseh
2005/0007583 A1 1/2005 Difoggio
2005/0034857 A1 2/2005 Defretin et al.
2005/0115741 A1 6/2005 Terry et al.
2005/0121235 A1 6/2005 Larsen et al.
2005/0189146 A1 9/2005 Oglesby
2005/0230107 A1 10/2005 Fuller et al.
2005/0263281 A1 12/2005 Lovell et al.
2005/0269132 A1 12/2005 Batarseh et al.
2005/0279511 A1 * 12/2005 Adnan ..... E21B 17/206 166/380
2006/0070770 A1 4/2006 Marsh
2006/0102343 A1 5/2006 Skinner et al.
2006/0185843 A1 8/2006 Smith
2006/0191684 A1 8/2006 Smith
2006/0207799 A1 9/2006 Yu
2006/0231257 A1 10/2006 Fuller et al.
2006/0237233 A1 10/2006 Reed et al.
2006/0260832 A1 11/2006 McKay
2006/0289724 A1 12/2006 Skinner et al.
2007/0034409 A1 2/2007 Dale et al.
2007/0068705 A1 3/2007 Hosie et al.
2007/0193990 A1 8/2007 Richerzhagen et al.
2007/0217736 A1 9/2007 Rojas et al.
2007/0267220 A1 11/2007 Magiawal et al.
2007/0272407 A1 11/2007 Lehman et al.
2007/0278195 A1 12/2007 Richerzhagen et al.
2008/0053702 A1 3/2008 Smith
2008/0073077 A1 3/2008 Tunc et al.
2008/0093125 A1 4/2008 Potter et al.
2008/0135818 A1 * 6/2008 Griffioen ..... B65H 51/16 254/134.4
2008/0166132 A1 7/2008 Lynde et al.
2008/0245568 A1 10/2008 Jeffryes
2009/0078467 A1 3/2009 Castillo
2009/0126235 A1 5/2009 Kobayashi et al.
2009/0133871 A1 5/2009 Skinner et al.
2009/0139768 A1 6/2009 Castillo
2009/0166042 A1 7/2009 Skinner
2009/0194292 A1 8/2009 Oglesby
2010/0001179 A1 1/2010 Kobayashi et al.
2010/0013663 A1 1/2010 Cavender et al.
2010/0018703 A1 1/2010 Lovell et al.
2010/0032207 A1 2/2010 Potter et al.
2010/0044102 A1 2/2010 Rinzler et al.
2010/0044103 A1 2/2010 Moxley
2010/0044104 A1 2/2010 Zediker et al.
2010/0044105 A1 2/2010 Faircloth et al.
2010/0044106 A1 2/2010 Zediker et al.
2010/0078414 A1 4/2010 Perry et al.
2010/0084132 A1 4/2010 Noya et al.
2010/0089576 A1 4/2010 Wideman et al.
2010/0096124 A1 * 4/2010 Naumann ..... E21B 17/206 166/250.01
2010/0187010 A1 7/2010 Abbasi et al.
2010/0197116 A1 8/2010 Shah et al.
2010/0215326 A1 8/2010 Zediker
2010/0218993 A1 9/2010 Wideman et al.
2010/0224408 A1 9/2010 Kocis et al.
2010/0258289 A1 10/2010 Lynde et al.
2010/0326659 A1 12/2010 Schultz et al.
2011/0079437 A1 4/2011 Hopkins et al.
2011/0174537 A1 7/2011 Potter et al.
2011/0290563 A1 12/2011 Kocis et al.
2012/0020631 A1 1/2012 Rinzler
2012/0067643 A1 3/2012 DeWitt
2012/0068086 A1 3/2012 DeWitt
2012/0074110 A1 3/2012 Zediker
2012/0217015 A1 8/2012 Zediker
2012/0217017 A1 8/2012 Zediker
2012/0217018 A1 8/2012 Zediker
2012/0217019 A1 8/2012 Zediker
2012/0248078 A1 10/2012 Zediker
2012/0255774 A1 10/2012 Grubb
2012/0255933 A1 10/2012 McKay
2012/0255993 A1 * 10/2012 Bandholz ..... G06K 7/10722 235/375
2012/0261188 A1 10/2012 Zediker
2012/0266803 A1 10/2012 Zediker
2012/0267168 A1 10/2012 Grubb
2012/0273269 A1 11/2012 Rinzler
2012/0273470 A1 11/2012 Zediker
2012/0275159 A1 11/2012 Fraze
2013/0011102 A1 1/2013 Rinzler
2013/0175090 A1 7/2013 Zediker

(56) References Cited

U.S. PATENT DOCUMENTS

| | | | | |
|---|---|---|---|---|
| 2013/0192893 | A1 | 8/2013 | Zediker | |
| 2013/0192894 | A1 | 8/2013 | Zediker | |
| 2013/0220626 | A1 | 8/2013 | Zediker | |
| 2013/0228372 | A1 | 9/2013 | Linyaev | |
| 2013/0228557 | A1 | 9/2013 | Zediker | |
| 2013/0266031 | A1 | 10/2013 | Norton | |
| 2013/0319984 | A1 | 12/2013 | Linyaev | |
| 2014/0000902 | A1 | 1/2014 | Wolfe | |
| 2014/0060802 | A1 | 3/2014 | Zediker | |
| 2014/0060930 | A1 | 3/2014 | Zediker | |
| 2014/0069896 | A1 | 3/2014 | Deutch | |
| 2014/0090846 | A1 | 4/2014 | Deutch | |
| 2014/0190949 | A1 | 7/2014 | Zediker | |
| 2014/0231085 | A1 | 8/2014 | Zediker | |
| 2014/0231398 | A1 | 8/2014 | Land | |
| 2014/0248025 | A1 | 9/2014 | Rinzler | |
| 2014/0345872 | A1 | 11/2014 | Zediker | |
| 2015/0129203 | A1* | 5/2015 | Deutch | E21B 43/11 166/250.1 |

OTHER PUBLICATIONS

U.S. Appl. No. 14/214,112, filed Mar. 14, 2014, Zediker et al.
U.S. Appl. No. 14/213,212, filed Mar. 14, 2014, Zediker et al.
U.S. Appl. No. 14/105,949, filed Dec. 13, 2013, Deutch, et al.
International Search Report and the Written Opinion of the International Searching Authority, PCT/US13/070321, dated Jun. 13, 2014.
International Search Report and the Written Opinion of the International Searching Authority, PCT/US13/77614, dated Nov. 3, 2014.
Daneshy, A., Jr. "Opening of a Pressurized Fracture in an Elastic Medium," Petroleum Society of CIM, Paper No. 7616, Jun. 1971, 17 pp.
Daneshy, A., "A Study of Inclined Hydraulic Fractures," Society of Petroleum Engineers Journal, SPE 4062, Apr. 1973, 8 pp.
Daneshy, A., "Experimental Investigation of Hydraulic Fracturing Through Perforations," Journal of Petroleum Technology, SPE 4333, Oct. 1973, 6 pp.
Daneshy, A., "True and Apparent Direction of Hydraulic Fracture" American Institute of Mining, Metallurgical, and Petroleum Engineers, Inc., SPE 3226, 1971, 15 pp.
Van De Ketterij, R.G., "Experimental Study on the Impact of Perforations on Hydraulic FractureTortuosity," Society of Petroleum Engineers, Inc., SPE 38149, 1997, 9 pp.
Van De Ketterij, R.G., "Impact of Perforations on Hydraulic Fracture Tortuosity," SPE Prod. & Facilities, 14 (2), May 1999, 8 pages.
Pearson, C.M., "Results of Stress-Oriented and Aligned Perforating in Fracturing Deviated Wells," JPT, Jan. 1992. 9 pp.
Warpinski, Norman R., "Laboratory Investigation on the Effect of In-Situ Stresses on Hydraulic Fracture Containment," Society of Petroleum Engineers of AIME, Jun. 1982, 8 pp.
Weng, Xiaowei, "Fracture Initiation and Propagation From Deviated Wellbores," Society of Petroleum Engineers, SPE 26597, 1993, 16 pp.
Teufel, Lawrence, W., "Hydraulic Fracture Propagation in Layered Rock: Experimental Studies of Fracture Containment," Society of Petroleum Engineers of AIME, Feb. 1984, 14 pages.
Warpinski, N.R., "Influence of Geologic Discontinuities on Hydraulic Fracture Propagation," Journal of Petroleum Technology, Feb. 1987, 14 pages.

* cited by examiner

HIGH POWER LASER HYDRAULIC FRACTURING, STIMULATION, TOOLS SYSTEMS AND METHODS

This application: (i) claims, under 35 U.S.C. § 119(e)(1), the benefit of the filing date of Nov. 15, 2012 of provisional application Ser. No. 61/727,096; (ii) claims, under 35 U.S.C. § 119(e)(1), the benefit of the filing date of Mar. 15, 2013 of provisional application Ser. No. 61/786,687; (iii) is a continuation-in-part of U.S. patent application Ser. No. 13/782,869, filed Mar. 1, 2013; (iv) is a continuation-in-part of U.S. patent application Ser. No. 13/222,931, filed Aug. 31, 2011, which claims, under 35 U.S.C. § 119(e)(1), the benefit of the filing date of Aug. 31, 2010 of provisional application Ser. No. 61/378,910 and the benefit of the filing date of Aug. 20, 2008 of provisional application Ser. No. 61/090,384; (v) is a continuation-in-part of Ser. No. 13/210,581; (vi) is a continuation-in-part of Ser. No. 12/543,986, filed Aug. 19, 2009, which claims, under 35 U.S.C. § 119(e)(1), the benefit of the filing date of Aug. 20, 2008 of provisional application Ser. No. 61/090,384, the benefit of the filing date of Oct. 3, 2008 of provisional application Ser. No. 61/102,730, the benefit of the filing date of Oct. 17, 2008 of provisional application Ser. No. 61/106,472, and the benefit of the filing date of Feb. 17, 2009 of provisional application Ser. No. 61/153,271; and (vii) claims, under 35 U.S.C. § 119(e)(1), the benefit of the filing date of Mar. 15, 2013 of provisional application Ser. No. 61/798,875, the entire disclosures of each of which are incorporated herein by reference.

This invention was made with Government support under Award DE-EE0006270 awarded by the Office of Energy Efficiency & Renewable Energy U.S. Department of Energy. The Government has certain rights in the invention.

BACKGROUND OF THE INVENTION

Field of the Invention

The present inventions relate to hydraulic fracturing, well stimulation and the recovery of energy sources using high power laser tools. In particular, the present inventions relate to hydrocarbon and energy recovery through high power laser hydraulic fracturing, perforating, fracturing, and opening, increasing and enhancing the flow of energy sources, from a formation or reservoir into a production tubing or collection system. In addition to improved performance and safety over conventional systems, such as explosive based perforating guns and high pressure jetting with solids laden fluids, the present inventions provide for the precise and predetermined placement of laser beam energy, in precise and predetermined energy distribution patterns, e.g., custom geometries, custom perforations, custom fracture patterns, volumetric removals and laser adaptive fracturing. These custom operations can be tailored and fitted to the particular geological and structural features of a formation, reservoir and pay zone. Unlike conventional methods, such as explosive perforating tools and high pressure jetting with solids laden fluids, the laser beam and laser process can be controlled or operated in a manner that provides numerous advantages, such as for example, increase control, custom volumetric removals and geometries, adaptive volumetric removals and geometries, maintaining and enhancing the porosity, openness and structure of the inner surface of the openings.

As used herein, unless specified otherwise "high power laser energy" means a laser beam having at least about 1 kW (kilowatt) of power. As used herein, unless specified otherwise "great distances" means at least about 500 m (meter). As used herein, unless specified otherwise, the term "substantial loss of power," "substantial power loss" and similar such phrases, mean a loss of power of more than about 3.0 dB/km (decibel/kilometer) for a selected wavelength. As used herein the term "substantial power transmission" means at least about 50% transmittance.

As used herein, unless specified otherwise, "optical connector", "fiber optics connector", "connector" and similar terms should be given their broadest possible meanings and include any component from which a laser beam is or can be propagated, any component into which a laser beam can be propagated, and any component that propagates, receives or both a laser beam in relation to, e.g., free space, (which would include a vacuum, a gas, a liquid, a foam and other non-optical component materials), an optical component, a wave guide, a fiber, and combinations of the forgoing.

As used herein, unless specified otherwise, the term "earth" should be given its broadest possible meaning, and includes, the ground, all natural materials, such as rocks, and artificial materials, such as concrete, that are or may be found in the ground, including without limitation rock layer formations, such as, granite, basalt, sandstone, dolomite, sand, salt, limestone, rhyolite, quartzite and shale rock.

As used herein, unless specified otherwise, the term "borehole" should be given it broadest possible meaning and includes any opening that is created in a material, a work piece, a surface, the earth, a structure (e.g., building, protected military installation, nuclear plant, offshore platform, or ship), or in a structure in the ground, (e.g., foundation, roadway, airstrip, cave or subterranean structure) that is substantially longer than it is wide, such as a well, a well bore, a well hole, a micro hole, slimhole and other terms commonly used or known in the arts to define these types of narrow long passages. Wells would further include exploratory, production, abandoned, reentered, reworked, and injection wells, and cased and uncased or open holes. Although boreholes are generally oriented substantially vertically, they may also be oriented on an angle from vertical, to and including horizontal. Thus, using a vertical line, based upon a level as a reference point, a borehole can have orientations ranging from 0° i.e., vertical, to 90°,i.e., horizontal and greater than 90° e.g., such as a heel and toe, and combinations of these such as for example "U" and "Y" shapes; there may also be for example multilateral boreholes in a fishbone pattern, and multilateral horizontal boreholes initiated at different levels in the earth from the mother bore. Boreholes may further have segments or sections that have different orientations, they may have straight sections and arcuate sections and combinations thereof; and for example may be of the shapes commonly found when directional drilling is employed. Thus, as used herein unless expressly provided otherwise, the "bottom" of a borehole, the "bottom surface" of the borehole and similar terms refer to the end of the borehole, i.e., that portion of the borehole furthest along the path of the borehole from the borehole's opening, the surface of the earth, or the borehole's beginning. The terms "side" and "wall" of a borehole should to be given their broadest possible meaning and include the longitudinal surfaces of the borehole, whether or not casing or a liner is present, as such, these terms would include the sides of an open borehole or the sides of the casing that has been positioned within a borehole. Boreholes may be made up of a single passage, multiple passages, connected passages and combinations thereof, in a situation where multiple boreholes are connected or interconnected each borehole would have a borehole bottom. Boreholes may be formed in the sea floor, under bodies of water, on land, in ice formations, or in other locations and settings.

Boreholes are generally formed and advanced by using mechanical drilling equipment having a rotating drilling tool, e.g., a bit. For example and in general, when creating a borehole in the earth, a drilling bit is extending to and into the earth and rotated to create a hole in the earth. In general, to perform the drilling operation the bit must be forced against the material to be removed with a sufficient force to exceed the shear strength, compressive strength or combinations thereof, of that material. Thus, in conventional drilling activity mechanical forces exceeding these strengths of the rock or earth must be applied. The material that is cut from the earth is generally known as cuttings, e.g., waste, which may be chips of rock, dust, rock fibers and other types of materials and structures that may be created by the bit's interactions with the earth. These cuttings are typically removed from the borehole by the use of fluids, which fluids can be liquids, foams or gases, or other materials know to the art.

As used herein, unless specified otherwise, the term "advancing" a borehole should be given its broadest possible meaning and includes increasing the length of the borehole. Thus, by advancing a borehole, provided the orientation is less than 90° the depth of the borehole may also increased. The true vertical depth ("TVD") of a borehole is the distance from the top or surface of the borehole to the depth at which the bottom of the borehole is located, measured along a straight vertical line. The measured depth ("MD") of a borehole is the distance as measured along the actual path of the borehole from the top or surface to the bottom. As used herein unless specified otherwise the term depth of a borehole will refer to MD. In general, a point of reference may be used for the top of the borehole, such as the rotary table, drill floor, well head or initial opening or surface of the structure in which the borehole is placed.

As used herein, unless specified otherwise, the term "drill pipe" is to be given its broadest possible meaning and includes all forms of pipe used for drilling activities; and refers to a single section or piece of pipe. As used herein the terms "stand of drill pipe," "drill pipe stand," "stand of pipe," "stand" and similar type terms should be given their broadest possible meaning and include two, three or four sections of drill pipe that have been connected, e.g., joined together, typically by joints having threaded connections. As used herein the terms "drill string," "string," "string of drill pipe," string of pipe" and similar type terms should be given their broadest definition and would include a stand or stands joined together for the purpose of being employed in a borehole. Thus, a drill string could include many stands and many hundreds of sections of drill pipe.

As used herein, unless specified otherwise, the term "tubular" is to be given its broadest possible meaning and includes drill pipe, casing, riser, coiled tube, composite tube, vacuum insulated tubing ("VIT), production tubing and any similar structures having at least one channel therein that are, or could be used, in the drilling industry. As used herein the term "joint" is to be given its broadest possible meaning and includes all types of devices, systems, methods, structures and components used to connect tubulars together, such as for example, threaded pipe joints and bolted flanges. For drill pipe joints, the joint section typically has a thicker wall than the rest of the drill pipe. As used herein the thickness of the wall of tubular is the thickness of the material between the internal diameter of the tubular and the external diameter of the tubular.

As used herein, unless specified otherwise, the terms "blowout preventer," "BOP," and "BOP stack" should be given their broadest possible meanings, and include: (i) devices positioned at or near the borehole surface, e.g., the surface of the earth including dry land or the seafloor, which are used to contain or manage pressures or flows associated with a borehole; (ii) devices for containing or managing pressures or flows in a borehole that are associated with a subsea riser or a connector; (iii) devices having any number and combination of gates, valves or elastomeric packers for controlling or managing borehole pressures or flows; (iv) a subsea BOP stack, which stack could contain, for example, ram shears, pipe rams, blind rams and annular preventers; and, (v) other such similar combinations and assemblies of flow and pressure management devices to control borehole pressures, flows or both and, in particular, to control or manage emergency flow or pressure situations.

As used herein, unless specified otherwise, the terms "removal of material," "removing material," "remove" and similar such terms should be given their broadest possible meanings. Thus, such terms would include melting, flowing, vaporization, softening, laser induced break down, ablation; as well as, combinations and variations of these, and other processes and phenomena that can occur when directed energy from a laser beam is delivered to a material, object or work surface. Such terms would further include combinations of the forgoing laser induced processes and phenomena with the energy that the fluid jet imparts to the material to be cut. Moreover, irrespective of the processes or phenomena taking place, such terms would include the lessening, opening, cutting, severing or sectioning of the material, object or targeted structure.

As used herein, unless specified otherwise, the terms "workover," "completion" and "workover and completion" and similar such terms should be given their broadest possible meanings and would include activities that place at or near the completion of drilling a well, activities that take place at or the near the commencement of production from the well, activities that take place on the well when the well is a producing or operating well, activities that take place to reopen or reenter an abandoned or plugged well or branch of a well, and would also include for example, perforating, cementing, acidizing, fracturing, pressure testing, the removal of well debris, removal of plugs, insertion or replacement of production tubing, forming windows in casing to drill or complete lateral or branch wellbores, cutting and milling operations in general, insertion of screens, stimulating, cleaning, testing, analyzing and other such activities. These terms would further include applying heat, directed energy, preferably in the form of a high power laser beam to heat, melt, soften, activate, vaporize, disengage, desiccate and combinations and variations of these, materials in a well, or other structure, to remove, assist in their removal, cleanout, condition and combinations and variation of these, such materials.

As used herein, unless specified otherwise, the terms "conveyance structure", "umbilical", "line structure" and similar such terms should be given their broadest possible meanings and may be, contain or be optically or mechanically associated with: a single high power optical fiber; a single high power optical fiber that has shielding; a single high power optical fiber that has multiple layers of shielding; two, three or more high power optical fibers that are surrounded by a single protective layer, and each fiber may additionally have its own protective layer; a fiber support structure which may be integral with or releasable or fixedly attached to an optical fiber (e.g., a shielded optical fiber is clipped to the exterior of a metal cable and lowered by the cable into a borehole); other conduits such as a conduit to carry materials to assist a laser cutter, for example gas, air, nitrogen, oxygen, inert gases; other optical fibers or metal wires for the transmission of data and control information and signals; and any combinations and variations thereof.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Preferably, the conveyance structure may be coiled tubing, a tube within the coiled tubing, jointed drill pipe, jointed drill pipe having a pipe within a pipe, or may be any other type of line structure, that has a high power optical fiber associated with it. As used herein the term "line structure" should be given its broadest meaning, unless specifically stated otherwise, and would include without limitation: wireline; coiled tubing; slick line; logging cable; cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®.

Drilling Wells, Perforating and Hydraulic Fracturing

In the production of natural resources from formations, reservoirs, deposits, or locations within the earth a well or borehole is drilled into the earth to the location where the natural resource is believed to be located. These natural resources may be a hydrocarbon reservoir, containing natural gas, crude oil and combinations of these; the natural resource may be fresh water; it may be a heat source for geothermal energy; or it may be some other natural resource that is located within the ground.

As used herein, unless specified others wise, the terms "formation," "reservoir," "pay zone," and similar terms, are to be given their broadest possible meanings and would include all natural and man made locations, structures, geological features within the earth, all natural and man made locations, structures, geological features within the earth that contain natural resources, such as hydrocarbons, water, or geothermal energy, and all natural and man made locations, structures, geological features within the earth that may contain or are believed to contain natural resources, such as hydrocarbons, water, or geothermal energy.

As used herein, unless specified otherwise, the terms "field," "oil field" and similar terms, are to be given their broadest possible meanings, and would include any area of land, sea floor, water that is loosely or directly associated with a formation, and more particularly with a resource containing formation, thus, a field may have one or more exploratory and producing wells associated with it, a field may have one or more governmental body resource leases associated with it, one or more field(s) may be directly associated with a resource containing formation.

These resource-containing formations may be at or near the surface, at or near the sea floor, a few hundred feet, a few thousand feet, or tens of thousands of feet below the surface of the earth, including under the floor of a body of water, e.g., below the sea floor. In addition to being at various depths within the earth, these formations may cover areas of differing sizes, shapes and volumes.

Unfortunately, and generally, when a well is drilled into these formations the natural resources rarely flow into the well at rates, durations and amounts that are economically viable. This problem occurs for several reasons, some of which are understood, others of which are not as well understood, and some of which may not yet be known. These problems can relate to the viscosity of the natural resource, the porosity of the formation, the geology of the formation, the formation pressures, and the openings that place the resource recovery conduit, e.g., production tubing, in the well in fluid communication with the formation, to name a few.

Typically, and by way of general illustration, in drilling a well an initial borehole is made into the earth or seabed and then subsequent and smaller diameter boreholes are drilled to extend the overall depth of the borehole. Thus, as the overall borehole gets deeper its diameter becomes smaller; resulting in what can be envisioned as a telescoping assembly of holes with the largest diameter hole being at the top of the borehole closest to the surface of the earth.

Thus, by way of example, the starting phases of a subsea drill process may be explained in general as follows. Once the drilling rig is positioned on the surface of the water over the area where drilling is to take place, an initial borehole is made by drilling a 36" hole in the earth to a depth of about 200-300 ft. below the seafloor. A 30" casing is inserted into this initial borehole. This 30" casing may also be called a conductor. The 30" conductor may or may not be cemented into place. During this drilling operation a riser is generally not used and the cuttings from the borehole, e.g., the earth and other material removed from the borehole by the drilling activity, are returned to the seafloor. Next, a 26" diameter borehole is drilled within the 30" casing, extending the depth of the borehole to about 1,000-1,500 ft. This drilling operation may also be conducted without using a riser. A 20" casing is then inserted into the 30" conductor and 26" borehole. This 20" casing is cemented into place. The 20" casing has a wellhead secured to it. (In other operations an additional smaller diameter borehole may be drilled, and a smaller diameter casing inserted into that borehole with the wellhead being secured to that smaller diameter casing.) A BOP is then secured to a riser and lowered by the riser to the sea floor; where the BOP is secured to the wellhead. From this point forward all drilling activity in the borehole takes place through the riser and the BOP.

For a land based drill process, the steps are similar, although the large diameter tubulars, 30"-20" are typically not used. Thus, and generally, there is a surface casing that is typically about 13⅜" diameter. This may extend from the surface, e.g., wellhead and BOP, to depths of tens of feet to hundreds of feet. One of the purposes of the surface casing is to meet environmental concerns in protecting ground water. The surface casing should have sufficiently large diameter to allow the drill string, product equipment such as ESPs and circulation mud to pass by. Below the casing one or more different diameter intermediate casings may be used. (It is understood that sections of a borehole may not be cased, which sections are referred to as open hole.) These can have diameters in the range of about 9" to about 7", although larger and smaller sizes may be used, and can extend to depths of thousands and tens of thousands of feet. Inside of the casing and extending from a pay zone, or production zone of the borehole up to and through the wellhead on the surface is the production tubing. There may be a single production tubing or multiple production tubings in a single borehole, with each of the production tubing ending at different depths.

Typically, when completing a well, it is necessary to perform a perforation operation, and also in some instances perform a hydraulic fracturing, or fracing operation. In general, when a well has been drilled and casing, e.g., a metal pipe, is run to the prescribed depth, the casing is typically cemented in place by pumping cement down and into the annular space between the casing and the earth. The casing, among other things, prevents the hole from collapsing and fluids from flowing between permeable zones in the annulus. (In some situations only the metal casing is present, in others there may be two metal casing present one inside of the other, there may be more that two metal casing present each inside of the other, in still others the metal casing and cement are present, and in others there could be other configurations of metal, cement and metal; and in others there may be an open hole, e.g., no casing, liner or cement is present, at the location of interest in the borehole.) Thus, this casing forms a structural support for the well and a barrier to the earth.

While important for the structural integrity of the well, the casing and cement present a problem when they are in the production zone. Thus, in addition to holding back the earth, they also prevent the hydrocarbons from flowing into the well and from being recovered. Additionally, the formation itself may have been damaged by the drilling process, e.g., by the pressure from the drilling mud, and this damaged area of the formation may form an additional barrier to the flow of hydrocarbons into the well. Similarly, in most situations where casing is not needed in the production area, e.g., open hole, the formation itself is generally tight, and more typically can be very tight and thus will not permit the hydrocarbons to flow into the well. (In some situations the formation pressure is large enough that the hydrocarbons readily flow into the well in an uncased, or open hole. Nevertheless, as formation pressure lessens a point will be reached where the formation itself shuts-off, or significantly reduces, the flow of hydrocarbons into the well. Also the low formation pressure could prevent fluid from flowing from the bottom of the borehole to the surface, requiring the use of artificial lift.)

To overcome this problem of the flow of hydrocarbons into the well being blocked by the casing, cement and the formation itself, openings, e.g., perforations, are made in the well in the area of the pay zone. Generally, a perforation is a small, about ¼" to about 1" or 2" in diameter hole that extends through the casing, cement and damaged formation and goes into the formation. This hole creates a passage for the hydrocarbons to flow from the formation into the well. In a typical well a large number of these holes are made through the casing and into the formation in the pay zone.

Generally, in a perforating operation a perforating tool or gun is lowered into borehole to the location where the production zone or pay zone is located. The perforating gun is a long, typically round tool, that has a small enough diameter to fit into the casing or tubular and reach the area within the borehole where the production zone is believed to be. Once positioned in the production zone a series of explosive charges, e.g., shaped charges, are ignited. The hot gases and molten metal from the explosion cut a hole, i.e., the perf or perforation, through the casing and into the formation. These explosive made perforation, may only extend a few inches, e.g., 6" to 18" into the formation. In hard rock formations the explosive perforation device may only extend an inch or so, and may function poorly, if at all. Additionally, because these perforations are made with explosives they typically have damages areas, which include, loose rock and perforation debris along the bottom of the hole; and a damaged zone extending annularly around the hole. Beyond the damaged zone is a virgin zone extending annularly around the damage zone. The damage zone, which typically encompasses the entire hole, generally, greatly reduces the permeability of the formation. This has been a long standing, and unsolved problem, among others, with the use of explosive perforations. The perforation holes are made to get through one group of obstructions to the flow of hydrocarbons into the well, e.g., the casing, and in doing so they create a new group of these obstructions, e.g., the damage area encompassing the perforation holes.

The ability, or ease, by which the natural resource can flow out off the formation and into the well or production tubing (into and out of, for example, in the case of engineered geothermal wells, and some advanced recovery methods for hydrocarbon wells) can generally be understood as the fluid communication between the well and the formation. As this fluid communication is increased several enhancements or benefits may be obtained: the volume or rate of flow (e.g., gals per minute) can increase; the distance within the formation out from the well where the natural resources will flow into the well can be increase (e.g., the volume and area of the formation that can be drained by a single well is increased and it will thus take less total wells to recover the resources from an entire field); the time period when the well is producing resources can be lengthened; the flow rate can be maintained at a higher rate for a longer period of time; and combinations of these and other efficiencies and benefits.

Fluid communication between the formation and the well can be greatly increased by the use of hydraulic fracturing techniques. The first uses of hydraulic fracturing date back to the late 1940s and early 1950s. In general, hydraulic fracturing treatments involve forcing fluids down the well and into the formation, the fluids enter the formation and crack open the rock, e.g., force the layers of rock to break apart or fracture. These fractures create channels or flow paths that may have cross sections of a few millimeters, to several millimeters, to several centimeters, and potentially larger. The fractures may also extend out from the well in all directions for a few feet, several feet and tens of feet or further. It should be remembered that no wellbore or branch of a wellbore is perfectly vertical or horizontal. The longitudinal axis of the well bore in the reservoir will most likely be on an angle to both the vertical and the horizontal directions. The borehole could be sloping up or down or on occasion be mostly horizontal. The section of the well bore located within the reservoir, i.e. the section of the formation containing the natural resources, can be called the pay zone. For example, in the recovery of shale gas and oil the wells are typically essentially horizontal in the reservoir.

Generally, in a hydraulic fracturing operation a mixture of typically a water based fluid with sand or other small particles, e.g., proppants, is forced into the well and out into the formation (if the well is perforated the fracturing fluid is forced out and through one or more of the perforations and into the formation). The fluids used to perform hydraulic fracture can range from very simple to multicomponent formulations, e.g., water, water containing gelling agents to increase the viscosity of the fracturing fluid. Additionally, these fluids, e.g., fracing fluids or fracturing fluids, typically carry with them Propping Agents (proppants). Proppants are small particles, e.g., grains of sand or other material, that are flowed into the fractures and hold open the fractures when the pressure of the fracturing fluid is reduced and the fluid is removed to allow the resource, e.g., hydrocarbons, to flow into the well. In this manner the proppants hold open the fractures, keeping the channels open so that the hydrocarbons can more readily flow into the well. Additionally, the fractures greatly increase the surface area from which the hydrocarbons can flow into the well. Proppants may not be needed, or generally may not be used when acids are used to create a frac and subsequent channel in a carbonate rich reservoir where the acids dissolve part or all of the rock leaving an opening for the formation fluids to flow to the wellbore.

Typical fluid volumes in a propped fracturing treatment of a formation in general can range from a few thousand to a few million gallons. Proppant volumes can be several thousand cubic feet, and can approach several hundred thousand cubic feet. For example, for a single well 3-5 million gallons of water may be used and pressures may be in the range of about 500 psi and greater, at least about 1,000 psi, about 5,000 psi to about 10,000 psi, as high as 15,000 psi and potentially higher. As the fracturing fluid and proppants are forced into the formation at high injection rate, the bottom hole pressure increases enough to overcome the stresses and the rock tensile strength so that the formations breaks or fractures. Sometimes the breaks occur along planes of weakness that are called joints. Naturally occurring joints in the formation may also be opened, expanded and propagated by the fluid. In order to keep these newly formed and enlarged fractures, cracks or joints open, once the pressure and fluid are removed, the proppants are left behind. They in essence hold open, i.e., "prop" open, the newly formed and enlarged fractures, cracks, or joints in the formation.

Additionally, hydraulic fracturing has come under public and consequentially regulatory scrutiny for environmental reasons. This scrutiny has looked to such factors as: the large amounts of water used; the large amounts of vehicles, roads and other infrastructure needed to perform a fracturing operation; potential risks to ground water; potential risks of seismic activities; and potential risks from additives to the water, among other things.

SUMMARY

In the acquisition of natural sources, such as oil and natural gas, there exists a long felt need to have safe, controllable and predictable ways to establish and enhance fluid communication between the resource containing formation and the well bore. Incremental improvements in explosive perforating guns, and other conventional techniques have not met these long felt needs. It is the present inventions, among other things, that solve these needs by providing the articles of manufacture, devices and processes taught herein.

Thus, there is provided a method of producing hydrocarbons from a formation, the method having the operations of: identifying a stress in the formation in an area of the formation adjacent to a location along a borehole; positioning a laser perforating tool in the borehole at the location; determining the position of a laser beam path, the laser beam path position based at least in part upon the stress in the formation; delivering a high power laser beam having at least about 5 kW of power along a laser beam path, whereby the laser beam creates a laser perforation; and, flowing a fracturing fluid under pressure down the borehole, through the laser perforation and into the formation, whereby the formation is hydraulically fractured with minimal near bore hole tortuosity.

There is further provided stimulation methods, perforation methods, production of hydrocarbon methods, or fracturing methods in which one or more of the following also may be present: wherein the location along the borehole is at about 5,000 feet or more measured depth and the laser beam has a power of at least about 10 kW; wherein the location along the borehole is at about 10,000 feet or more measured depth depth and the laser beam has a power of at least about 10 kW; wherein the location along the borehole is at about 5,000 feet or more measured depth and the laser beam has a power of at least about 15 kW; wherein the location along the borehole is at about 10,000 feet or more measured depth depth and the laser beam has a power of at least about 15 kW; wherein the identification of stress in the formation including using laser adaptive fracturing; wherein the laser adaptive fracturing including creating a first laser perforation, performing a mini-fracture through the laser perforation, and evaluating the mini-fracture to identify a formation condition; wherein the acts of perforating and mini-fracturing are repeated, and the formation condition is a preferred stress plane for the formation; wherein the laser beam path follows the preferred stress plane; wherein the laser beam path is positioned in the preferred stress plane; wherein the laser beam path is positioned in and parallel with the preferred stress plane; wherein the identified stress including a preferred stress plane and the laser beam path follows the preferred stress plane; wherein the identified stress including a preferred stress plane and the laser beam path is positioned in the preferred stress plane; wherein the identification of stress in the formation including using laser adaptive fracturing; wherein the laser adaptive fracturing including creating a first laser perforation, performing a mini-fracture through the laser perforation, and evaluating the mini-fracture to identify a formation condition; wherein the laser perforating tool including a tractor section, and a laser cutting head section; wherein the laser perforating tool including a tractor section, and a laser cutting head section; wherein the laser perforating tool including a tractor section, a laser cutting head section, and a means to axially extend the laser cutting head section; and the means to axially extend the laser cutting section including a motor a controller and an advancement screw; and, wherein the laser perforating tool is located within a laser hydraulic fracturing apparatus, the laser hydraulic fracturing apparatus having a packer assembly.

Additionally, there is provided a method of stimulating a well, including: positioning a laser perforating tool in the borehole at a location in a formation; delivering a plurality of high power laser beams, each having at least about 10 kW of power, in a plurality of predetermined laser beam patterns; the laser beam patterns position at the location and extending along a length of the borehole, wherein the position of the laser beam patterns is based at least in part upon a stress plane in the formation; whereby each laser beam creates a discrete volumetric removal having a predetermined shape defining a laser perforation; and, flowing a fracturing fluid under pressure down the borehole, through the laser perforation and into the formation, whereby the formation is hydraulically fractured.

Yet further there is provided stimulation methods, perforation methods, production of hydrocarbon methods, or fracturing methods in which one or more of the following also may be present: wherein the shape of the laser beam patterns is predetermined at least in part to reduce near borehole tortuosity; wherein the position of the laser beam patterns is based at least in part to reduce near borehole tortuosity; wherein the shape of the laser beam patterns is predetermined at least in part to reduce near borehole tortuosity and the position of the laser beam patterns is based at least in part to reduce near well bore tortuosity; wherein the shape of the laser beam patterns is at least in part reduces near borehole tortuosity; wherein the position of the laser beam patterns at least in part reduces near borehole tortuosity; wherein the shape of the laser beam patterns is at least in part essentially eliminates near borehole tortuosity; wherein the position of the laser beam patterns at least in part essentially eliminates near borehole tortuosity; wherein the shape of the laser beam patterns is at least in part essentially eliminates the adverse flow characteristics associated with near borehole tortuosity; wherein the position of the laser beam patterns at least in part essentially eliminates the adverse flow characteristics associated with near borehole tortuosity; wherein the shape of the laser beam patterns is predetermined at least in part to reduce near borehole tortuosity and the position of the laser beam patterns is based at least in part to reduce near well bore tortuosity; wherein the location along the borehole is at about 5,000 feet or more measured depth and the laser beam has a power of at least about 10 kW; wherein the location along the borehole is at about 10,000 feet or more measured depth and the laser beam has a power of at least about 10 kW; wherein the location along the borehole is at about 5,000 feet or more measured depth and the laser beam has a power of at least about 15 kW; wherein the location along the borehole is at about 10,000 feet or more measured depth and the laser beam has a power of at least about 15 kW; wherein the location along the borehole is at about 5,000 feet or more measured depth and the laser beam has a power of at least about 10 kW; wherein the location along the borehole is at about 5,000 feet or more measured depth and the laser beam has a power of at least about 10 kW; wherein the laser perforating tool including a tractor section, and a laser cutting head section; wherein the laser perforating tool including a tractor section, a laser cutting head section, and a means to axially extend the laser cutting head section; wherein the laser perforating tool including a tractor section, a laser cutting head section, and a means to axially extend the laser cutting head section; and the means to axially extend the laser cutting section including a motor a controller and an advancement screw; wherein the laser perforating tool including a tractor section, a laser cutting head section, and a means to axially extend the laser cutting head section; wherein the laser perforating tool is located within a laser hydraulic fracturing apparatus, the laser hydraulic fracturing apparatus having a packer assembly; and, wherein the laser perforating tool is located within a laser hydraulic fracturing apparatus, and the laser hydraulic fracturing apparatus having a packer assembly.

Additionally, there is provided a method of hydraulically fracturing a well, which method includes the activities of: positioning a laser hydraulic fracturing assembly in the borehole at a location in a formation; delivering a plurality of high power laser beams, each having at least about 10 kW of power, in a plurality of predetermined laser beam patterns; the laser beam patterns positioned at the location and extending along a length of the borehole, wherein the position of the laser beam patterns is based at least in part upon a stress plane in the formation; whereby each laser beam creates a discrete volumetric removal having a predetermined shape defining a laser perforation; and, flowing a fracturing fluid under pressure down the borehole, through the laser perforation and into the formation, whereby the formation is hydraulically fractured.

Moreover, there is provided stimulation methods, perforation methods, production of hydrocarbon methods, or fracturing methods in which one or more of the following also may be present: wherein the shape of the laser beam patterns is predetermined at least in part to reduce near borehole tortuosity; wherein the position of the laser beam patterns is based at least in part to reduce near borehole tortuosity; and wherein the location along the borehole is at about 5,000 feet or more measured depth and the laser beam has a power of at least about 10 kW; wherein the shape of the laser beam patterns is predetermined at least in part to reduce near borehole tortuosity and the position of the laser beam patterns is based at least in part to reduce near well bore tortuosity; wherein the shape of the laser beam patterns at least in part reduces near borehole tortuosity; and wherein the location along the borehole is at about 5,000 feet or more measured depth and the laser beam has a power of at least about 10 kW; wherein the shape of the laser beam patterns at least in part essentially eliminates near borehole tortuosity; wherein the position of the laser beam patterns at least in part essentially eliminates near borehole tortuosity; and wherein the location along the borehole is at about 5,000 feet or more measured depth and the laser beam has a power of at least about 10 kW; and, wherein the shape of the laser beam patterns at least in part essentially eliminates the adverse flow characteristics associated with near borehole tortuosity.

Still additionally, there is provided a method of stimulating a well, including: positioning a laser beam delivery head in the borehole at a location in a formation, the location being at a measured depth of at least 5,000 ft; delivering a plurality of high power laser beams, each having at least about 10 kW of power, in a plurality of predetermined laser beam patterns; the laser beam patterns positioned at the location and extending along a length of the borehole, wherein the position of the laser beam patterns is based at least in part upon a stress plane in the formation; whereby each laser beam creates a discrete volumetric removal having a predetermined shape defining a laser perforation; and, flowing a fracturing fluid under pressure down the borehole, through the laser perforation and into the formation, whereby the formation is hydraulically fractured.

Moreover, there is provided stimulation methods, perforation methods, production of hydrocarbon methods, or fracturing methods in which one or more of the following also may be present: wherein the stress plane is a preferred stress plane; wherein the identified stress including a preferred stress plane and at least one volumetric removal follows the preferred stress plane; wherein the identified stress including a preferred stress plane and the volumetric removals follow the preferred stress plane; wherein the identified stress including a preferred stress plane and at least one volumetric removal is positioned in and parallel with the preferred stress plane; having identifying the stress in the formation using laser adaptive fracturing; and, wherein at least one volumetric removal follows the stress plane; wherein the volumetric removals follow the stress plane; wherein at least one volumetric removal is positioned in and parallel with the preferred stress plane; wherein the volumetric removals are positioned in and parallel with the stress plane; wherein the fracturing fluid is slick water; wherein the fracturing fluid including a proppant; wherein the proppant is a sand; wherein the location in the borehole is substantially vertical; wherein the location in the borehole is substantially horizontal; wherein the borehole has a TVD of at least about 5,000 ft, a MD of at least about 15,000, and a substantially horizontal section having a length of at least about 5,000 ft; wherein the borehole has a TVD of at least about 5,000 ft, a MD of at least about 15,000, and a substantially horizontal section having a length of at least about 5,000 ft; wherein the borehole has a TVD of at least about 5,000 ft, a MD of at least about 15,000, and a substantially horizontal section having a length of at least about 5,000 ft; wherein the volumetric removals are in the shape of a disc, each having a volume removed of greater than about 1 cubic inches; wherein at least one volumetric removal is in the shape of a disc having a volume removed of greater than about 1 cubic inches; wherein at least one volumetric removal is in the shape of a disc having a volume removed of greater than about 1 cubic inches; wherein at least one volumetric removal is in the shape of a disc having a volume removed of greater than about 1 cubic inches; wherein at least one volumetric removal is in the shape of a disc having a volume removed of greater than about 1 cubic inches; wherein at least one volumetric removal is in the shape of a disc having a volume removed of greater than about 7 cubic inches; wherein the volumetric removals are in the shape of a disc, each disc having a volume removed of greater than about 7 cubic inches; wherein for each volumetric removal the volume removed is greater than about 7 cubic inches; wherein for each volumetric removal the volume removed is greater than about 50 cubic inches; wherein the volumetric removal is in the shape of a disc having a volume removed of greater than about 7 cubic inches; wherein the volumetric removal is in the shape of a disc having a volume removed of greater than about 50 cubic inches; wherein the volumetric removal is in the shape of a disc having a volume removed of greater than about 100 cubic inches; wherein the plurality of volumetric removals including at least four discrete shapes; wherein the plurality of volumetric removals including at least five discrete shapes; wherein the plurality of volumetric removals including at least six discrete shapes; wherein the plurality of volumetric removals including at least four discrete shapes; wherein the plurality of volumetric removals including at least five discrete shapes; wherein the plurality of volumetric removals including at least four discrete shapes; and wherein the removed volume for each discrete shape is at least 7 cubic inches; wherein the plurality of volumetric removals including at least five discrete shapes; and wherein the removed volume for each discrete shape is at least 7 cubic inches; wherein the plurality of volumetric removals including at least six discrete shapes; and wherein the removed volume for each discrete shape is at least 7 cubic inches; wherein the plurality of volumetric removals including at least four discrete shapes; and wherein the removed volume for each discrete shape is at least 50 cubic inches; wherein the plurality of volumetric removals including at least five discrete shapes; and wherein the removed volume for each discrete shape is at least 50 cubic inches; wherein the plurality of volumetric removals including at least six discrete shapes; and wherein the removed volume for each discrete shape is at least 50 cubic inches; wherein the volumetric removals are each in the shape of a rectangular slot; wherein at least one volumetric removal is in the shape of a rectangular slot having a volume removed of greater than about 100 cubic inches; wherein at least one volumetric removal is in the shape of a rectangular slot having a volume removed of greater than about 150 cubic inches; wherein at least one volumetric removal is in the shape of a rectangular slot having a volume removed of greater than about 100 cubic inches; and, wherein at least one volumetric removal is in the shape of a rectangular slot having a volume removed of greater than about 150 cubic inches.

Moreover there is provided a method of producing hydrocarbons from a formation, including: identifying stresses in the formation in an area of the formation adjacent to a location along a borehole; positioning a laser perforating tool in the borehole at the location; delivering a high power laser beam having at least about 5 kW of power in a predetermined laser beam pattern, the laser beam pattern position based at least in part upon the stresses in the formation; whereby the laser beam volumetrically removes a material in the shape of the laser beam pattern creating a laser perforation; and, flowing a fracturing fluid under pressure down the borehole, through the laser perforation and into the formation, whereby the formation is hydraulically fractured.

Furthermore, there is provided stimulation methods, perforation methods, production of hydrocarbon methods, or fracturing methods in which one or more of the following also may be present: wherein the material removed consists of the formation; wherein the material removed consists of the formation; wherein the material removed includes a coiled tubing; wherein the material removed includes a casing and the formation; wherein the material removed is a casing; wherein the material removed is a first tubular and a second tubular surrounding the first tubular; wherein the material removed is a casing; wherein the material removed is a first tubular and a second tubular surrounding the first tubular and the formation; wherein the material removed includes a casing, a cement, and the formation; wherein the laser adaptive fracturing including creating a first laser perforation, performing a mini-fracture through the laser perforation, and evaluating the mini-fracture to identify a formation condition; and, wherein the laser adaptive fracturing including creating a first laser perforation, performing a mini-fracture through the laser perforation, and evaluating the mini-fracture to identify a formation condition; wherein the identified stress including a preferred stress plane and the laser beam pattern follows the preferred stress plane.

Yet moreover there is provided a method of laser hydraulic fracturing a well, the method having the steps of: positioning a laser perforating tool in the borehole at a location in a formation; delivering a plurality of high power laser beams each having at least about 10 kW of power in a plurality of predetermined laser beam patterns, the laser beam patterns position at the location and extending along a length of the borehole, wherein the position of the laser beam patterns is based at least in part upon a stress plane in the formation; whereby each laser beam creates a discrete volumetric removal having a predetermined shape defining a laser perforation; and, flowing a fracturing fluid under pressure down the borehole, through the laser perforation and into the formation, whereby the formation is hydraulically fractured.

Still further, there is provided stimulation methods, perforation methods, production of hydrocarbon methods, or fracturing methods in which one or more of the following also may be present: wherein each laser perforation defines an opening in a casing in the borehole, wherein each opening is a circle, and wherein the diameters of each opening vary by no more than about 2%; wherein each laser perforation defines an opening in a casing in the borehole having an opening edge, wherein each opening is a circle, and wherein each opening edge is essentially burr free; wherein each laser perforation defines an opening in a casing in the borehole having an opening edge, wherein each opening is a circle, and wherein each opening edge is essentially smooth; and wherein near borehole tortuosity is essentially not present; wherein near borehole tortuosity is not present.

Additionally there is provided a method of drilling a well in a shale reservoir, including: advancing a bore hole to and into a shale reservoir, the borehole having an essentially vertical component and essentially horizontal component, the borehole having a TVD of greater than 1,000 feet and a MD of greater than about 5,000 ft, deploying a laser hydraulic fracturing apparatus in the borehole; cutting a laser perforation pattern into the formation; activating a first packer and a second packer, whereby the packers define a first stage, hydraulically fracturing the first stage.

Still further there is provided a method of drilling wherein the laser hydraulic fracturing apparatus includes a laser perforating tool, and wherein the laser perforating tool in part defines a seal for the fracturing stage.

Yet further, there is provided a method wherein the laser hydraulic fracturing apparatus including a laser perforating tool, and the laser perforating tool remains in the horizontal section of the borehole during the hydraulic fracturing.

Still further there is provided a method of drilling a well in a reservoir, including: advancing a bore hole to and into a reservoir, the borehole having an essentially vertical component and essentially horizontal component, the borehole having a TVD of greater than 1,000 feet and a MD of greater than about 5,000 ft, deploying a laser hydraulic fracturing apparatus in the borehole, the apparatus having a plurality of means for sealing against an inner wall of the borehole, a laser perforating tool, a high power laser conveyance structure, a means for axially advancing a laser cutter, and a means for sealing against the laser perforating tool or the laser conveyance structure; cutting a laser perforation pattern into the formation; sealing the borehole below the laser perforation and hydraulically fracturing the formation.

Yet further, there is provided a laser hydraulic fracturing assembly, the assembly having: a connector for connecting to a tubular; a first and a second, outwardly sealing, sealing assemblies; a laser perforating tool, having a sealing section, the sealing section having a high power laser conveyance structure; and, an inwardly sealing, sealing assembly, whereby the inwardly sealing assembly is capable of forming a seal with the sealing section that is capable of withstanding the pressure and flow of hydraulic fracturing.

There is provided a method of producing hydrocarbons from a formation, the method having the operations of: identifying a stress in the formation in an area of the formation adjacent to a location along a borehole; positioning a laser perforating tool in the borehole at the location; determining the position of a laser beam path, the laser beam path position based at least in part upon the stress in the formation; delivering a high power laser beam having at least about 5 kW of power along a laser beam path, whereby the laser beam creates a laser perforation.

Additionally, there is provided a method of stimulating a well, including: positioning a laser perforating tool in the borehole at a location in a formation; delivering a plurality of high power laser beams, each having at least about 10 kW of power, in a plurality of predetermined laser beam patterns; the laser beam patterns position at the location and extending along a length of the borehole, wherein the position of the laser beam patterns is based at least in part upon a stress plane in the formation; and, whereby each laser beam creates a discrete volumetric removal having a predetermined shape defining a laser perforation.

Additionally, there is provided a method of producing hydrocarbons, which method includes the activities of: positioning a laser hydraulic fracturing assembly in the borehole at a location in a formation; delivering a plurality of high power laser beams, each having at least about 10 kW of power, in a plurality of predetermined laser beam patterns; the laser beam patterns positioned at the location and extending along a length of the borehole, wherein the position of the laser beam patterns is based at least in part upon a stress plane in the formation; and, whereby each laser beam creates a discrete volumetric removal having a predetermined shape defining a laser perforation.

Still additionally, there is provided a method of stimulating a well, including: positioning a laser beam delivery head in the borehole at a location in a formation, the location being at a measured depth of at least 5,000 ft; delivering a plurality of high power laser beams, each having at least about 10 kW of power, in a plurality of predetermined laser beam patterns; the laser beam patterns positioned at the location and extending along a length of the borehole, wherein the position of the laser beam patterns is based at least in part upon a stress plane in the formation; and, whereby each laser beam creates a discrete volumetric removal having a predetermined shape defining a laser perforation.

Moreover there is provided a method of producing hydrocarbons from a formation, including: identifying stresses in the formation in an area of the formation adjacent to a location along a borehole; positioning a laser perforating tool in the borehole at the location; delivering a high power laser beam having at least about 5 kW of power in a predetermined laser beam pattern, the laser beam pattern position based at least in part upon the stresses in the formation; and, whereby the laser beam volumetrically removes a material in the shape of the laser beam pattern creating a laser perforation.

Yet moreover, there is provided a method of stimulation including: positioning a laser perforating tool in the borehole at a location in a formation; delivering a plurality of high power laser beams each having at least about 10 kW of power in a plurality of predetermined laser beam patterns, the laser beam patterns position at the location and extending along a length of the borehole, wherein the position of the laser beam patterns is based at least in part upon a stress plane in the formation; and, whereby each laser beam creates a discrete volumetric removal having a predetermined shape defining a laser perforation.

DESCRIPTION OF THE PREFERRED EMBODIMENTS

Figure 1:
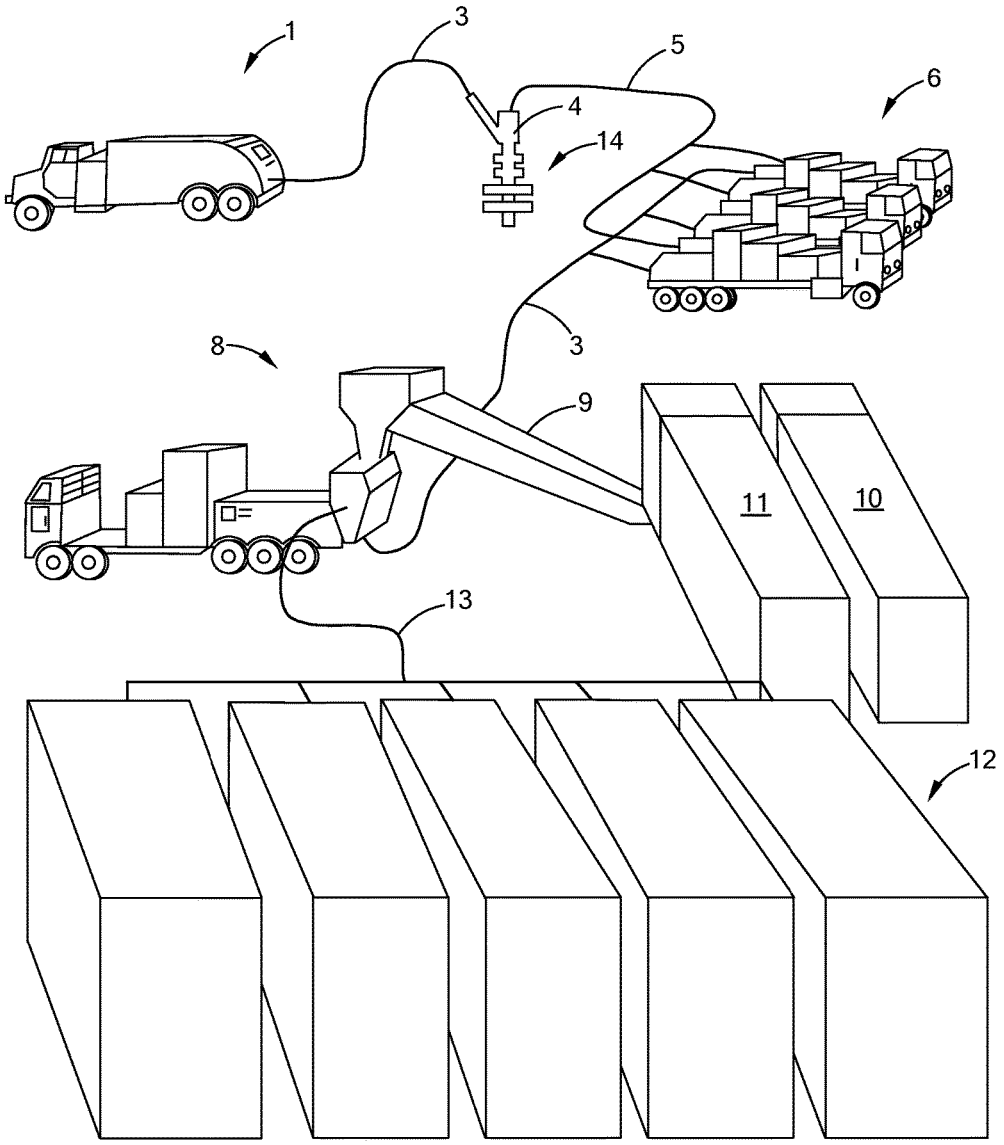
FIG. 1 is a schematic perspective view of an embodiment of a laser hydraulic fracturing field site in accordance with the present inventions.

In general, the present inventions relate to systems, methods and tools to establish and enhance fluid communication between a natural resource containing formation and a well bore. In particular, the present inventions relate to hydraulic fracturing using high power lasers, high power laser tools, laser perforating, laser fracturing, and laser opening, increasing and enhancing the flow of natural resources, such as hydrocarbons and geothermal, from a formation into a production tubing or collection system. The present inventions, among other things, provide improved performance, efficiency and safety over conventional explosive based perforating guns and high pressure jetting with solids laden fluids, as well as, provide for the precise and predetermined placement of laser beam energy, in precise and predetermined energy distribution patterns. These patterns can be tailored and customized to, for example, the particular geological and structural features of a formation and pay zone, the response of the pay zone to fracturing, and other customized and adaptive hydraulic fracturing and stimulation implementations. Thus, giving rise, among other things, to never before seen, or obtainable customization of perforating and fracturing patterns and activities to precisely match the formation and geologic conditions.

Generally, once a borehole has been drilled to the desired depth and position in a formation a laser field unit is positioned near the well head. The laser field unit may have already been present at the field for laser drilling, laser pipe cutting or other laser oil field related operations. Further, the laser field unit may be close or further removed from the well head, depending upon the specific logistical constrains and considerations of the well site, as the high power laser energy can be transmitted over long distances. Although this specification focuses on hydrocarbon recovery, e.g., oil and natural gas, this focus is illustrative and it should be understood that the present inventions and their utilization have broader applications and uses. The high power laser field unit has a high power laser that provides a high power laser beam, e.g., 5 kW, 10 kW, 20 kW or more. The laser is in optical communication with a high power laser conveyance structure, which transmits the laser beam from the laser down the borehole to the location in the well where the laser hydraulic fracturing process is to occur. The high power laser beam is delivered to the borehole surface to remove material from the surface, the formation and both. Thus, the laser beam creates an opening in the borehole surface and into the formation. The laser beam delivery device can then be moved in the borehole, or taken out of the borehole entirely, as the laser cut area is isolated and the fracturing fluid is pumped into the well and into the laser made opening to fracture the formation.

In general, the laser beam has the ability to be shaped and delivered in predetermined and preselected patterns, having predetermined energy distributions, including, lines, slots, holes, and other shapes that create volumetric removals. The laser beams also have the ability to provide custom shaped openings, such as, smooth edges (e.g., bur-free), bevels, tapers, curves, lips, etc., that, for example, will provide for better control of proppants through casing into the formation, the building of a better proppant pack, the ease of moving packers and other down hole equipment into and out of the well bore, and other well operation, completion, and fracturing fluid flow enhancements. These volumetric removals can be customized for a particular formation, completion strategy, other factors and considerations, and combinations and variations of these.

Further, the laser beam delivery patterns and their resultant volumetric removals can be adapted during the hydraulic fracturing process. Thus, the laser beam delivery pattern can be shaped and predetermined, while the delivery tool is down hole or above ground, and in response to down hole information, such as for example in response to pressure data and flow data obtained during a fracturing stage. In this manner, the laser hydraulic fracturing process can be customized during the fracturing stages, by cutting new, different, or adapted openings to enhance a subsequent stage in a fracturing operation, correct a less than optimal result from an earlier fracturing stage, and combinations and variations of these.

Further, the laser beam and the volumetric removal patterns can be customized, or predetermined, to perform operations such as correction of fracture jobs, reentry and other recompletion, or activities for increase the production of a failing or failed well. The laser beam may additionally be used to seal openings, such as perforations in or damaged sections of casing, which could then enable the fracing of a different zone or area of the well. The laser's ability to seal and the remove material from the borehole in a selected and predetermined manner, as well as in a repeating manner, provides the capabilities to address many and varied production and completion related problems and difficulties, such as for example if a zone is producing water and/or gas.

Turning to FIG. 1 there is provided a perspective view of an embodiment of a laser hydraulic fracturing site 1. Thus, positioned near the well head 14 there is a laser field unit 2, pumping trucks 6, proppant storage containers 10, 11, a proppant feeder assembly 9, a blender, (e.g., mixing truck) 8, and fracturing fluid holding units 12. As will be understood by one of skill in the hydraulic fracturing arts, FIG. 1 is an illustration and simplification of a fracturing site. Such sites may have more, different, and other pieces of equipment such as pumps, holding tanks, mixers, and chemical holding units, mixing and addition equipment, lines, valves and transferring equipment, as well as control and monitoring equipment.

The laser field unit has a high power laser conveyance structure or laser umbilical 3, which enters the well head 14 through laser fracturing adapter 4. The laser fracturing adapter 4 has a high pressure line 5 that transfers high pressure fracturing fluid from the pump trucks 6 into the well. The laser fracturing adapter 4 has packers or other pressure managing apparatus, known to those of skill in the art, to enable the insertion and removal of a laser fracturing sub, a laser fracturing tool, a laser perforating tool and the movement of the laser umbilical into and out of the well. The well head 4 may also have further well control devices associated with it, such as a BOP.

Fracturing fluid from holding units 12 is transferred through lines 13 to mixing truck 8, where proppant from storage containers 10, 11 is feed by assembly 9 and mixed with the fracturing fluid. The fracturing fluid and proppant mixture is the transferred to the pump trucks 6, by line 7.

In this manner the laser perforating and cutting applications can take place, the well can be appropriately isolated, e.g., a fracture stage, zone or predetermined section, and the fracturing fluid can be pumped into the well under pressure to fracture the formation.

Figure 2:
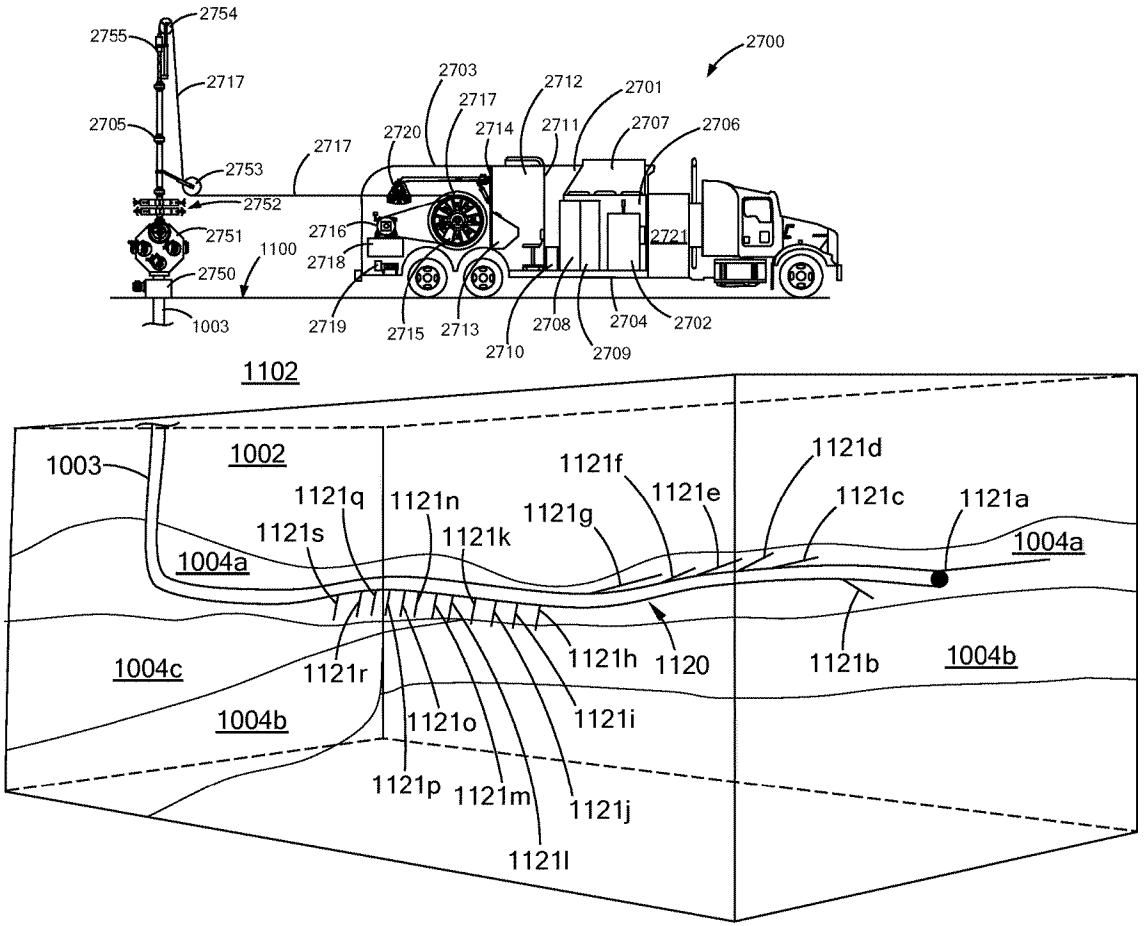
FIG. 2 is a perspective view of an embodiment of laser system providing an embodiment of a laser energy delivery pattern in accordance with the present inventions.

An embodiment of a high power laser system and its deployment and use in the field, to provide a custom laser perforation and fracturing pattern to a formation, is shown in FIG. 2. Thus, there is provided a laser field unit, such as the embodiment of a mobile laser conveyance truck (MLCT) 2700. The MLCT 2700 has a laser cabin 2701 and a handling apparatus cabin 2703, which is adjacent the laser cabin. The laser cabin 2701 and the handling cabin 2703 are located on a truck chassis 2704. In this embodiment the delivery tool could be any of the laser delivery tools of the embodiments in this specification.

The laser cabin 2701 houses a high power fiber laser 2702, (e.g., 20 kW; wavelength of 1070-1080 nm); a chiller assembly 2706, which has an air management system 2707 to vent air to the outside of the laser cabin and to bring fresh air in to the chiller (not shown in the drawing). The laser cabin also has two holding tanks 2708, 2709. These tanks are used to hold fluids needed for the operation of the laser and the chiller during down time and transit. The tanks have heating units to control the temperature of the tank and in particular to prevent the contents from freezing, if power or the heating and cooling system for the laser cabin was not operating. A control system 2710 for the laser and related components is provided in the laser cabin 2703. A partition 2711 separates the interior of the laser cabin from the operator booth 2712.

The operator booth contains a control panel and control system 2713 for operating the laser, the handling apparatus, and other components of the system. The operator booth 2712 is separated from the handling apparatus cabin 2703 by partition 2714.

The handling apparatus cabin 2703 contains a spool 2715 (e.g., about 6 ft OD, barrel or axle OD of about 3 feet, and a width of about 6 feet) holding about 10,000 feet of the conveyance structure 2717. The spool 2715 has a motor drive assembly 2716 that rotates the spool. The spool has a holding tank 2718 for fluids that may be used with a laser tool or otherwise pumped through the conveyance structure and has a valve assembly for receiving high pressure gas or liquids for flowing through the conveyance structure.

The laser 2702 is optically associated with the conveyance structure 2717 on the spool 2715 by way of an optical fiber and optical slip ring (not shown in the figures). The fluid tank 2718 and the valve assembly 2719 are in fluid communication with the conveyance structure 2717 on the spool 2715 by way of a rotary slip ring (not shown).

The laser cabin 2701 and handling apparatus cabin 2703 have access doors or panels (not shown in the figures) for access to the components and equipment, to for example permit repair, replacement and servicing. At the back of the handling apparatus cabin 2703 there are door(s) (not shown in the figure) that open during deployment for the conveyance structure to be taken off the spool. The MLCT 2700 has an electrical generator 2721 to provide electrical power to the system.

The MLCT 2700 is on the surface 1100 of the earth 1102, positioned near a wellhead 2750 of a borehole 1003, and having a Christmas tree 2751, a BOP 2752 and a lubricator 2705. The conveyance structure 2717 travels through winder 2720 (e.g., line guide, level wind) to a first sheave 2753, to a second sheave 2754, which has a weight sensor 2755 associated with it. Sheaves 2753, 2754 make up an optical block, which is a combination of sheaves to provide for a path, or configuration of the conveyance structure, and also to permit the movement of the conveyance in and out of the borehole, while not significantly interfering with, or otherwise significantly adversely affecting the transmission of the high power laser beam. The weight sensor 2755 may be associated with sheave 2753 or the conveyance structure 2717. The conveyance structure 2717 enters into the top of the lubricator and is advanced through the BOP 2752, tree 2751 and wellhead 2750 into the borehole 1003 below the surface of the earth 1100. The sheaves 2753, 2754 have a diameter of about 3 feet. In this deployment path for the conveyance structure the conveyance structure passes through several radii of curvature, e.g., the spool and the first and second sheaves. These radii are all equal to or large than the minimum bend radius of the high power optical fiber in the conveyance structure. Thus, the conveyance structure deployment path would not exceed (i.e., have a bend that is tighter than the minimum radius of curvature) the minimum bend radius of the fiber.

As seen in the embodiment of FIG. 2, the MLCT 2700 is positioned over a formation 1002, in the earth 1102. The formation 1002 is shown as being freestanding, e.g., a block of material, for the purpose of clarity in the figure. It being understood that the formation may be deep within the earth, nearer to the surface such as in some shale gas fields and that the orientation of borehole 1003 may be from vertical, to the essentially horizontal shown in FIG. 2, to up turned, as well as branched.

In FIG. 2, the piping, pumps etc., for the delivery of the fracturing fluid are not shown. Once the laser beam(s) have been delivered the conveyance structure and the delivery tool can be removed from the well and the fracturing fluid delivery equipment connected to the well, or the fracturing fluid delivery equipment can be associated with the well, and the lubricator isolated from the pressure and flow of the fracturing fluid, while the fluid is being delivered, in this manner the conveyance structure and laser delivery tool may be left within the well during fracturing, partially removed from the well, or entirely removed from the well, and combinations and variation of these.

The formation 1002 has various geological formations and properties, e.g., 1004*a*, 1004*b*, 1004*c*. The geological properties and characteristic of the formation and hydrocarbon deposit may have been previously determined by seismic, well logging and other means known to the arts. Based upon this information a custom laser energy delivery perforating pattern 1120 was designed to extend from borehole 1003 and is delivered to the formation 1002. The laser perforating pattern 1120 has a series of laser perforations 1121*a*-1121*s*.

The position, spacing and orientation of these laser perforations 1121*a*-1121*s* is based in whole, or in part, upon the characteristics and features of the formation in which the laser pattern is delivered. As can be seen from FIG. 2, and for illustration purposes the perforation may have different lengths, may have different orientations to vertical, may have different angles with respect to the longitudinal axis of the borehole, and combinations and variations of these and other properties. Preferably, the perforation pattern and laser delivery pattern, because of its fracturing and weakening effect on the formation, is predetermined to enhance, augment, redo, or even replace hydraulic fracturing.

Figure 3:
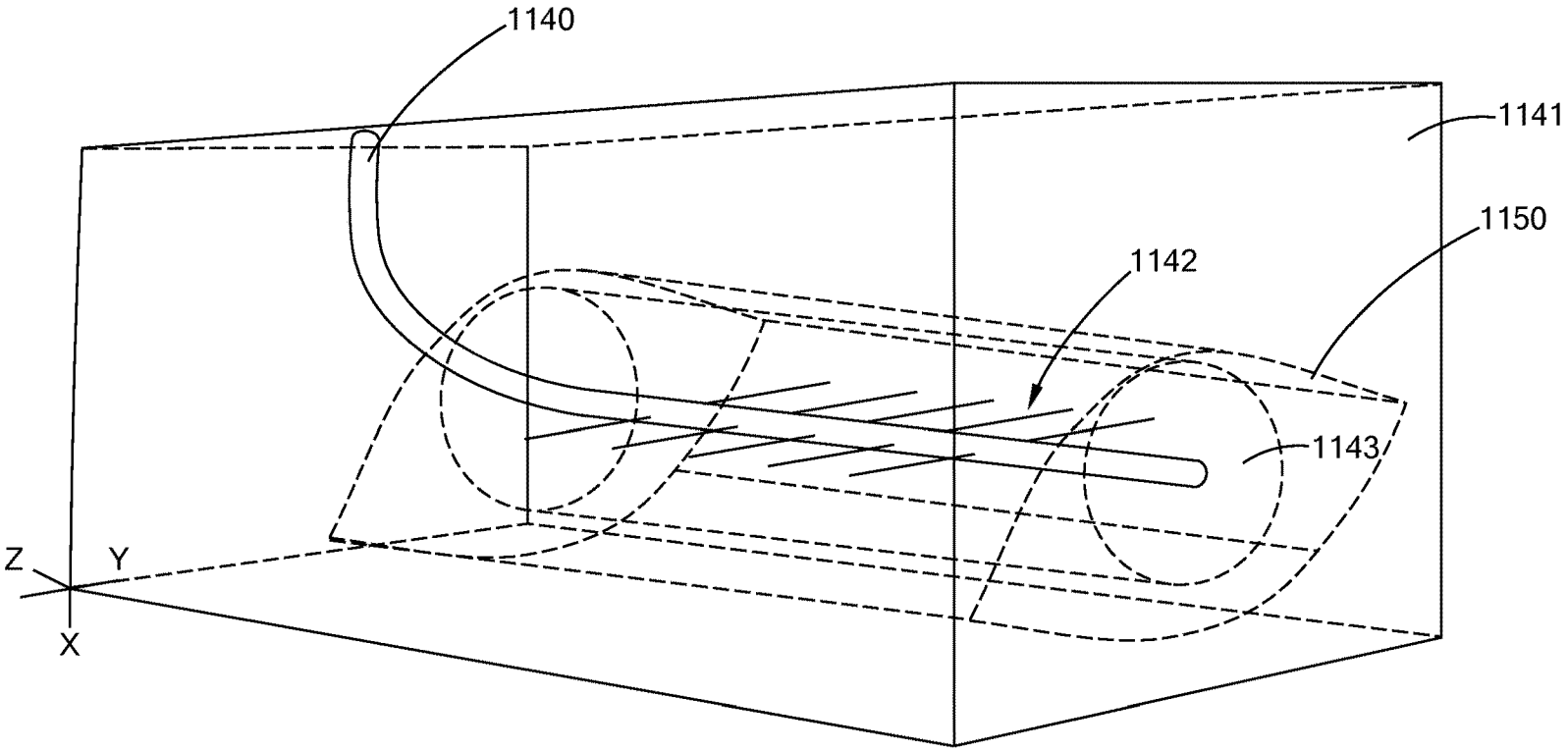
FIG. 3 is a perspective view of an embodiment of a laser energy delivery pattern in accordance with the present inventions.

Turning to FIG. 3 there is shown an embodiment of laser fracturing zone. A borehole 1140 in a section of a formation 1141. An essentially horizontal laser perforation pattern 1142 has been made from the borehole, resulting in a predetermined laser effected zone 1143, e.g., custom geometry (shown in dashed lines), which zone has laser induced fracturing. Hydraulic fracturing operations can then be applied using this custom geometry, to further enhance fluid communication between the borehole and the formation. Preferably, the hydraulic fracture zone 1150 is extended from the well bore, to and beyond the laser effected zone 1143. In this manner, the surface area exposed in the formation from the fracturing, is equal to the laser effected zone, and preferable larger, and substantially larger than the laser effected zone.

Figure 4:
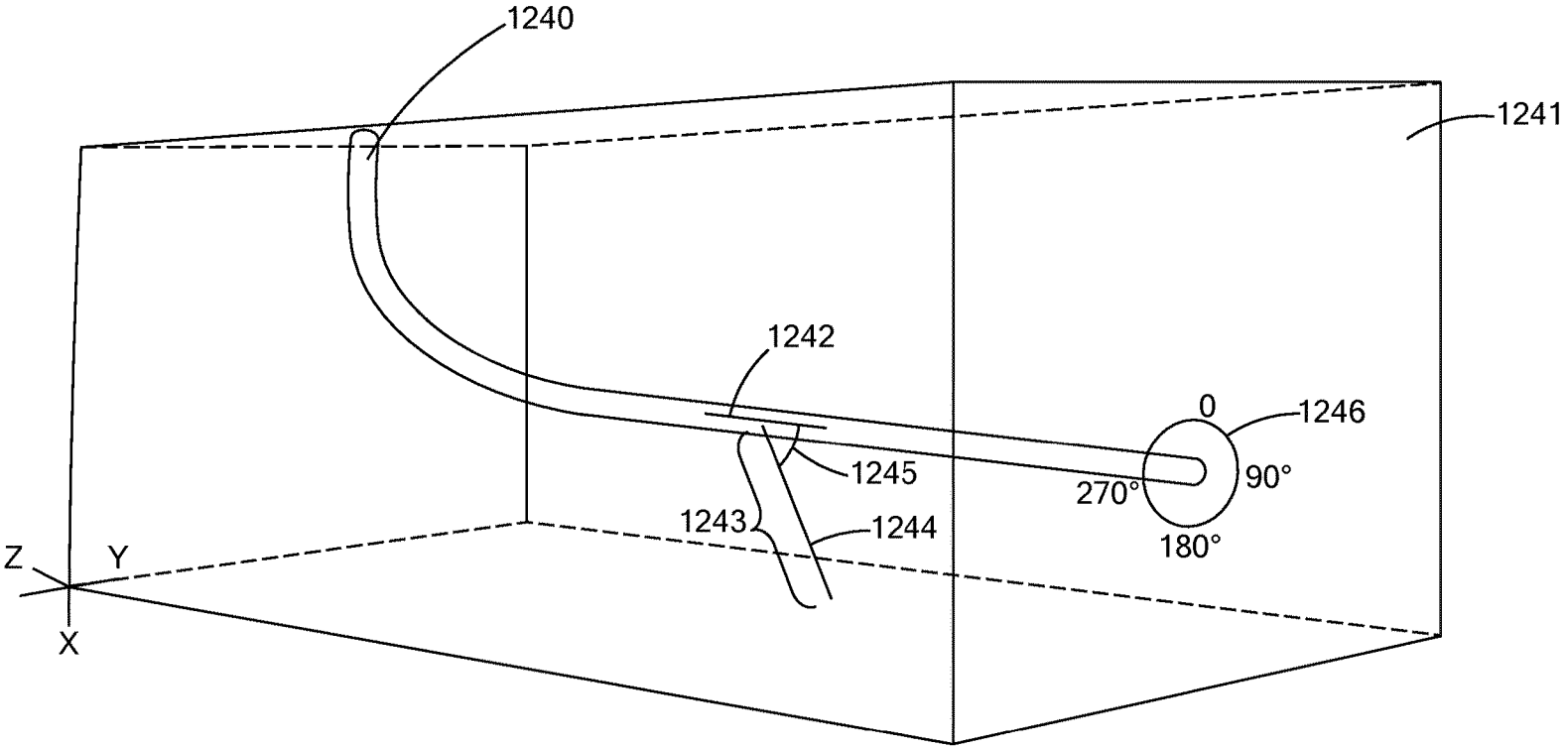
FIG. 4 is a perspective view of an embodiment of a laser energy delivery pattern in accordance with the present inventions.

Turning to FIG. 4 there is shown a borehole 1240 in a section of a formation 1241. The borehole has a single laser perforation 1244. A single perforation is used in this figure to illustrate the different variables that are controllable through laser perforation and which can, in whole or in part, be used to provide a predetermined laser perforation delivery pattern, and custom volumetric removal. The laser perforation can be varied in length 1243. The angle 1245 that the perforation forms with the longitudinal axis of the borehole (also typically the laser perforation tool) can be varied. The orientation around the borehole, e.g., degrees 1246 around the borehole can be varied, e.g., for 0° to 90° to 180° to 270° to 0°, and thus, any point around 360°. Additional, since it is preferred to have a multiple perforations, there spacing can be varied, and the other variables can be changed from one adjacent perforation to the next. This ability to predetermine and adapt these variables provides the further ability to have predetermined volumetric removals, and adaptive volumetric removals to conditions, data and information that develop during fracturing, fracturing stages, production, and combinations and variations of these, as well as, other down hole conditions.

Figure 38A:
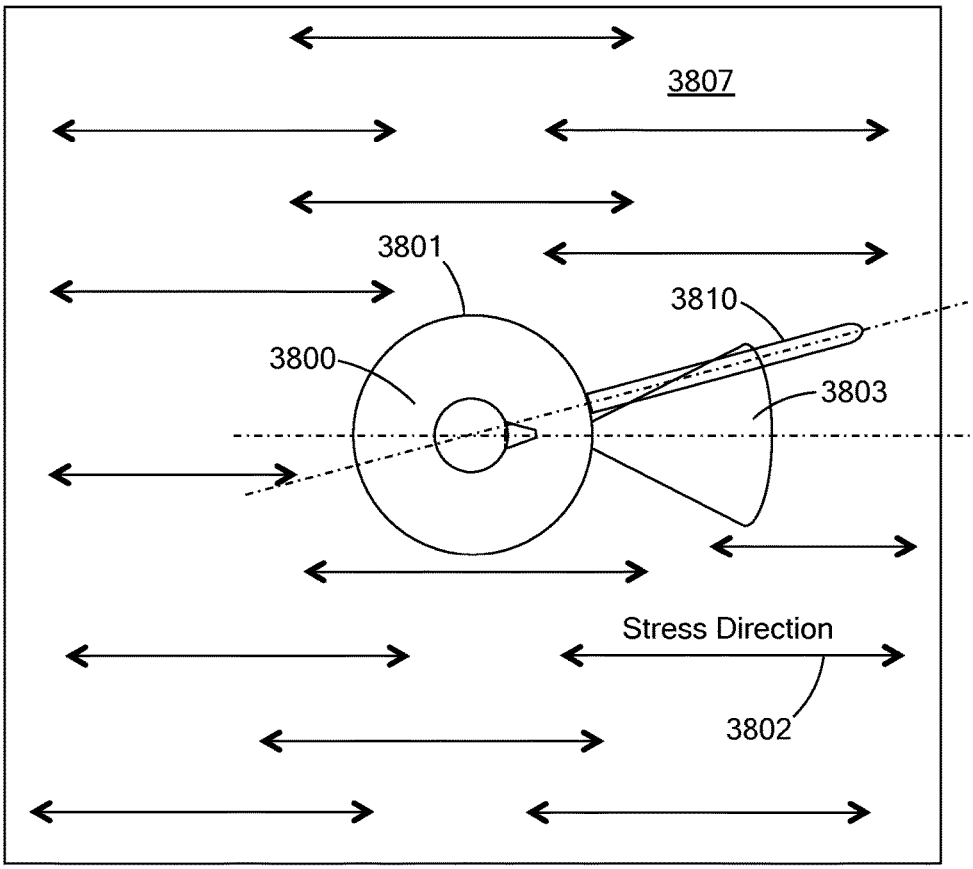
FIG. 38A is axial planer view of an embodiment of a laser perforating geometry following a stress plane of a formation in accordance with the present inventions.
Figure 38B:
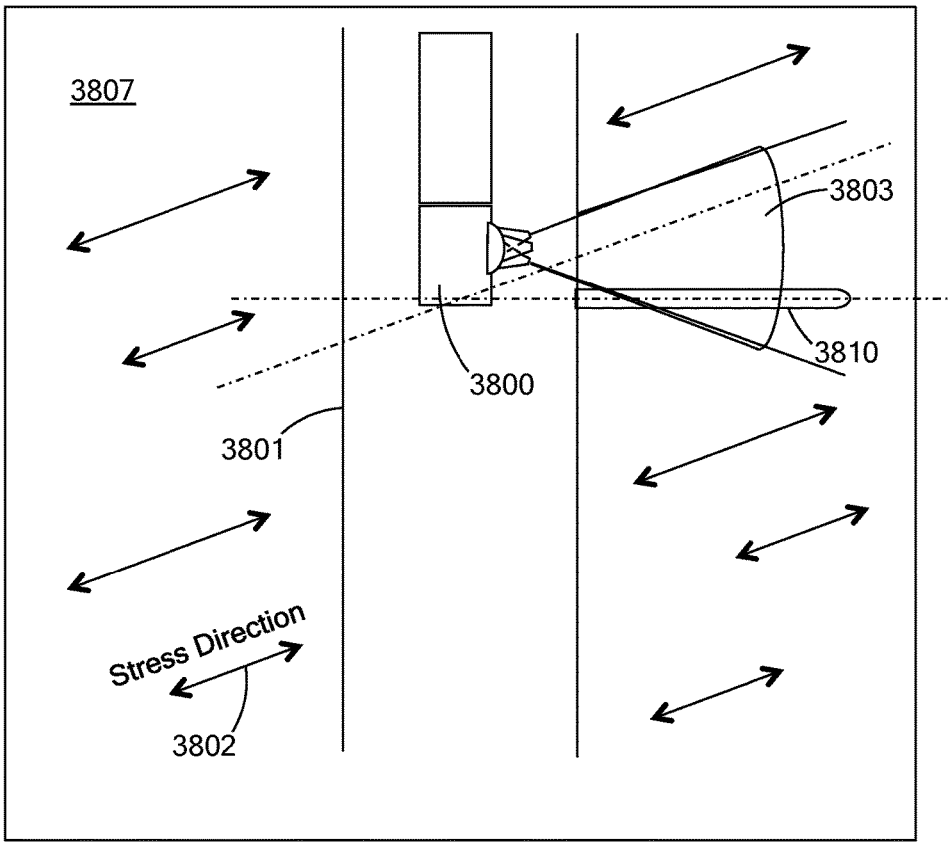
FIG. 38B is a cross sectional view of the laser perforating geometry of FIG. 38A.

Turning to FIGS. 38A and 38B there is shown an axial planer view and cross sectional view of a laser perforating geometry in a formation in relation to the stress planes in the formation. Thus, there is a laser tool 3800 in a borehole 3801 in a formation 3807 that has a stress direction shown by arrows, e.g., 3802. The laser tool 3800 has a range or area 3803 where the laser beam can be delivered, which for example could be a fan shaped delivery volumetrically removing the entire area. This area is within and the direction of stress 3802, and thus, the laser tool 3800 can deliver the laser beam in the direction of the stress, following the direction of stress, and parallel to the direction of stress. The limited ability of conventional tools is shown by perforation range 3810.

In additional to providing an entire laser perforation pattern based upon formation information, in whole, in part or without such information, it is possible to construct an evolving or adaptive laser perforation pattern based upon real time data and information, such as pressure testing in the well. Thus, for example, straddle packers may be employed with the laser perforation tool. The packers are set and the area is pressured up; changes, as measured with a caliper assembly for example, are then measured. From this information the strength of the formation and its strength in different directions can be measured and used to direct the laser beam to provide the optimum configuration of laser perforations for that specifically tested section of the formation. Additionally, sonic wireline tools may also be utilized to measure stress direction.

Figure 5A:
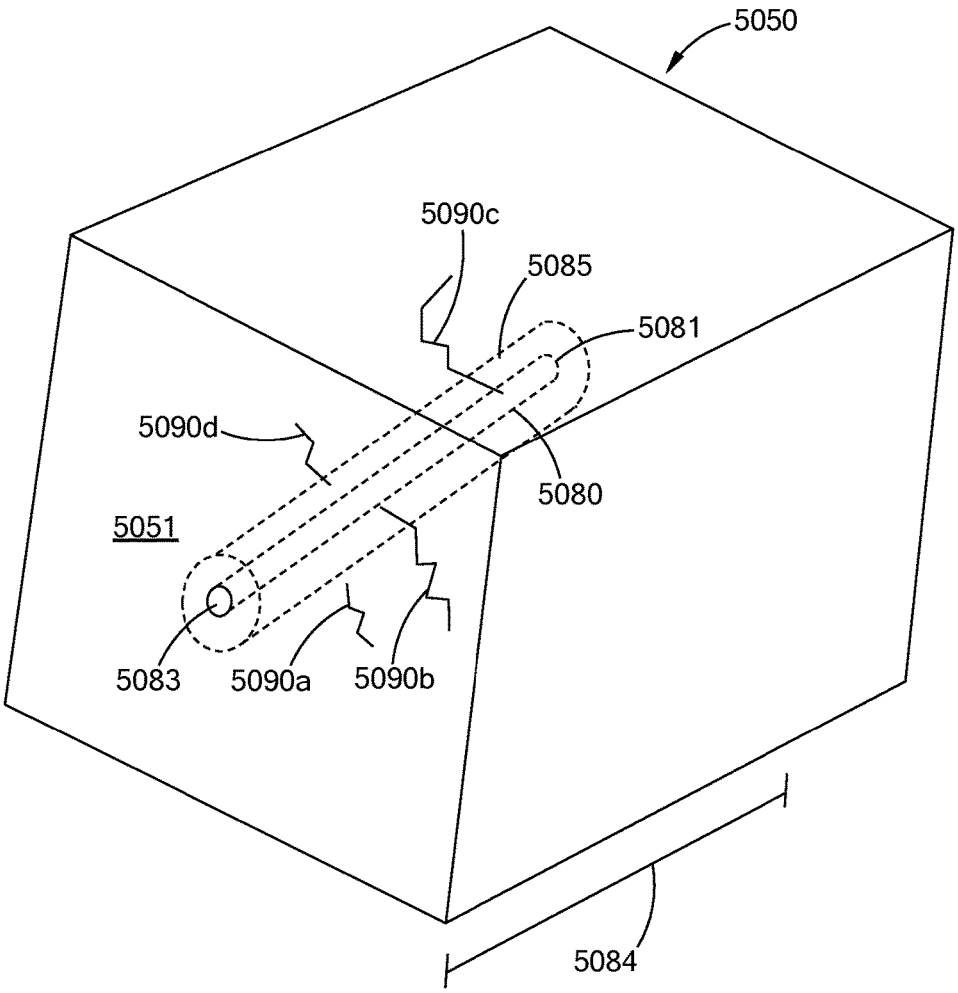
FIG. 5A is a perspective view of an embodiment of a laser energy delivery pattern in accordance with the present inventions.
Figure 5B:
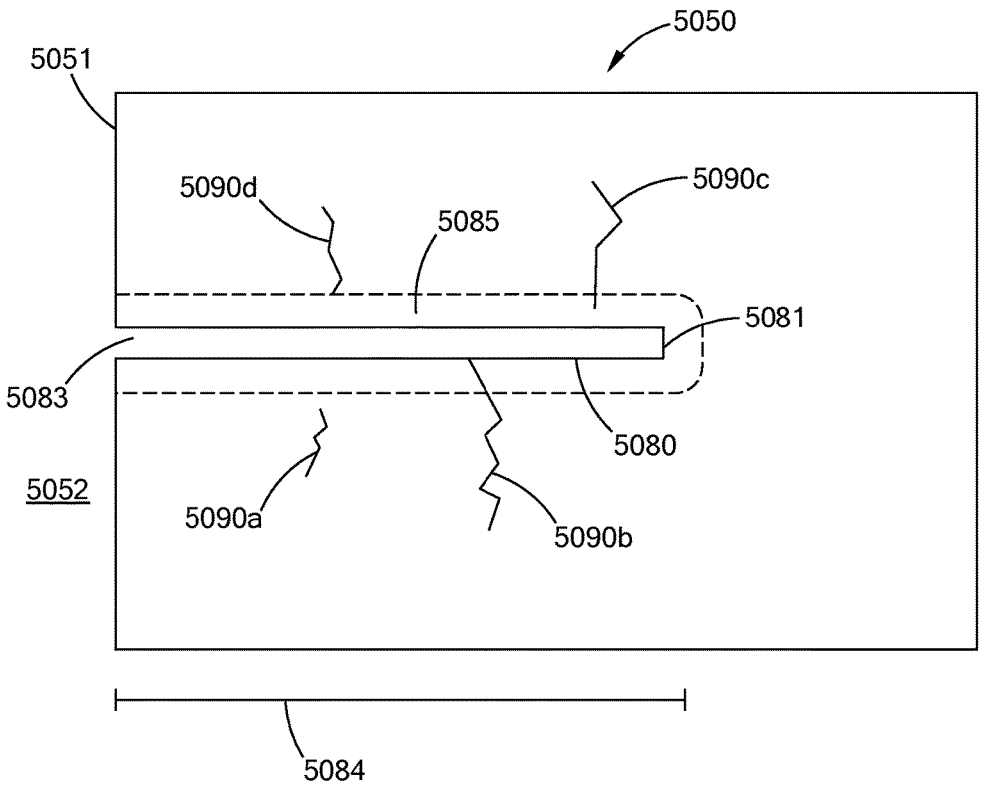
FIG. 5B is a perspective view of an embodiment of a laser energy delivery pattern in accordance with the present inventions.

Turning to FIGS. 5A and 5B there are shown in FIG. 5A a prospective view a section of a formation 5050, and in FIG. 5B a cross sectional view of the formation 5050. The formation 5050 is shown as being freestanding, e.g., a block of material, for the purpose of clarity in the figure. It being understood that the formation may be deep within the earth, nearer to the surface such as in some shale gas fields, and preferably in a hydrocarbon rich or pay zone of the formation, and that the face 5051 forms a part of, or is adjacent to, a borehole 5052 (as seen in FIG. 5B). Further although some boreholes are represented as being vertical, this is merely for illustration purposes and it should be recognized that the boreholes may have any orientation.

A laser cut hole 5080 extends into the formation 5050 from the hole opening 5083 to the back of the hole 5081. Around the hole 5080 is an area 5085 of laser affected formation. In this area 5085 the formation is weakened, substantially weakened, fractured or essentially structurally destroyed. Additionally, the laser cutting process forms cracks or fractures, i.e., laser induced fracturing, in the formation. By way of example, fracture 5090*a* is an independent fracture and does not extend to, or into, the laser affected area 5085, the hole 5080 or another fracture. Fracture 5090*b* extends into and through the laser affected area 5085 into the hole 5081. Additionally, fracture 5090*b* is made up of two associated cracks that are not fully connected. Fracture 5090*c* extends to, and into, the laser affected area 5085 but does not extend to the hole 5080. Fracture 5090*d* extends to, but not into the laser affected area 5085.

The fractures 5090*a*, 5090*b*, 5090*c* and 5090*d* are merely schematic representation of the laser induced fractures that can occur in the formation, such as rock, earth, rock layer formations and hard rocks, including for example granite, basalt, sandstone, dolomite, sand, salt, limestone and shale rock. In the formation, and especially in formations that have a tendency, and a high tendency for thermal-mechanical fracturing, in a 10 foot section of laser cut hole there may be about 10, about 20, about 50 or more such fractures, and these fractures may be tortuous, substantially linear, e.g., such as a crack along a fracture line, interconnected to greater and lessor extents, and combinations and variations of these and other geometric and volumetric configurations. These laser fractures may also be of varying size, e.g., length, diameter, or distance of separation. Thus, they may vary from micro fractures, to hairline fractures, to total and extended separation of sections having considerable lengths. These laser induced fractures may open up, provide or give rise to, additional surface area for the flow of hydrocarbons. Further, these laser induced fractures provide additional paths for fracturing fluid to move through and extend out from the borehole, and provide the ability for the fracturing fluid to leave proppant behind in these an other fractures in the laser effected zone and extending out beyond that zone. Thus, resulting in a substantial increase in total exposed surface area from a laser hydraulic fracture than would be obtained from conventional fracturing alone.

The depth or length of the laser cut hole can be controlled by determining the rate, e.g., inches/min, at which the hole is advanced for a particular laser beam, configuration with respect to the work surface of the formation, and type of formation. Thus, based upon the advancement rate, the depth of the hole can be predetermined by firing the laser for a preset time.

The rate and extent of the laser fracturing, e.g., laser induced crack propagation, may be monitored by sensing and monitoring devices, such as acoustical devices, acoustical geological sensing devices, and other types of geological, sensing and surveying type devices. In this manner the rate and extent of the laser fracturing may be controlled real time, by adjusting the laser beam properties based upon the sensing data.

Cuts in, sectioning of, and the volumetric removal of the formation down hole can be accomplished by delivering the laser beam energy to the formation in preselected and predetermined energy distribution patterns. These patterns can be done with a single laser beam, or with multiple laser beams. For example, these patterns can be: a linear cut; a pie shaped cut; a cut appearing like the shape of an automobile cam shaft; a circular cut; an elliptical cut; a square cut; a spiral cut; a pattern of connected cuts; a pattern of connected linear cuts, a pattern of radially extending cuts, e.g., spokes on a wheel; a circle and radial cut pattern, e.g., cutting pieces of a pie; a pattern of spaced apart holes, such as in a line, in a circle, in a spiral, or other pattern, as well as other patterns and arrangements. The patterns, whether lines, staggered holes, others, or combinations thereof, can be traced along, e.g., specifically targeted in a predetermined manner, a feature of the formation, such as, a geologic joints, bedding layers, or other naturally occurring features of a formation that may enhance, exploited or built upon to increase the fluid connectivity between the borehole and the hydrocarbons in the formation.

Thus, for example, in determining a laser beam delivery pattern to provide a predetermined and preselected laser beam energy distribution pattern, the spacing of cut lines, or staggered holes, in the formation, preferably may be such that the laser affect zones are slightly removed from one another, adjacent to one another but do not overlap, or overlap only slightly. In this manner, the maximum volume of the formation will be laser affect, i.e., weakened, fractured or perforated with the minimum amount of total energy.

Figure 6:
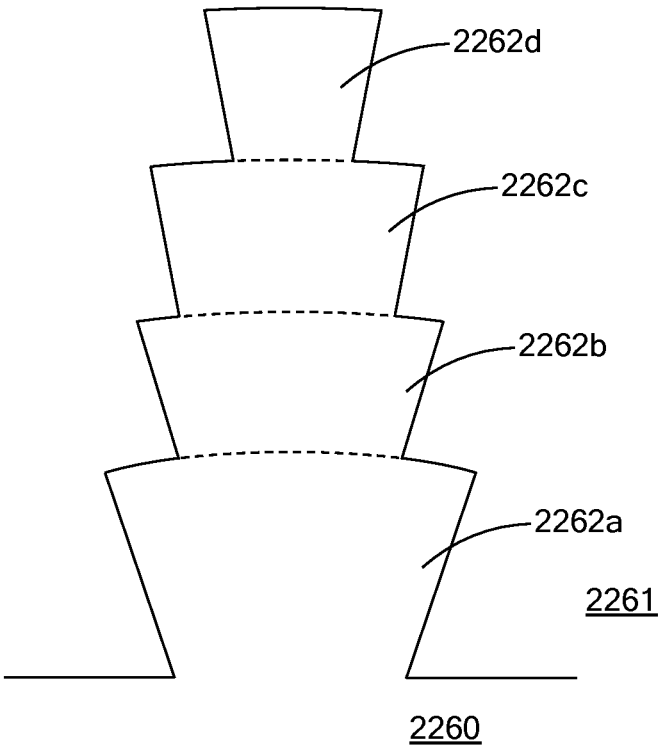
FIG. 6 is schematic view of an embodiment of a laser energy delivery pattern in accordance with the present inventions.

FIG. 6 shows an embodiment of a stepping down fan perforating pattern that can be implemented with the present laser perforation tools. In this pattern a series of progressively smaller fan shapes 2262*a*, 2262*b*, 2262*c*, 2262*d* are cut into formation 2261 moving away from borehole 2260. The dashed lines indicated the end of a first fan pattern that was cut through with the deeper, and later in time, fan pattern.

Figure 7A:
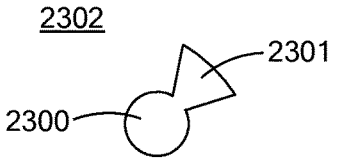
FIGS. 7A and 7B are plan and perspective views respectively of an embodiment of a laser energy delivery pattern in accordance with the present inventions.
Figure 7B:
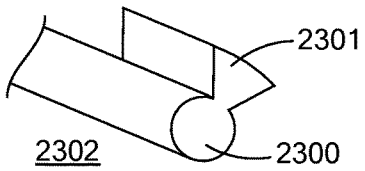

FIG. 7A is a plan view looking down borehole 2300 showing an embodiment of a fan, or pie shape perforation 2301 in formation 2302. FIG. 7B is a perspective view along the longitudinal axis of borehole 2300 showing that pie shape perforation 2301 is a volumetric shape extending along the borehole 2300. The length of pie shaped perforation 2301 may be a few inches to a few feet, tens of feet or more. Additionally more than one pie shaped perforation can be space along the length of the borehole.

Figure 9A:
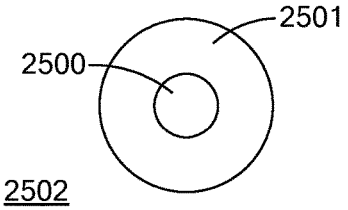
FIGS. 9A and 9B are plan and perspective views respectively of an embodiment of a laser energy delivery pattern in accordance with the present inventions.
Figure 9B:
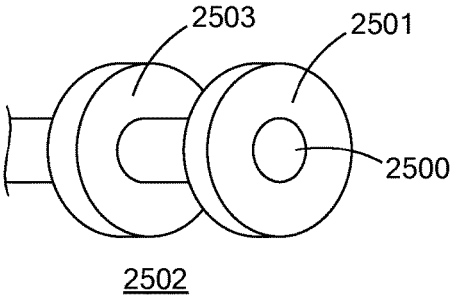

FIG. 9A is a plan view looking down borehole 2500 showing an embodiment of a disk shaped perforation 2501 in formation 2502. FIG. 9B is a perspective view along the longitudinal axis of borehole 2500 showing that there are a number of disk shape perforation 2501, 2503, spaced along the length of the borehole 2501 and that each is a volumetric shape extending along the length of the borehole 2500. The length of disk shaped perforation 2501, 2503 may be an inch, few inches to a few feet, but should not be so long as to adversely effect the stability of the well bore. Their lengths, and their spacing may be uniform, or it may be staged to, for example, match to formation characteristics to optimize fluid communication between the borehole and the formation.

The laser perforation patterns, beam delivery patterns have the capability to remove controlled volumes of material for each perforation, or discrete geometric shape. Thus, the volumetric removals, for discrete shape, e.g., disc, cylinder, line, could be greater than about 0.1 cubic inches ($in^3$), greater than about 0.2 $in^3$, greater than about 1 $in^3$, greater than about 4 $in^3$, greater than about 20 $in^3$, greater than about 50 $in^3$, and greater than about 100 $in^3$, and greater than about 150 $in^3$ (it being understood that greater and lessor volumes of removal are also contemplated) The laser beam removes material by, among other things, spalling, melting, vaporizing and combinations of these processes. For example the following Table 1 provides volumetric removals for a discrete shape, i.e., a disc, for particular casing, disc outer diameter and thickness.

TABLE 1

| | pipe outer diameter in | | | | | |
|---|---|---|---|---|---|---|
| Casing | Disc OD 5 in, thickness ¼ in -- volume removed in $in^3$ | Disc OD 5 in, thickness ½ in -- volume removed in $in^3$ | Disc OD 5 in, thickness 1 in -- volume removed in $in^3$ | Disc OD 7 in, thickness ¼ in -- volume removed in $in^3$ | Disc OD 7 in, thickness ½ in -- volume removed in $in^3$ | Disc OD 7 in, thickness 1 in -- volume removed in $in^3$ |
| 1 | 4.71 | 9.42 | 18.84 | 9.42 | 18.84 | 37.68 |
| 2½ | 3.68 | 7.36 | 14.72 | 8.39 | 16.78 | 33.56 |
| 5 | 1.77 | 3.54 | 7.08 | 12.76 | 25.52 | 51.04 |
| 4½ | 0.93 | 1.86 | 3.72 | 5.64 | 11.28 | 22.56 |
| | Disc OD 10 in, thickness ¼ in -- volume removed in $in^3$ | Disc OD 10 in, thickness ½ in -- volume removed in $in^3$ | Disc OD 10 in, thickness 1 in -- volume removed in $in^3$ | Disc OD 20 in, thickness ¼ in -- volume removed in $in^3$ | Disc OD 20 in, thickness ½ in -- volume removed in $in^3$ | Disc OD 20 in, thickness 1 in -- volume removed in $in^3$ |
| 7½ | 28.23 | 17.18 | 34.36 | 67.49 | 134.98 | 269.96 |
| 7⅝ | 27.87 | 16.46 | 32.92 | 67.13 | 134.26 | 268.52 |
| 8⅝ | 24.68 | 10.08 | 20.16 | 63.94 | 127.88 | 255.76 |

Figure 8A:
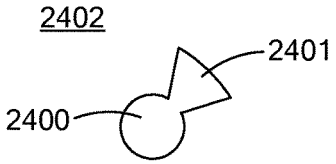
FIGS. 8A and 8B are plan and perspective views respectively of an embodiment of a laser energy delivery pattern in accordance with the present inventions.
Figure 8B:
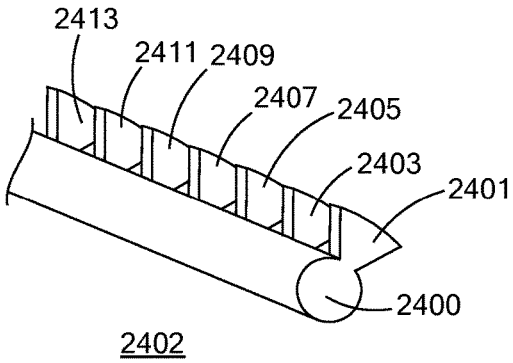

FIG. 8A is a plan view looking down borehole 2400 showing an embodiment of a fan, or pie shape perforation 2401 in formation 2402. FIG. 8B is a perspective view along the longitudinal axis of borehole 2400 showing that there are a number of pie shape perforation 2401, 2403, 2405, 2407, 2409, 2411, 2413 spaced along the length of the borehole 2400 and that each is a volumetric shape extending along the length of the borehole 2400. The length of pie shaped perforation 2401, 2403, 2405, 2407, 2409, 2411, 2413, may be a few inches to a few feet, tens of feet or more. Their lengths, and their spacing may be uniform, or it may be staged to, for example, match to formation characteristics to optimize fluid communication between the borehole and the formation.

Laser perforating tools and operations may find considerable uses, for example, in shales and shale formations and other unconventional or difficult to produce from formations. For example, in shales for unconventional extraction of gas and oil there is essentially no permeability, and in many cases no permeability. The current operations to access this rock and make it productive are to drill a 6 to 12 inch diameter borehole, thousands of feet long with a mechanical rig and bit, and then perforate on the order of inches using explosives. Once the perforations are formed tens or hundreds of thousands of gallons of fracturing fluid containing propping agents are pumped into the well at high pressure and are used to create fractures which increased the productivity of the well.

The high power laser perforating tools can greatly improve on this conventional operation by creating a custom geometry (e.g. shape, length, entrance area, thickness) with a laser. This custom geometry can stem off a main borehole in any orientation and direction, which in turn will initiate a fracture that is more productive than existing conventional methods, by exposing more rock and positioning the fractures in optimum stress planes, resulting in even greater surface area upon hydraulic fracturing.

Generally, fracturing in rocks at depth is suppressed by the confining pressure, from the weight of the rocks and earth above. The force of the overlying rocks is particularly suppressive of fracturing in the situation of tensile fractures, e.g., Mode 1 fractures. These fractures require the walls of the fracture to move apart, working against this confining pressure.

Hydraulic fracturing or fracing is used to increase the fluid communication between the borehole and the formation. Thus, it can restore, maintain, and increase the rate at which fluids, such as petroleum, water, and natural gas are produced from reservoirs in formations.

Thus, it has long been desirable to create conductive fractures in the rock, which can be pivotal to extract gas and oil from, for example, shale reservoirs because of the extremely low natural permeability of shale, which is measured for typical shales in the microdarcy to nanodarcy range. These fractures provide a conductive path connecting a larger volume of the reservoir to the borehole.

The custom geometries that can be created with laser perforating can provide enhanced, more predictable, and more controllable predetermined conductive paths that result from hydraulic fracturing. Thus, the laser perforation custom geometry can increase the efficiency of hydraulic fracturing and hydrocarbon production from a well.

Laser perforated custom geometries for hydraulic fracturing have many advantages in many, if not all well types, and particularly have advantages in horizontal drilling, which involves wellbores where the borehole is completed as a "lateral" that extends parallel to the hydrocarbon containing rock layer. For example, lateral boreholes can extend 1,500 to 5,000 feet (460 to 1,500 m) in the Barnett Shale basin in Texas, and up to 10,000 feet (3,000 m) in the Bakken formation in North Dakota. In contrast, a vertical well only accesses the thickness of the rock layer, typically 50-300 feet (15-91 m). Mechanical drilling, however, typically causes damage to the pore space, e.g., formation structure, at the wellbore wall, reducing the permeability at and near the wellbore. This reduces flow into the borehole from the surrounding rock formation, and partially seals off the borehole from the surrounding rock. Custom geometries, from the laser perforation, enable hydraulic fracturing in these wells to provide, restore and increase permeability and the productivity of the well; and to also do so in a more efficient and potentially cost effective manner than with previous perforating practies.

Thus, laser hydraulic fracturing, its systems tools and methods, as well as, the laser perforating tools, and laser energy distribution patterns, which can provide custom geometries, laser fractures and customer volumetric removals for hydraulic fracturing operations, have the potential to greatly increase hydrocarbon production, especially form unconventional sources.

Figures 34, 34A:
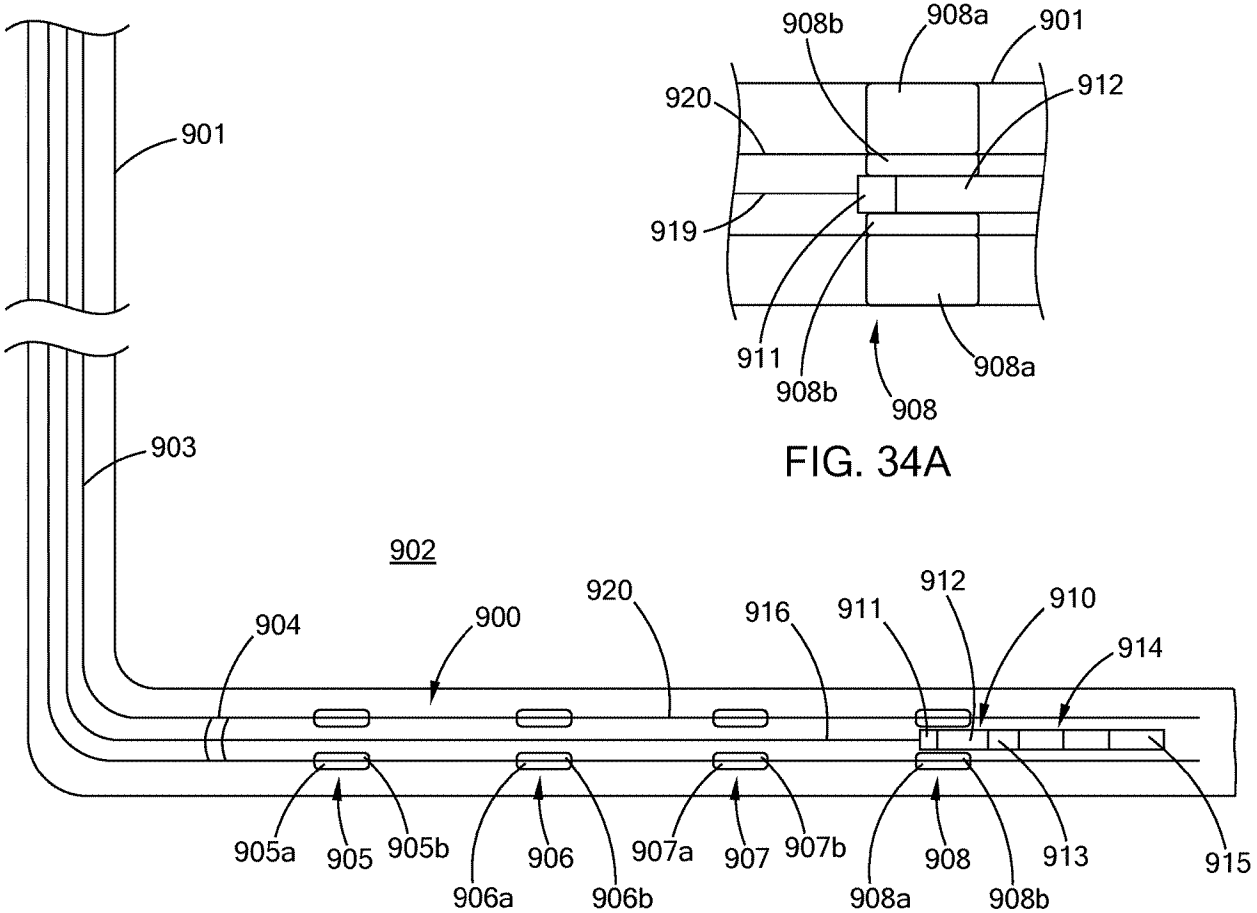
FIG. 34 is a cross sectional view of an embodiment of a laser hydraulic fracturing assembly in accordance with the present inventions.
FIG. 34A is an enlarged cross sectional view of the packer assembly of the embodiment of FIG. 34 expanded in accordance with the present inventions.

Turning to FIG. 34, there is provided an embodiment of a laser hydraulic fracturing assembly 900 deployed in a borehole at the beginning of a laser hydraulic fracturing operation.

In general, embodiments of laser hydraulic fracturing assemblies can have the capability to perform perforating operations in several predetermined zones or sections of the borehole. They can also preferably have the capability to isolate those sections, and to have the laser tool remain in the borehole during a pressure or flow operations, such as a hydraulic fracturing operation, if one should be required.

Thus, in general, a laser tool is located inside a sleeve, which is inserted into the borehole. (The sleeve may be lowered into the borehole via any type of conveyance structure, however, if flow or pressure operations are intended it should preferably be lowered via coiled tubing.) The sleeve has a series of spaced apart packers assemblies. These packer assemblies are configured to have the capability to expand outwardly and seal against the borehole wall, and also to expand inwardly and seal against the laser tool or the high power laser conveyance structure.

Thus, the outer packers can seal against the borehole wall isolating a section of the borehole between them. The inner packers can seal against the laser tool, effectively creating a plug (which also protects the laser optical components and other components of the laser tool from any high pressures or flows that may be above the "plug.") In this manner the laser hydraulic fracturing assembly has the capability to perform many varied perforation, cutting, welding, pressure, and flow operations; to perform these operations in multiple predetermined and isolated sections along the length of the borehole; and to perform these multiple operations along the length of the borehole while remaining in the borehole.

Thus, for example, a laser fracturing assembly can be lowered to the bottom of a borehole. The sleeve of the laser fracturing assembly has, for example, 10 sets of outwardly expanding spaced apart packers, which are distributed along the length of the sleeve. The lower most (closest to the bottom of the borehole) set of packers on the sleeve are expanded and isolate a section of the borehole between them.

The laser tool is positioned inside of the sleeve in the section of the sleeve between to the two expanded packers. The laser tool delivers the laser beam, readily cutting through the sleeve and performing the desired laser perforating operation on the borehole (either cased, multiple casing, or open hole).

The laser tool is then moved to a position in the sleeve adjacent the lower most expanded packer. When the laser tool is at this position, the inner packer is activated, expanding inwardly, sealing against the laser tool and creating a plug (e.g., the inner packer sealing against the laser tool and the adjacent outer packer, which is still activated sealing against the bore hole). A pressure and flow operation, e.g., hydraulic fracturing can then be performed on the isolated section of the borehole.

Once completed, the next set of up-hole packers can be expanded and the laser tool moved into position and the process repeated. In this manner, the laser tool, and related operations, can move in a serial manner from the down hole packer set (closest to the bottom of the borehole) to the upper most packer set (closest to the top of the hole).

It should further be understood, that this assembly provides great flexibility in the number and types of processes, operations, perforation patterns, reperforation patterns, hydraulic fractures, and other procedures and operations that can be performed along a length of a borehole, in isolated section of the borehole along that length, and preferably that can be performed in a single down hole trip.

Turning again to the embodiment of FIG. 34, the laser hydraulic fracturing assembly 900 is attached by joint 904 to coil tubing 903. The coil tubing 903 has been used to lower the laser hydraulic fracturing assembly 900 into a desired position within the borehole 901, in formation 902. Positioned within assembly 900 is laser cutting or perforating tool 910. Laser perforating tool 910 may be moved into the borehole with assembly 900, or it may moved into position after assembly 900 is situated in the borehole.

Assembly 900 has a sleeve or outer housing 920, with a series of packer assemblies 905, 906, 907, 908, located along the length of the sleeve 920. In this embodiment packer assembly 908 would be the bottom most assembly, e.g., closest to the bottom of the borehole, and packer assembly 905 would be the upper most assembly, e.g., closes to the top of the borehole. More or less packer assemblies may be used on a laser hydraulic fracturing assembly. Each packer assembly has an outer expandable sealing member 905*a*, 906*a*, 907*a*, 908*a*, and an adjacent inner expandable sealing member 905*b*, 906*b*, 907*b*, 908*b*. These packer assemblies are spaced, e.g., positioned along the length of the sleeve 920 of the laser hydraulic fracturing assembly 900. They provide predetermined locations, sections or zones where laser perforations can be made. They also provide for the performance of flow and pressure operations, through the laser perforations, on these isolated sections of the borehole, such as for example, where fracturing fluid and pressures will be applied to the formation 902. Thus, their number, spacing and frequency can vary and will be determined, in part, by information regarding the nature and characteristics of the formation and hydrocarbon sought to be recovered.

The laser perforating tool 910 has a high pressure sealing section 911. This section is configured to seal against the laser conveyance structure 916, and be engaged by, and thus seal against the inner sealing member, e.g., 908*b*, when that sealing member is extended inwardly. In this manner the sealing section 911 when engaged by an inner sealing member protects the laser perforating tool 910 from any up hole conditions, such as for example, the pressures and flows from an hydraulic fracturing operation. The laser sealing section 911 may also have its own expandable device, which could be expanded to engage the inner sealing member 908*b*, or could be expanded to engage and seal against the inner wall of the sleeve 920, or even potentially against the inner wall of another tubular located around the laser tool. (In this manner, the position of the laser perforating tool 910 would not be limited to being adjacent a packer assembly, e.g., 908, during an hydraulic fracturing stage).

The laser perforating tool 910 has a laser cutter section 912, which may contain a laser optics package for shaping and determining the laser beam properties, a mirror or prism for changing the direction of the laser beam, and a beam steering assembly for scanning or otherwise directing the laser beam. For example, the cutter section may have a digital micromirror device ("DMD") to direct the laser beam in a predetermined path, to give rise to a predetermined volumetric removal. The laser cutter section 912 may also have a nozzle, jet or other components to assist in the delivery of the laser beam, along a predetermined laser beam path, to it is target.

The laser cutter section 912 is optically associated with the conveyance structure 916, by for example, a high power connector. The conveyance structure 916 transmits the high power laser beam from a high power laser, preferably above the surface, to the cutting head section 912, where it is launch toward the target, e.g., the borehole wall. The conveyance structure 916 may be a high power optical fiber having a core diameter of at least about 300 microns, an inner protective sleeve of for example Teflon, which is located between the exterior of the optical fiber and the inner surface of a metal tube. The metal tube is then wrapped with carbon fiber, preferably in a braided fashion to provide strength to the metal tube and reduce, if not prevent the stretching of the tube. The woven carbon fiber outer wrap is then impregnated with an abrasion resistant resin or coating, which is also preferably high temperature, such as polyimide. The conveyance structure may also include other line structures for data, power, hydraulics for the laser perforating tool 910, or these lines to the extent needed may be places in one or more other conveyance structures.

The laser perforating tool 910 has an instruments section 913, which may have position location equipment, logging equipment, sensors and the like. In particular and preferably, the instrument section 913 has a locator device that can detect and determine the position of the laser perforating tool 910 with respect to a packer assembly, e.g., 908.

The laser perforating tool, has a motive section 914, which may contain an axial extending device, such as a ball screw assembly, for moving the laser cutting head in a predetermined and controlled rate axially along the length of the borehole. Depending upon the laser beam steering capabilities of the laser cutter section 912, the laser motive section 914 may also have a rotation device for rotating the laser head to a particular orientation regarding the borehole (see, e.g., FIG. 4, item 1246).

The laser perforating tool 910 has a tractor section 915, which can be used to initially position the tool 910 in the coiled tubing, can be used to move the tool from one section of packer assemblies to the next, e.g., moving from packer assembly 908 to packer assembly 907. The tractor section 915 may also serve to anchor the tool 910 as the laser cutting head is moved during a laser perforating operation, and to anchor the tool 910 when the inner sealing members are sealed during a fracturing stage. Depending up the vertical slope of the borehole, the tractor section 915 may only be an anchoring section as the movement of the tool 910 in the borehole can be accomplished by gravity and the lowering or rising of the conveyance structure 916.

This embodiment of the laser hydraulic fracturing assembly 900 and its laser perforating tool 910 are illustrative. Thus, additional and different components of the various sections may be used, additional or fewer sections may be used, the components of one section may be located in a different section, duplicate and redundant components may be used, and the functions of one component may be spread across or combined with other components. Preferably, the various sections of the laser perforating tool provide the tool with the capability to perform precision and predetermined volumetric removals by directing and moving the laser beam in predetermined angles and patterns, for example, as shown in and described regarding the embodiment of FIG. 4.

The laser hydraulic fracturing assembly 900 provides many varied methods of operation to perform laser hydraulic fractures. Turning to FIG. 9, the tractor section 915 is anchored against the inner wall of the sleeve 920. The laser cutter is moved at a predetermined rate and manner by the motive section 914. In this example the laser cutter is moved axially for a distance of three feet between packer assembly 908 and assembly 907, to perforate the borehole, by cutting a slot in the borehole wall and formation. The laser readily cuts through sleeve 920, which does not interfere with the laser perforation of the borehole. (To the extent that the packer assemblies are a greater distance apart, for example 15 feet, and the length of the slot is desired to be 10 feet, once the full extension of the motive device 914 is reached, e.g., 3 feet, the tractor can be moved forward as the motive device is retracted, the tractor can then be anchored and the cut continued.) In addition to a slot, the laser cutter could be moved and create holes at predetermined locations, or any other predetermined perforation pattern.

Once the desired laser perforations are made the laser cutter 912 is retracted back by the motive section 914, to the point where the sealing section 911 is adjacent to the inner packer 908*b*. At this point the inner packer 908*b* is sealed against the sealing section 911. The inner packer 908*b* and the sealing section 911 form a pressure tight seal. This seal has sufficient strength, e.g., is sufficiently tight and strong, to withstand the pressures and flows during e.g., a fracturing operation. The outer sealing member 908*a* of packer assembly 908 and the outer sealing member 907*a* of packer assembly 907 are then extended to seal against the inner surface of the borehole 901. In this manner the packer assembly 908, in conjunction with sealing section 911 form a plug in the borehole, as shown in FIG. 34A. Further, in this manner packer assemblies 907 and 908 form an isolation zone along the length of the borehole.

Once the packers sealing members 907*a*, 908*a*, and 908*b* are set, hydraulic fracturing can begin. The fracturing fluid is pumped down the coiled tubing 903, into the sleeve 920, out of the sleeve through the laser cut openings, and into the laser perforations in the formation fracturing the formation.

As the pressures and flows are monitored, if it is believed that less than optimal fracturing is occurring, the pressure and flow of the fracturing fluid can be reduced and stopped. The packer 908*b* can be disengaged, and subsequent laser cutting, and perforating operations, can be commented in the section between packer assembly 908 and 907. Once the subsequent, adaptive, laser perforation is completed, the cutter head 912 is retracted, the inner seal 908*b* is set, and the hydraulic fracturing can be continued. In this manner, real time monitoring and adaptive perforation of the well can be performed to optimize the hydraulic fracturing operation. (It should also be noted that these seals can be used to control the beam path free space environment, by for example, filling the free space with a gas, such as nitrogen, or a liquid, such as $D_2O$, which is preferred if the laser wavelength is about 1070 nm, or with a different fluid that is selected to provide minimal transmission losses to a particular laser beam wave length.)

This procedure can then be repeated, moving for example in a serial fashion up hole, from one packer section to the next, e.g., 908-907 to 907-906 to 906-905. With each section having an adaptive and optimized laser perforation and hydraulic fracturing procedure performed on it, should such a procedure be needed.

It being recognized that in this configuration and procedure the conveyance structure(s) will be exposed to the high pressures, flow and abrasive effects of the fracturing fluid and proppants. Thus, preferably for such configurations the conveyance structure should be coated with a friction reducing, abrasion resistant outer coating, which is also preferably high temperature and strong.

In various embodiments and various applications, and by way of illustration, a laser perforating tool may have several components or sections. The tool may have a one or more of these and similar types of sections: a conveyance structure, a guide assembly, a cable head, a roller section, a casing collar locating section, a swivel, a LWD/MWD section, a vertical positioning section, a tractor, a packer or packer section, an alignment or orientation section, laser directing aiming section, a packer, and a laser head. These components or sections may be arranged in different orders and positions going from top to bottom of the tool. In general, and unless specified otherwise, the bottom of the tool is that end which first enters the borehole and the top of the tool is that section which last enters the borehole and typically is attached to or first receives the conveyance structure. It is further understood that one component in the tool may perform the functions of two or more other components; that the functions of a single component may be performed by one two or more components; and combinations and variations of these.

Figure 10:
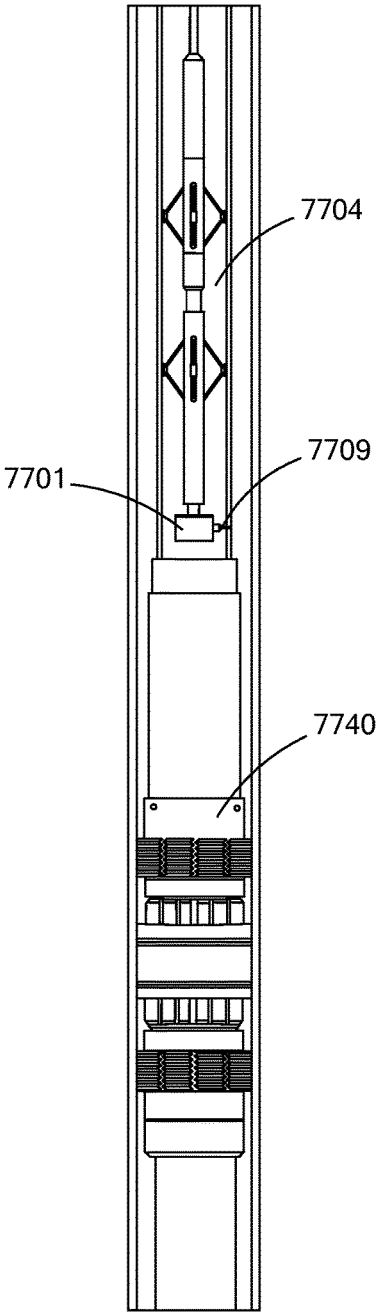
FIG. 10 is schematic view of an embodiment of a laser perforating tool in accordance with the present inventions.
Figure 11:
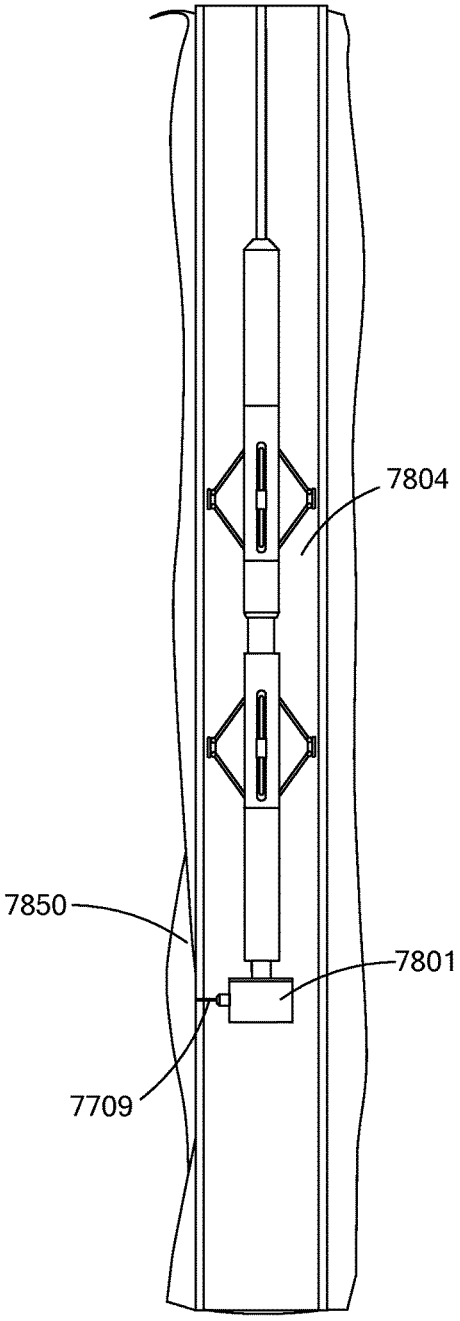
FIG. 11 is schematic view of an embodiment of a laser perforating tool in accordance with the present inventions.
Figure 12:
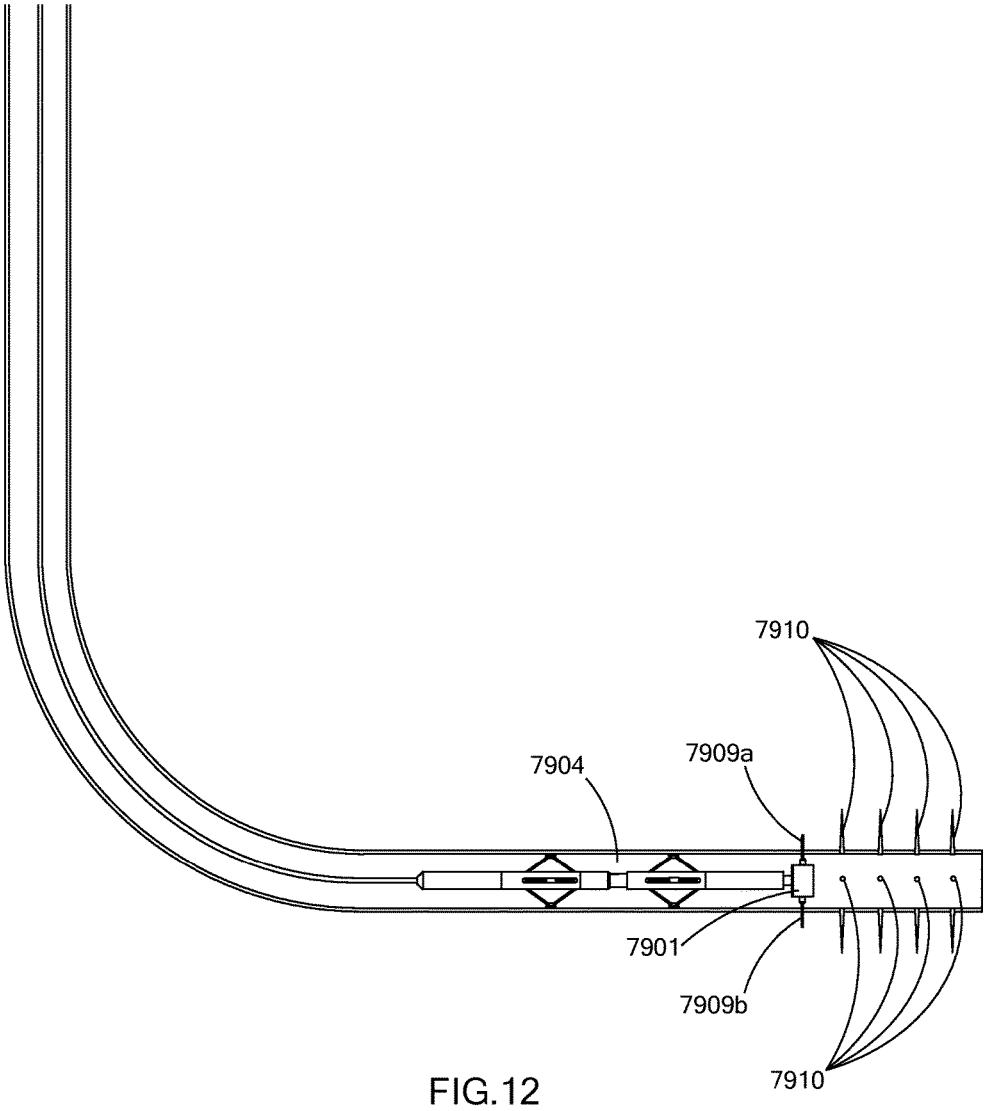
FIG. 12 is schematic view of an embodiment of a laser perforating tool in accordance with the present inventions.

Embodiments and applications for laser hydraulic fracturing, perforating of tubing and casing, open holes, and embodiments of laser tools, systems, methods and devices are shown in FIGS. 10, 11 and 12. In these embodiments the perforating of casing and tubing is done as a means of establishing communication between two areas previously isolated. The most common type of perforating done is for well production, the exposure of the producing zone to the drilled wellbore to allow product to enter the wellbore and be transported to surface facilities. Similar perforations are done for injection wells, providing communication to allow fluids and or gases to be injected at the surface and placed into formation. Workover operations often require perforating to allow the precise placement of cement behind casing to ensure adequate bond/seal or the establishing of circulation between two areas previously sealed due to mechanical failure within the system. Such workover operations can be accomplished and enhanced by the present laser systems and methods.

In the embodiments of FIGS. 10-12, the laser system for perforating includes a laser cutting head 7701, 7801, 7901, which propagates a laser beam(s) 7709, 7809, 7909*a* and 7909*b*, an anchoring or an anchoring/tractor device, 7704, 7804, 7904 an imaging tool and a direction/inclination/orientation measurement tool. The assembly is conveyed with a wireline style unit and a hybrid electric line. The assembly is capable of running into a well and perforating multiple times through the wellbore in a single trip, with the perforations 7910 specifically placed in distance, size, frequency, depth, and orientation. The tool is also capable of cutting slots in the pipe to maximize exposure while minimizing solids production from a less-than-consolidated formation. In a horizontal wellbore, the tractor 7904 is engaged to move the assembly while perforating. (In vertical uses the tractor assemblies 7704, 7804 may also be used to position the tool) Further, to the extent sufficient control or precision can not be obtained by the tractor assembly, a precision advancement mechanism can be used to move the laser head in an axial direction along the length of the borehole at a very precise rate, such precision axial movement mechanisms would include, ball nut and screw, hydraulic piston, chain drive, gear drive and the like. The tool is capable of perforating while underbalanced, even while the well is producing, allowing evaluation of specific zones to be done as the perforating is conducted. The tool is relatively short, allowing deployment methods that are significantly easier than traditional underbalanced perforating systems.

Turning specifically to FIG. 10 the tool is positioned above a packer 7740 to establish an area to be perforated that has an established circulation. Turning to FIG. 11, the tool is being used to cut access to an area of poor cement bond 7850. In this manner additional cement could be pumped in.

Figure 13:
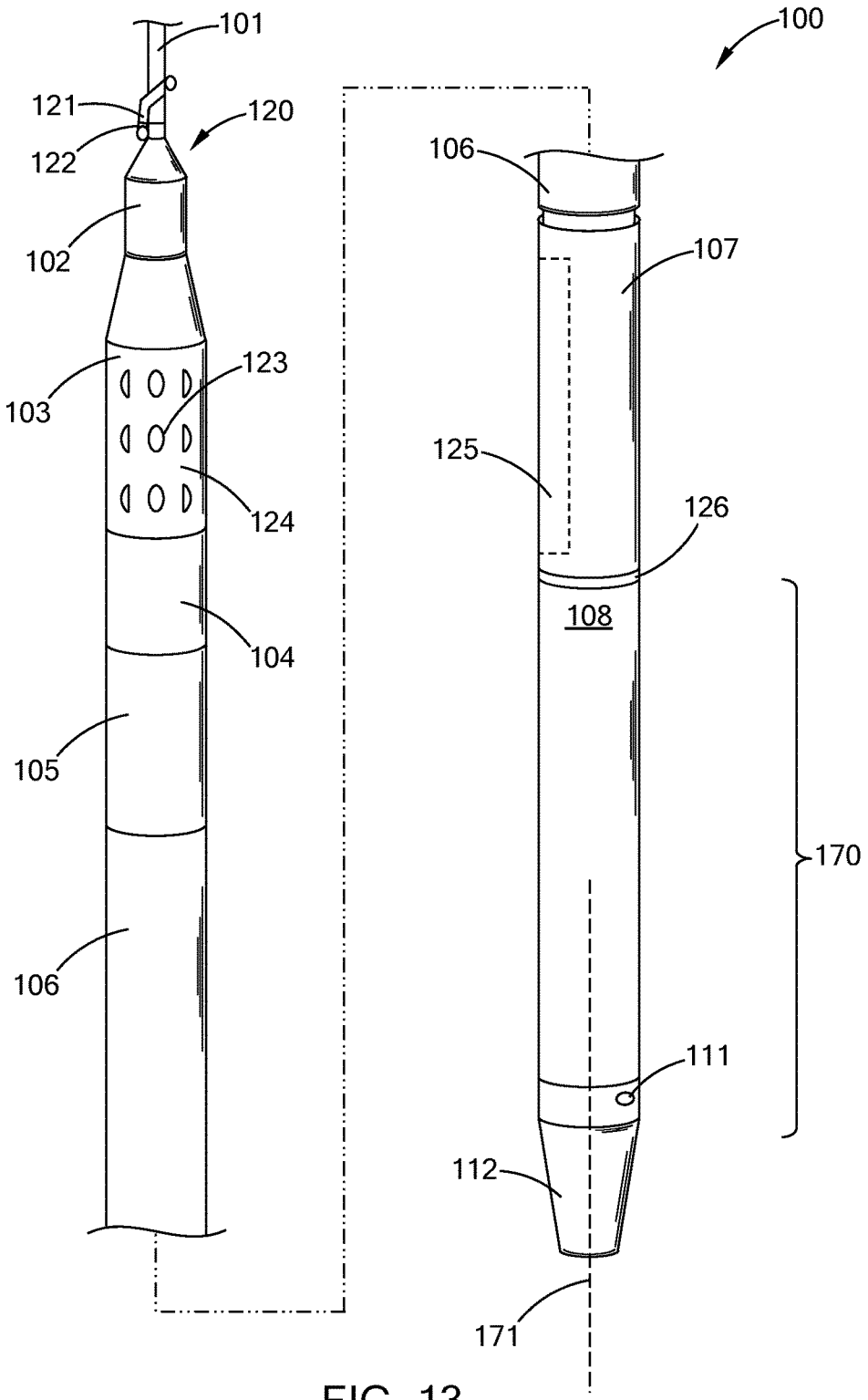
FIG. 13 is a perspective view of an embodiment of a laser perforating tool in accordance with the present inventions.

Turning to FIG. 13 there is provided a perspective view of an embodiment of a laser perforating tool with a conveyance structure attached, for use in laser hydraulic fracturing operations. The laser perforating tool 100 contains several connectable and cooperatively operable subassemblies forming an elongated housing that may be joined together by threaded unions, or other connecting means know to the art, into an operable piece of equipment for use. At the top 120 of tool 100 is a conveyance structure 101, which is mounted with the tool 100 at a cable head 102. A guide assembly 121 is mounted around conveyance structure 101 immediately above cable head 102. Housing guide assembly 121 is freely rotatedly mounted around the conveyance structure 101 and provided with a roller or wheel and a sliding shoe or guide portion 122 which enables the tool to be pulled into a reduced diameter aperture such as when the tool is pulled from a lower portion of well casing through a bulkhead or the like into a shorter tubing string. Guide assembly 121 prevents the upper end portion of cable head 102 from becoming stuck or wedged against the obstruction created by a reduced diameter aperture within a well casing. Adjacent cable head 102 is upper roller assembly 103. Upper roller assembly 103 contains a number of individual rollers, e.g., 123 mounted in a space relation around and longitudinally along this section. Rollers 123 protrude from the outer surface 124 of the upper roller assembly housing in order to support the housing on the interior tubular surface presented by well casing and tubing. Rollers 123 in this roller assembly can be constructed with low friction bearings and/or materials so that rotation of the rollers requires very little force, other devices for reducing the force required for movement through the borehole, know to those of skill in the art may also be used. This construction assists in longitudinal movement of the housing through the tubing and casing of a well by significantly reducing the force required to accomplish such movement. Below upper roller assembly 103 is a connecting segment 104, which joins a casing collar locator 105. Casing collar locator 105 is used to locate the collars within a casing of a well. In perforating operations it is typical to locate several collars within a well in order to determine the exact position of the zone of interest that is to be perforated, other instruments and assemblies may also be used to make this determination.

With explosive perforation it was necessary or suggested to locate collars within the casing in order to position the explosive perforating tool such that it would not attempt to perforate the casing through a collar. The laser perforating tools have over come this problem and restriction. The laser beam and laser cutting heads can readily cut a perforation hole through a casing collar or joint of any size.

Immediately below casing collar locator 105 is a swivel sub 106. Swivel sub 106 is constructed with overlapping internal and external members that provide for a rigid longitudinal connection between upper and lower portions of the housing while at the same time providing for free rotational movement between adjoining upper and lower portions of the housing.

Immediately below swivel sub 106 in the housing is an eccentrically weighted sub 107, which provides for passive vertical orientation, positioning, of the laser sub assembly 170. Eccentric weight sub 107 contains a substantially dense weight, e.g., depleted uranium, that is positioned in an eccentric relation to the longitudinal axis of the housing. This eccentric weight 125 is illustrated in dashed lines in its eccentric position relative to the longitudinal axis of this sub. The position of eccentric weight 125 is on what will be referred to as the bottom portion of the housing and the laser sub 170. Due to the mass of weight 125 being selected as substantially larger than the mass of the adjacent portion of the apparatus housing this weight will cause the housing to rotate to an orientation placing weight 125 in a downwardly oriented direction. This is facilitated by the presence of swivel sub 106. Immediately below eccentric weight sub 107 is an alignment joint sub indicated at 126. Alignment joint 126 is used to correctly connect eccentric weight sub 107 with the laser sub 170 so that the bottom portion of the housing will be in alignment with the laser beam aiming and directing systems in the laser sub 170.

Laser sub assembly 170 contains several components within its housing 108. These components or assemblies would include controllers, circuitry, motors and sensors for operating and monitoring the delivery of the laser beam, an optics assembly for shaping and focusing the laser beam, a beam aiming and directing assembly for precisely directing the laser beam to a predetermined location within the borehole and in a predetermined orientation with respect to the axis 171 of the laser sub 170, the beam aiming and directing system may also contain a beam path verification system to make certain that the laser beam has a free path to the casing wall or structure to be perforated and does not inadvertently cut through a second string or other structure located within the casing, a laser cutting head which is operably associated with, or includes, in whole or in part, the optics assembly and the beam aiming and directing assembly components, a laser beam launch opening 111, and an end cone 112. The laser sub 170 may also contain a roller section or other section to assist in the movement of the tool through the borehole.

Subassemblies and systems for orienting a tool in a well may include for example, gravity based systems such as those disclosed and taught in U.S. Pat. Nos. 4,410,051, 4,637,478, 5,101,964, and 5,211,714, the entire disclosures of each of which are incorporated herein by reference, laser gyroscopes, gyroscopes, fiber gyros, fiber gravimeter, and other devices and system known to the art for deterring true vertical in a borehole.

Figure 13A:
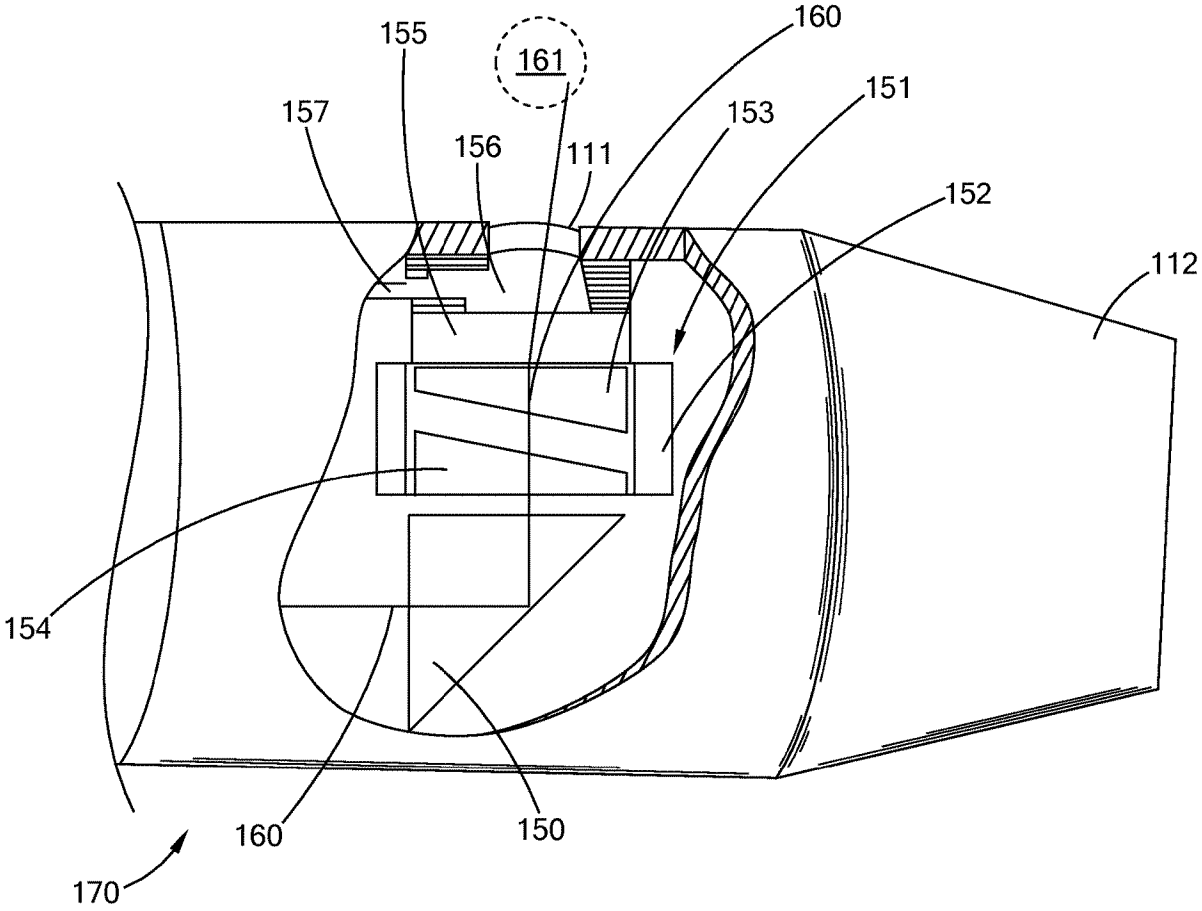
FIG. 13A is a cutaway perspective view of an embodiment of a laser perforating head in accordance with the present inventions.

Turning to FIG. 13A there is shown a cut away perspective view of the laser perforating sub assembly 170. The laser beam traveling along beam path 160, from optics assembly (not shown in the Figure) enters TIR prism 150 (Total internal reflection (TIR) prisms, and their use in high power laser tools is taught and disclosed in U.S. patent application Ser. No. 13/868,149, the entire disclosure of which is incorporated herein by reference.) It is noted that other forms of mirrors and reflective surfaces may be used, however these are not preferred. From TIR prism 150 the laser beam traveling along beam path 160 enters a pair of optical wedges 153, 154, which are commonly called Risley Prisms, and which are held and controlled by Risley Prism mechanism 152. As the prisms are rotted about the axis of the laser beam path 160 they will have the effect of steering the laser beam, such that depending upon the relative positions of the prisms 153, 154 the laser beam can be directed to any point in area 161 and can be moved in any pattern within that area. There is further provided a window 157 that is adjacent a nozzle assembly 156 that has a source of a fluid 157.

The conveyance structure transmits high power laser energy from the laser to a location where high power laser energy is to be utilized or a high power laser activity is to be performed by, for example, a high power laser tool. The conveyance structure may, and preferably in some applications does, also serve as a conveyance device for the high power laser tool. The conveyance structure's design or configuration may range from a single optical fiber, to a simple to complex arrangement of fibers, support cables, shielding on other structures, depending upon such factors as the environmental conditions of use, performance requirements for the laser process, safety requirements, tool requirements both laser and non-laser support materials, tool function(s), power requirements, information and data gathering and transmitting requirements, control requirements, and combinations and variations of these.

Figure 14B:
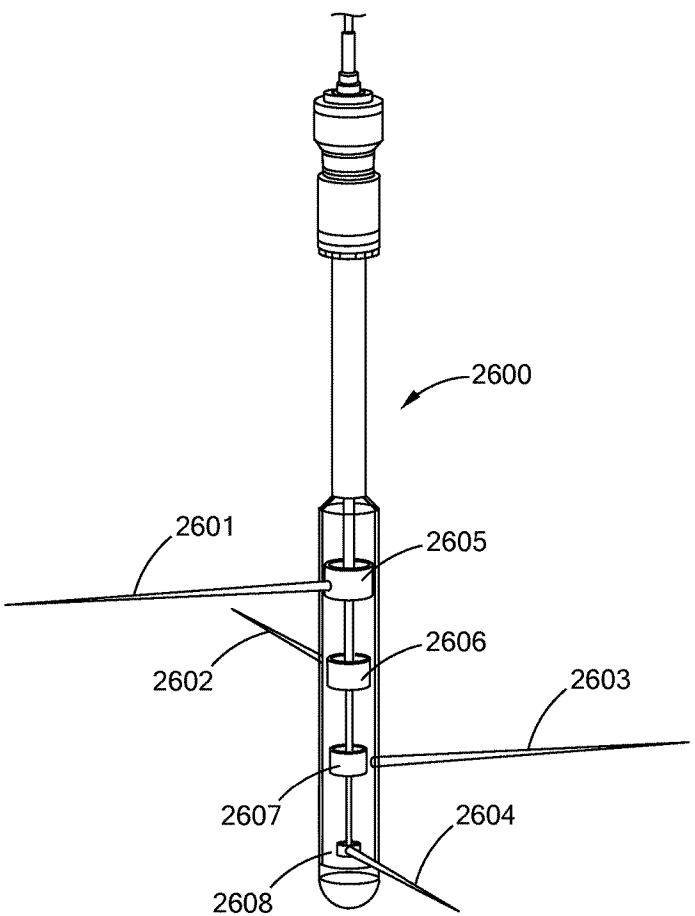
FIG. 14B is a cutaway perspective view of the embodiment of FIG. 14A.
Figure 14A:
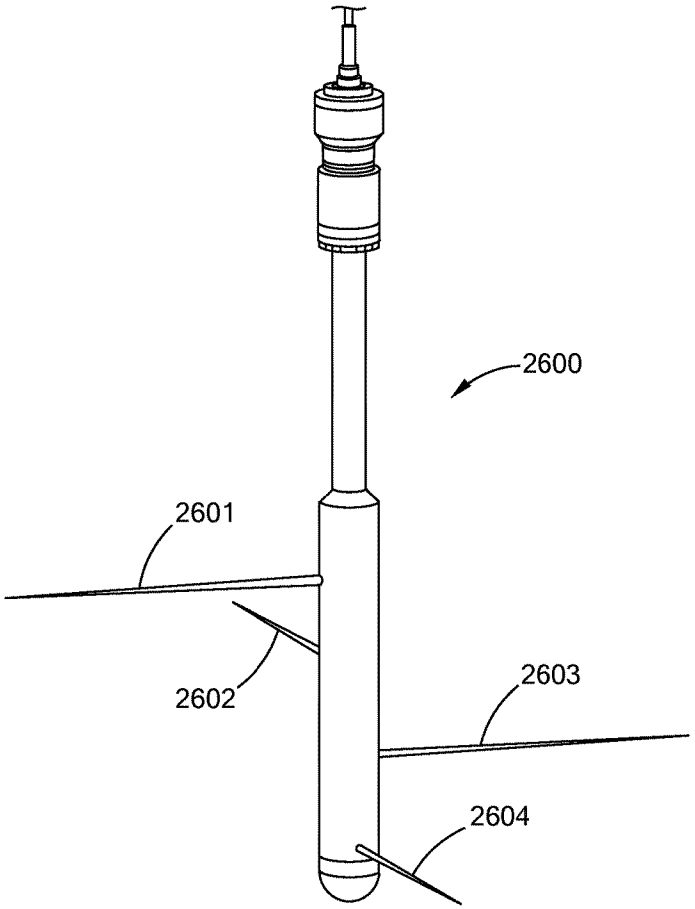
FIG. 14A is a perspective view of an embodiment of a laser perforating tool in accordance with the present inventions.
Figure 14C:
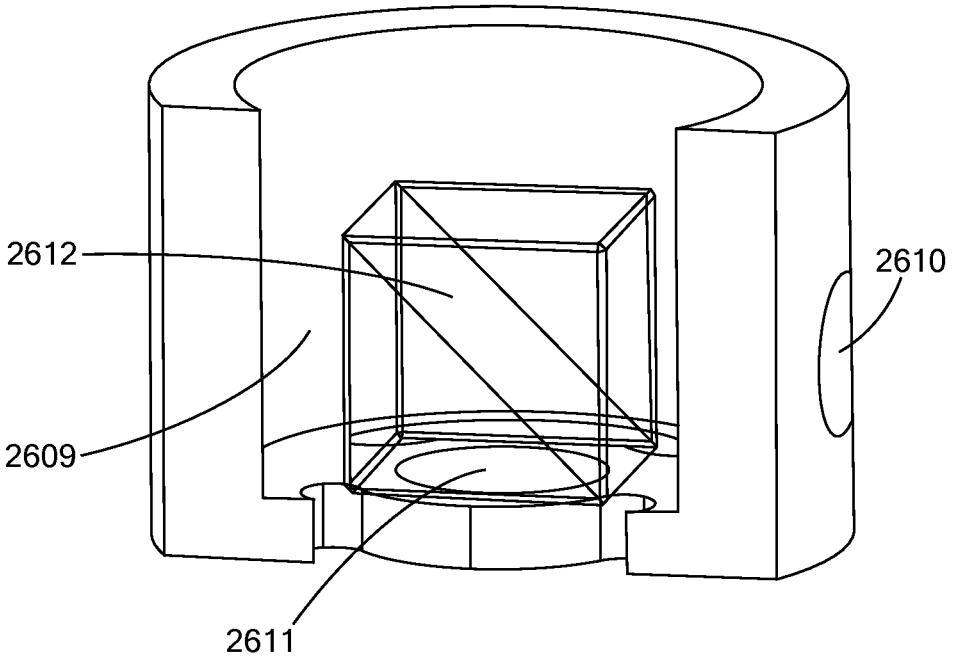
FIG. 14C is a cutaway perspective view of a component of the embodiment of FIG. 14A.

Turning to FIGS. 14A, 14B and 14C there is provided a perspective view of an embodiment of a laser perforating tool (FIG. 14B is a cutaway sectional perspective view of the tool of FIG. 14A and FIG. 14C is a cutaway sectional perspective view of a beam splitter assembly of the tool). The laser perforating tool 2600, for use in laser hydraulic fracturing operations, has four laser beam delivery assemblies 2605, 2606, 2607, 2608, which deliver four laser beams 2601, 2602, 2603, 2604 to form perforations in the borehole side wall and formation. Laser beam delivery assemblies, 2605, 2606, 2607 each have a beam splitter, e.g., 2612, in a housing which has air cooling passage 2609, and laser path openings 2610. The bottom laser delivery assembly 2608 has a TIR prism for directing laser beam 2604.

Figure 15A:
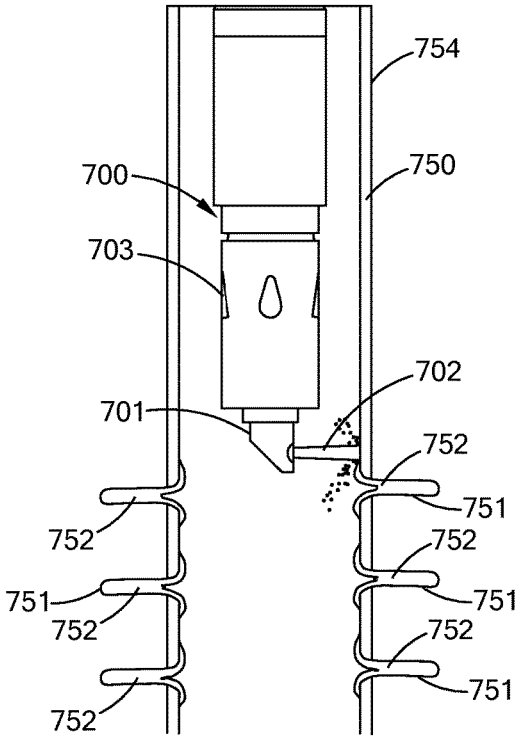
FIGS. 15A and 15B are cross sectional views of an embodiment of a laser perforation tool in accordance with the present inventions.
Figure 15B:
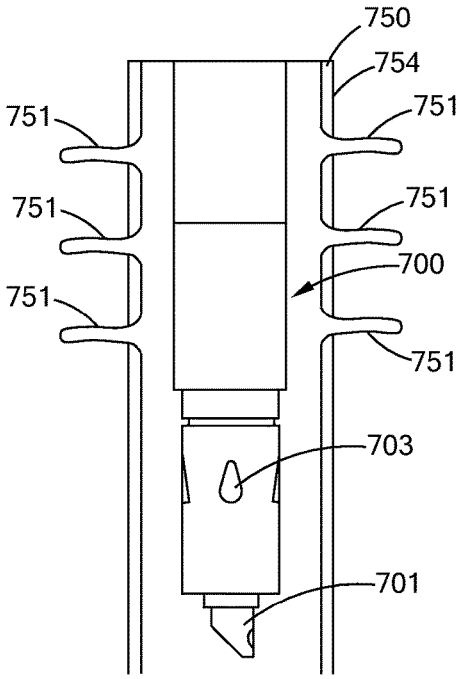

An embodiment of a laser perforating tool may be used to rework a well that has become less productive, for example, by the reopening of a perforation zone in a well for subsequent fracturing. Turning to FIGS. 15A and 15B there is shown a schematic cross section of an embodiment of a laser perforating tool 700 in a casing 750, in a well bore 754. The laser perforating tool 700 has circulating ports 703, for delivering a circulation fluid, e.g., gas, liquid or both, to assist in carrying away and out of the well any removed material. As shown in FIG. 15A the laser tool is being advanced toward the perforations 751 in the casing 750, which have been fouled by build up 752. Upon reaching the build up area the laser tool fires the laser beam 702 at the build up causing its removal. The laser beam is scanned around the inner diameter of the casing to remove all of the build up. Based upon sensors in the laser tool when the laser beam reaches a perforation 751, scanning of the beam is suspended, and the beam is held on the perforation until it is cleared of the build up.

Figure 16:
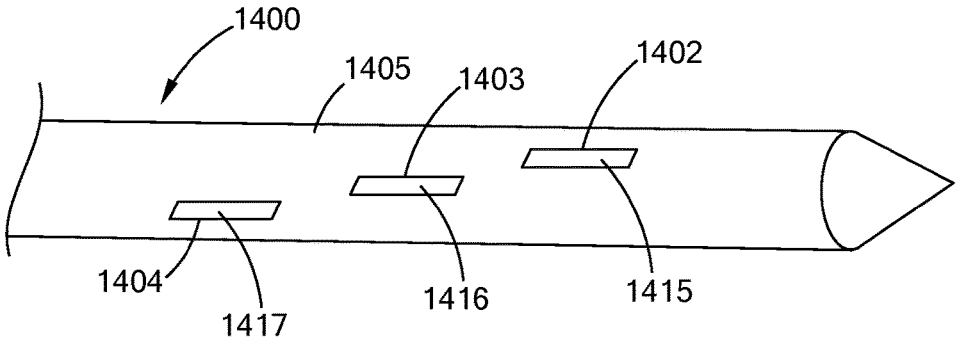
FIG. 16 is a perspective view of an embodiment of a laser perforating head in accordance with the present inventions.
Figure 16A:
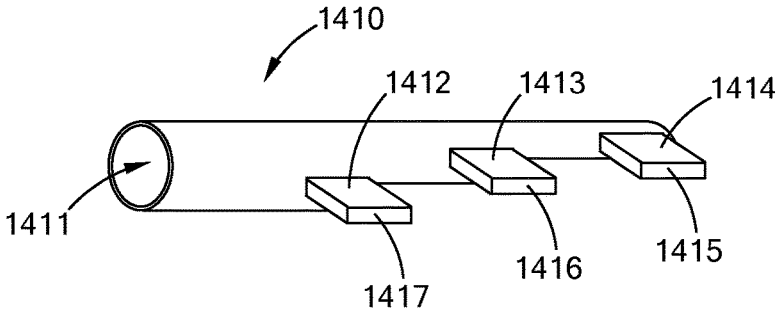
FIG. 16A is a perspective view of the optic assembly of the embodiment of FIG. 16.
Figure 16B:
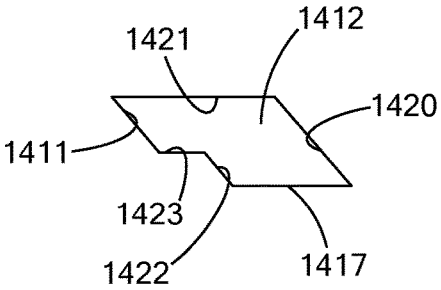
FIG. 16B is a cross section view of a laser beam launch member of the optic assembly of the embodiment of FIG. 16A.

Turning to the embodiment of FIGS. 16, 16A, and 16B there is provided an embodiment of a laser head and optics assembly for use in a laser hydraulic fracturing assembly and laser perforation tool. In this embodiment, the laser head 1400 has an outer body 1405 that has three openings 1402, 1403, 1404. The laser beam in a linear pattern is propagated through those openings. Turning to FIG. 16A, the optics assembly 1410, which is within laser head 1400, is shown. The optics head 1410 has a laser beam receiving or input face 1411 and three angular laser beam launch members 1412, 1413, 1414. Each laser beam launch member has a laser beam launch face 1417, 1416, and 1415. Turning now to FIG. 16B, which by way of example shows a cross sectional view of angular launch member 1412, the member has faces 1420, 1421, 1422 1423 (and side faces not shown) that reflect, and thus, direct the laser beam to and out of face 1417. These reflective faces may be obtained through the use of total internal reflection (TIR), reflected coatings, and combinations and variations of these.

The launch faces, e.g., 1417, of the optics assembly, preferably should be protected from dirt and debris. This may be accomplished by several means. For example, the faces may be slightly recessed within the body 1405 of the head 1400 with channels in, or associated with, the body directing a fluid across and away from the face. The face may be optically coupled to, or have within it, micro channels that are configured to form fluid jets into which the laser beam is coupled in the microchannel. A fluid stream could be flowed annularly down, or more preferably up, to help clear away debris along the surface of the tool.

Three staggered launch faces are shown in the embodiment of FIG. 16. It should be understood that more or less launch faces and launch members may be employed, that these members may obtain their laser energy for a single optical fiber, multiple fibers, or each having their own associated fiber, and that them may be arranged linearly, or in other patterns. The tool head may be attached to, or associated with a laser fracturing assembly or a perforation assembly. This laser head has the capability of having very small outside diameters, and thus has the capability of being configured for use in tubulars, channels, passages or pipes that have an internal diameter of less then about 3", less then about 2", less than about 1" and smaller. In this manner laser hydraulic fracturing can be conducted in product tubing, and boreholes have these smaller diameters.

Figure 17:
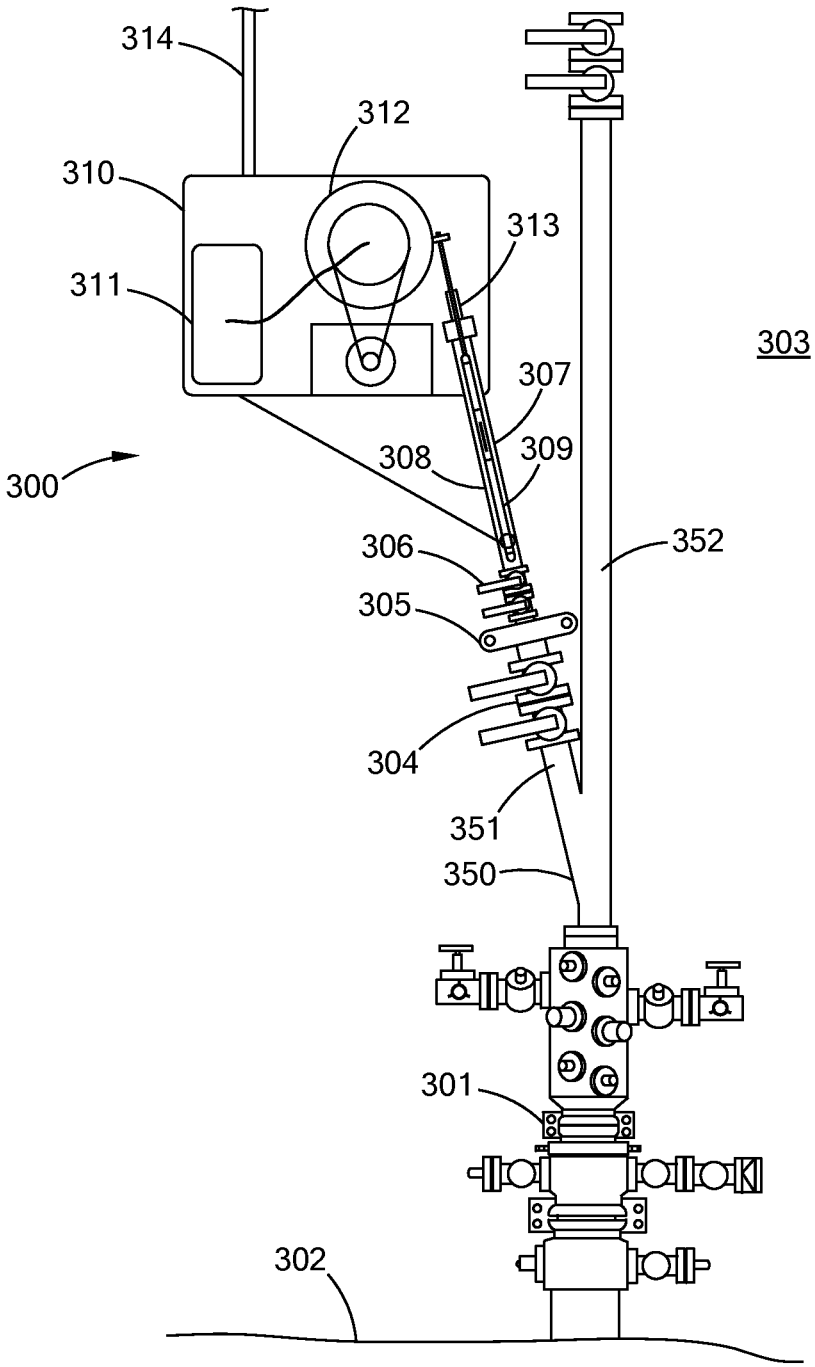
FIG. 17 is a perspective view of an embodiment of a laser fracturing adapter in accordance with the present inventions.

Turning to FIG. 17 there is shown a schematic perspective view of an embodiment of a laser fracturing adapter, which is shown in a subsea application but which also may be utilized on the surface. A subsea production tree 301 is located on the sea floor 302 below the surface (not shown in the figure) of a body of water 303. The tree 301 has a permanent riser assembly 350 attached to it. The permanent riser assembly 350 is in a "Y" configuration, with one branch 352 extending vertically to provide intervention access and the other branch 351 providing access for the laser tool, e.g., a fracturing assembly or laser perforation tool. The branch 351 has a riser isolation valve 304, a riser clamp 305. The laser assembly 300 has a deployment valve 306 that is attached to clamp 305 to connect and hold the laser assembly 300 in association with riser 350. The laser assembly 300 has a laser tool deployment housing 307, that forms a cavity 309 in which the laser tool 308 is housed. When the valves 306 and 304 are opened the cavity 309 is in fluid communication with the riser branch 351 and the tree 301. The laser assembly 300 has a laser container 310 that is sealed for protection from the sea and contains a high power laser 311, a conveyance reel 312 and a conveyance pack-off 313. The laser container 310 can be pressure compensated or at atmospheric pressure. Electric power, fluids of any laser jet, communication and data links are provided to the laser assembly 300 by umbilical 314. In surface applications the laser container 310 may be separate, removed and optically connected by a conveyance structure, and for example, be a laser field unit.

Figure 18:
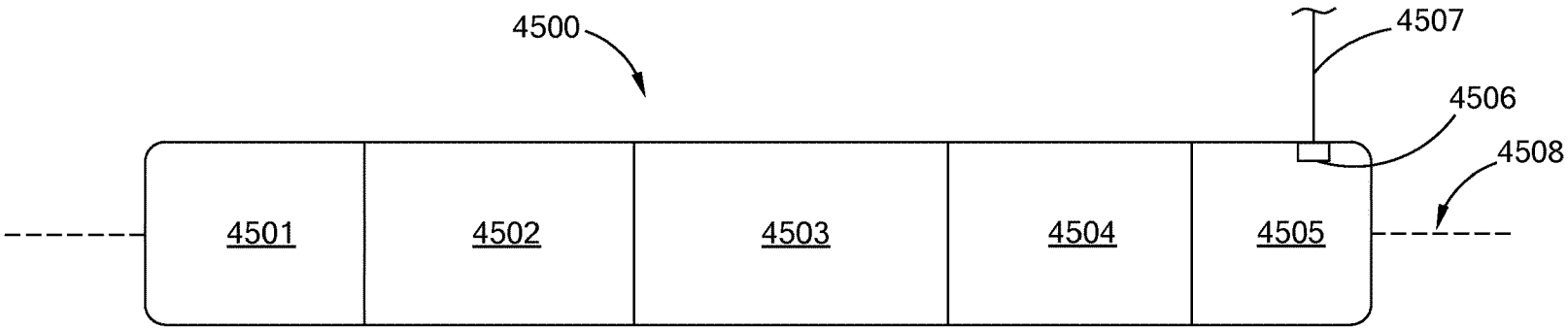
FIG. 18 is schematic view of an embodiment of a laser perforating tool in accordance with the present inventions.

Turning to FIG. 18 there is provided a schematic of an embodiment of a laser tool 4500 having a longitudinal axis shown by dashed line 4508. This tool could be used for, laser hydraulic fracturing, perforating, as well as, other things, such as pipe cutting, decommissioning, plugging and abandonment, window cutting, and milling. The laser cutting tool 4500 has a conveyance termination section 4501. The conveyance termination section 4501 would receive and hold, for example, a composite high power laser umbilical, a coil tube having for example a high power laser fiber and a channel for transmitting a fluid for the laser cutting head, a wireline having a high power fiber, or a slick line and high power fiber, or other type of conveyance structure. The laser tool 4500 has an anchor and positioning section 4502. The anchor and positioning section (which may be a single device or section, or may be separate devices within the same of different sections) may have a centralizer, a packer, or shoe and piston or other mechanical, electrical, magnetic or hydraulic device that can hold the tool in a fixed and predetermined position longitudinally (e.g., along the length of the borehole), axially (e.g., with respect to the axis of the borehole, or within the cross-section of the borehole) or both. The section may also be used to adjust and set the stand off distance that the laser head is from the surface to be perforated.

The laser tool 4500 has a motor section, which may be an electric motor, a step motor, a motor driven by a fluid, or other device to rotate the laser cutter head, or cause the laser beam path to rotate. The rotation of the laser tool, or laser head, may also be driven by the forces generated by the jet, either the laser fluid jet or a separate jet. For example, if the jet exits the tool at an angle or tangent to the tool it may cause rotation. In this configuration the laser fiber, and fluid path, if a fluid used in the laser head, passes by or through the motor section 4503. Motor, optic assemblies, and beam and fluid paths disclosed and taught in US Patent Application Publication No. 2012/0267168, the entire disclosure of which is incorporated herein by reference, may be utilized. There is provided an optics section 4504, which for example, may shape and direct the beam and have optical components such as a collimating element or lens and a focusing element or lens. Optics assemblies, packages and optical elements disclosed and taught in US Patent Application Publication No. 2012/0275159, the entire disclosure of which is incorporated herein by reference, may be utilized.

There is provided a laser cutting head section 4505, which directs and moves the laser beam along a laser beam path 4507. In this embodiment the laser cutting head 4505 has a laser beam exit 4506. In operation the laser beam path may be rotated through 360 degrees to perform a complete circumferential cut of a tubular. (The laser beam may also be simultaneously moved linearly and rotationally to form a spiral, s-curve, figure eight, or other more complex shaped cut.) The laser beam path 4507 may also be moved along the axis 4508 of the tool 4500. The laser beam path also may not be moved during propagation or delivery of the laser beam. In these manners, circular cuts, windows, perforations and other predetermined shapes may be made to a borehole (cased or open hole), a tubular, a support member, or a conductor. In the embodiment of FIG. 45, as well as some other embodiments, the laser beam path 4507 forms a 90-degree angle with the axis of the tool 4508. This angle could be greater than 90 degrees or less then 90 degrees.

The laser cutting head section 4505 preferably may have any of the laser fluid jet heads provided in this specification, it may have a laser beam delivery head that does not use a fluid jet, and it may have combinations of these and other laser delivery heads that are known to the art.

Figure 19:
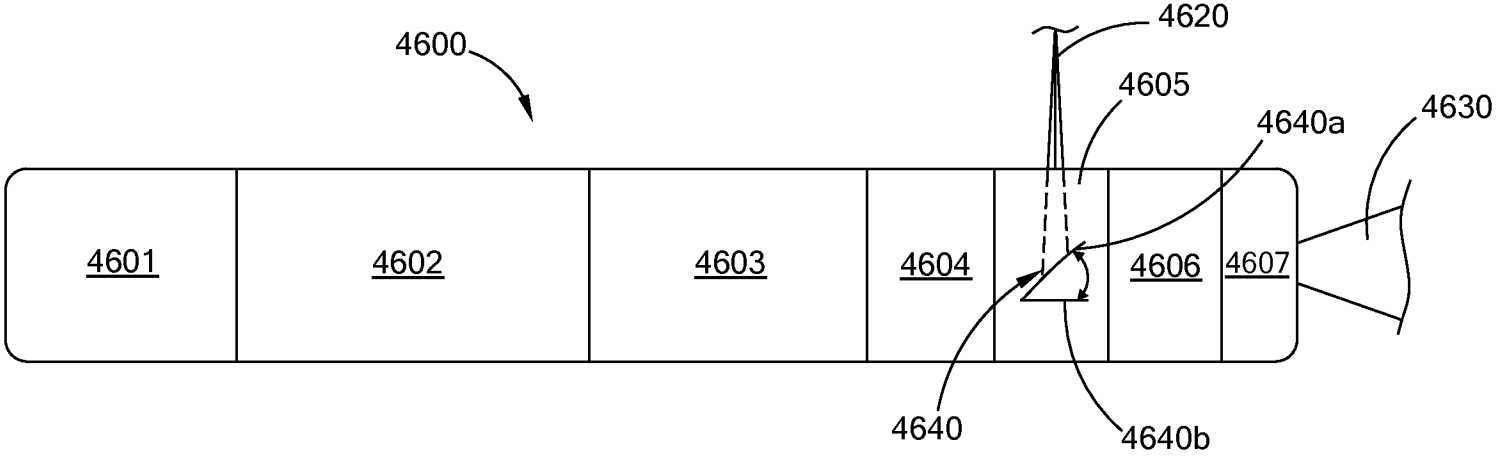
FIG. 19 is schematic view of an embodiment of a laser perforating tool in accordance with the present inventions.

Turning to FIG. 19, there is shown an embodiment of a laser hydraulic fracturing and perforating tool 4600. The laser tool 4600 has a conveyance termination section 4601, an anchoring and positioning section 4602, a motor section 4603, an optics package 4604, an optics and laser cutting head section 4605, a second optics package 4606, and a second laser cutting head section 4607. The conveyance termination section would receive and hold, for example, a composite high power laser umbilical, a coil tube having for example a high power laser fiber and a channel for transmitting a fluid for the laser cutting head, a wireline having a high power fiber, or a slick line and high power fiber.

The anchor and positioning section may have a centralizer, a packer, or shoe and piston or other mechanical, electrical, magnetic or hydraulic device that can hold the tool in a fixed and predetermined position both longitudinally and axially. The section may also be used to adjust and set the stand off distance that the laser head is from the surface to be cut. The motor section may be an electric motor, a step motor, a motor driven by a fluid or other device to rotate one or both of the laser cutting heads or cause one or both of the laser beam paths to rotate.

The optics and laser cutting head section 4605 has a mirror 4640. The mirror 4640 is movable between a first position 4640*a*, in the laser beam path, and a second position 4640*b*, outside of the laser beam path. The mirror 4640 may be a focusing element. Thus, when the mirror is in the first position 4640*a*, it directs and focuses the laser beam along beam path 4620. When the mirror is in the second position 4640*b*, the laser beam passes by the mirror and enters into the second optics section 4606, where it may be preferably shaped into a larger circular spot (having a diameter greater than the tools diameter), or a substantially linear or elongated elliptical pattern, for delivery along beam path 4630. Two fibers and optics assemblies may used, a beam splitter within the tool, or other means to provide the two laser beam paths 4620, 4630 may be used.

The tool of the FIG. 19 embodiment may be used in addition to perforating, for example, in the boring, sidetracking, window milling, rat hole formation, radially cutting, and sectioning operations, wherein beam path 4630 would be used for boring and beam path 4620 would be used for the axial cutting, perforating and segmenting of the structure. Thus, the beam path 4620 could be used to cut a window in a cased borehole and the formation behind the casing. A whipstock, or other off setting device, could be used to direct the tool into the window where the beam path 4630 would be used to form a rat hole; or depending upon the configuration of the laser head 4607, e.g., if it where a laser mechanical bit, continue to advance the borehole. Like the embodiment of FIG. 19, the laser beam path 4620 may be rotated and moved axially. The laser beam path 4630 may also be rotated and preferably should be rotated if the beam pattern is other than circular and the tool is being used for boring. The embodiment of FIG. 19 may also be used to clear, pierce, cut, or remove junk or other obstructions from the borehole to, for example, facilitate the pumping and placement of cement plugs during the plugging of a borehole.

The laser head section 4607 preferably may have any of the laser fluid jet heads provided in this specification and in US Published Application Publication No. 2012/0074110, the entire disclosure of which is incorporated herein by reference, it may have a laser beam delivery head that does not use a fluid jet, and it may have combinations of these and other laser delivery heads that are known to the art.

Figure 20:
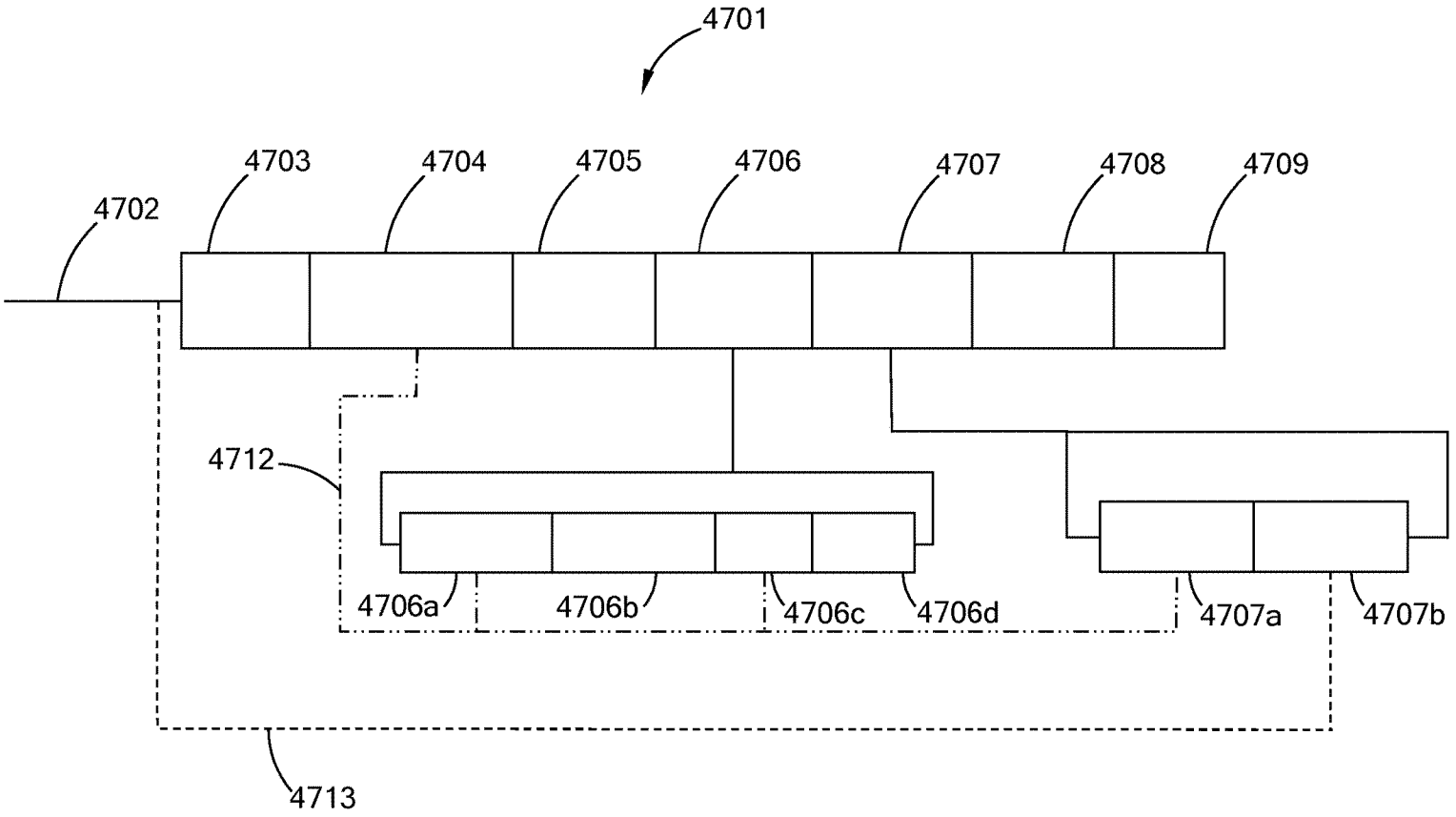
FIG. 20 is schematic view of an embodiment of a laser perforating tool in accordance with the present inventions.
Figure 21:
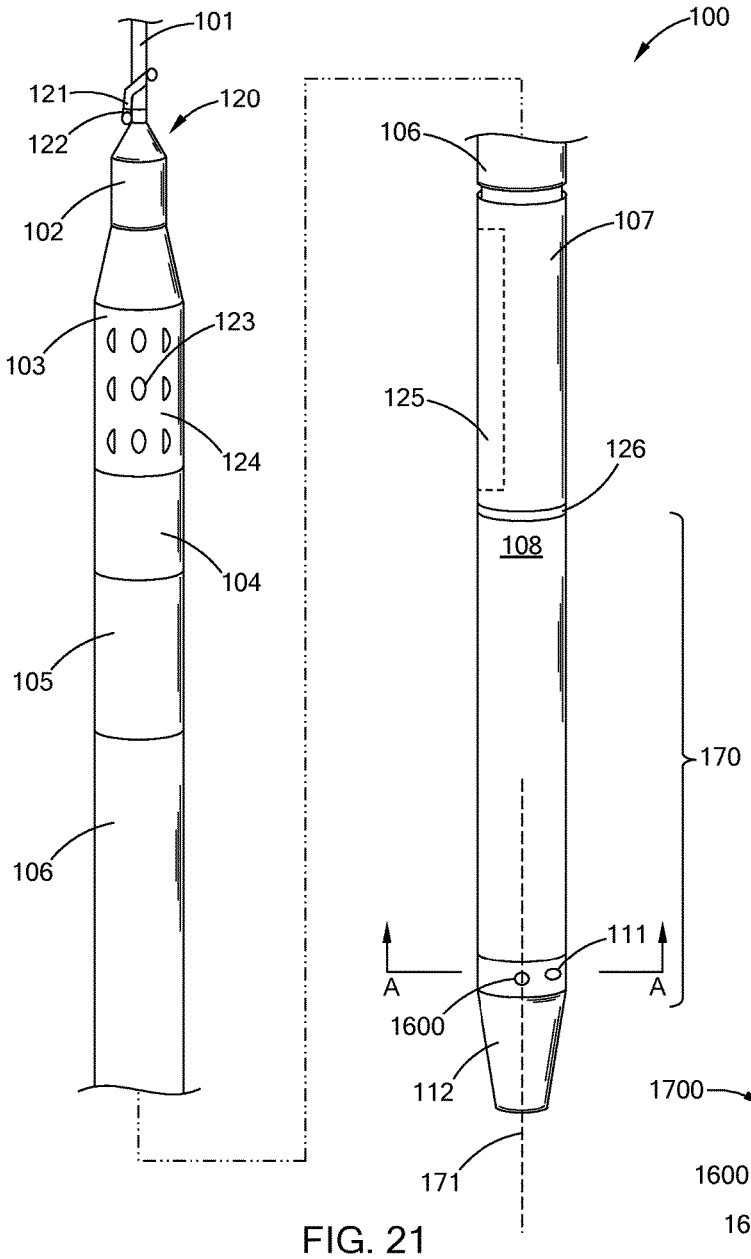
FIG. 21 is perspective view of an embodiment of a laser perforating tool in accordance with the present inventions.
Figure 21A:
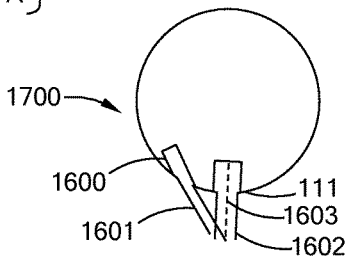
FIG. 21A is cross sectional view of the embodiment of FIG. 16 as taken along line A-A of FIG. 16.

Turning to FIG. 20 there is provided a schematic of an embodiment of a laser tool. The laser tool 4701 has a conveyance structure 4702, which may have an E-line, a high power laser fiber, and an air pathway. The conveyance structure 4702 connects to the cable/tube termination section 4703. The tool 4701 also has an electronics cartridge 4704, an anchor section 4705, an hydraulic section 4706, an optics/cutting section (e.g., optics and laser head) 4707, a second or lower anchor section 4708, and a lower head 4709. The electronics cartridge 4704 may have a communications point with the tool for providing data transmission from sensors in the tool to the surface, for data processing from sensors, from control signals or both, and for receiving control signals or control information from the surface for operating the tool or the tools components. The anchor sections 4705, 4708 may be, for example, a hydraulically activated mechanism that contacts and applies force to the borehole. The lower head section 4709 may include a junk collection device, or a sensor package or other down hole equipment. The hydraulic section 4706 has an electric motor 4706*a*, a hydraulic pump 4606*b*, a hydraulic block 4706*c*, and an anchoring reservoir 4706*d*. The optics/cutting section 4707 has a swivel motor 4707*a* and a laser head section 4707*b*. Further, the motors 4704*a* and 4706*a* may be a single motor that has power transmitted to each section by shafts, which are controlled by a switch or clutch mechanism. The flow path for the gas to form the fluid jet is schematically shown by line 4713. The path for electrical power is schematically shown by line 4712. The laser head section 4707*b* preferably may have any of the laser fluid jet heads provided in this specification, it may have a laser beam delivery head that does not use a fluid jet, and it may have In holes having a beam angle below horizontal a fluid assist may be required, depending upon laser power, shape of the perforation, formation material and other factors. For example, turning to FIGS. 21 and 21A there is provided the laser perforating tool 100 of the embodiment of FIG. 13 (as such like numbers refer to like structures and components). However, the laser head in the laser sub 170 has an angled fluid jet nozzle 1600. In FIG. 21A, which is a cross section along line A-A of FIG. 21, it is shown how the angled fluid jet nozzle 1600 directs the fluid jet 1601 toward the laser jet 1602 (which jets are not shown in FIG. 21). The laser beam path within jet 1602 is shown by dashed line 1603. Thus, the angled jet 1601, and in whole or in part the laser jet 1601, assists in clearing the perforation hole of debris as the perforation hole is advanced deeper into the formation.

Figure 22A:
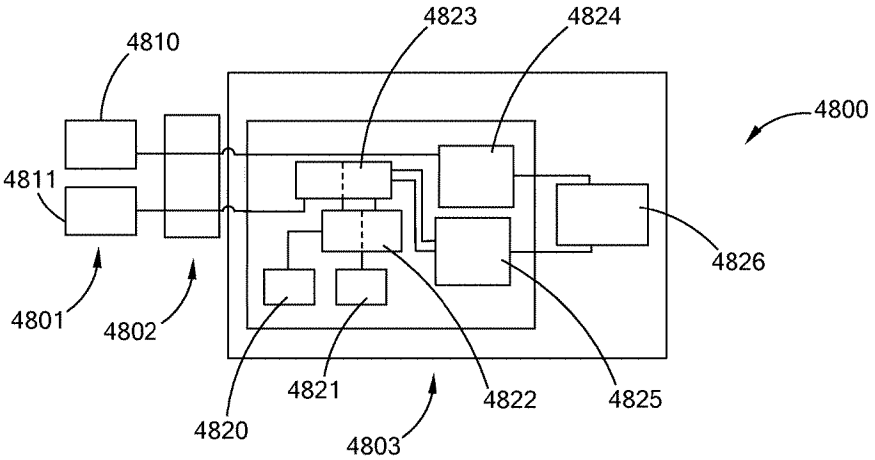
FIG. 22A is schematic view of an embodiment of a laser perforating tool in accordance with the present inventions.
Figure 22B:
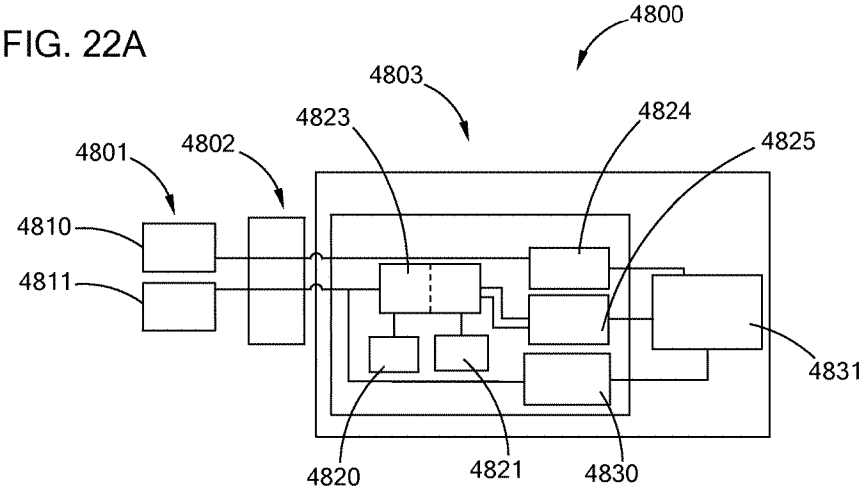
FIG. 22B is schematic view of an embodiment of a laser perforating tool in accordance with the present inventions.

FIGS. 22A and 22B show schematic layouts for perforating and cutting systems using a two fluid dual annular laser jet. Thus, there is an uphole section 4801 of the system 4800 that is located above the surface of the earth, or outside of the borehole. There is a conveyance section 4802, which operably associates the uphole section 4801 with the downhole section 4803. The uphole section has a high power laser unit 4810 and a power supply 4811. In this embodiment the conveyance section 4802 is a tube, a bunched cable, or umbilical having two fluid lines and a high power optical fiber. In the embodiment of FIG. 22A the downhole section has a first fluid source 4820, e.g., water or a mixture of oils having a predetermined index of refraction, and a second fluid source 4821, e.g., an oil having a predetermined and different index of refraction from the first fluid. The fluids are feed into a dual reservoir 4822 (the fluids are not mixed and are kept separate as indicated by the dashed line), which may be pressurized and which feeds dual pumps 4823 (the fluids are not mixed and are kept separate as indicated by the dashed line). In operation the two fluids 4820, 4821 are pumped to the dual fluid jet nozzle 4826. The high power laser beam, along a beam path enters the optics 4824, is shaped to a predetermined profile, and delivered into the nozzle 4826. In the embodiment of FIG. 22B a control head motor 4830 has been added and controlled motion laser jet 4831 has been employed in place of the laser jet 4826. Additionally, the reservoir 4822 may not be used, as shown in the embodiment of FIG. 22B.

Figure 23A:
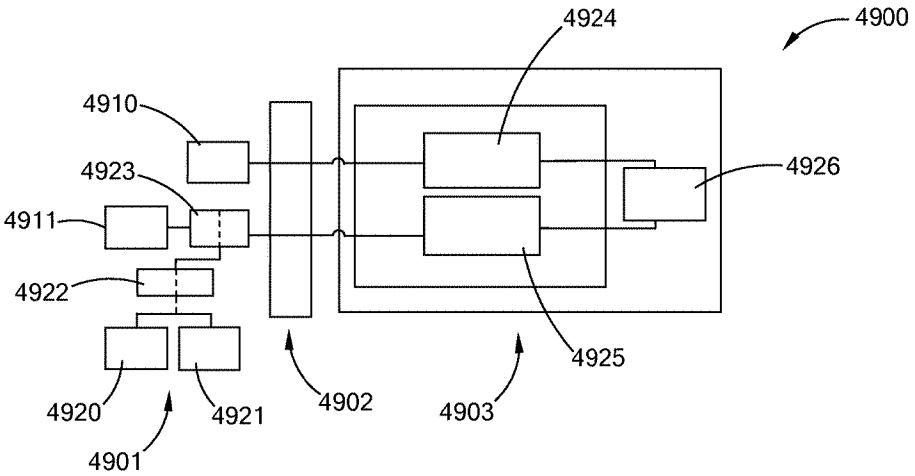
FIG. 23A is schematic view of an embodiment of a laser perforating tool in accordance with the present inventions.
Figure 23B:
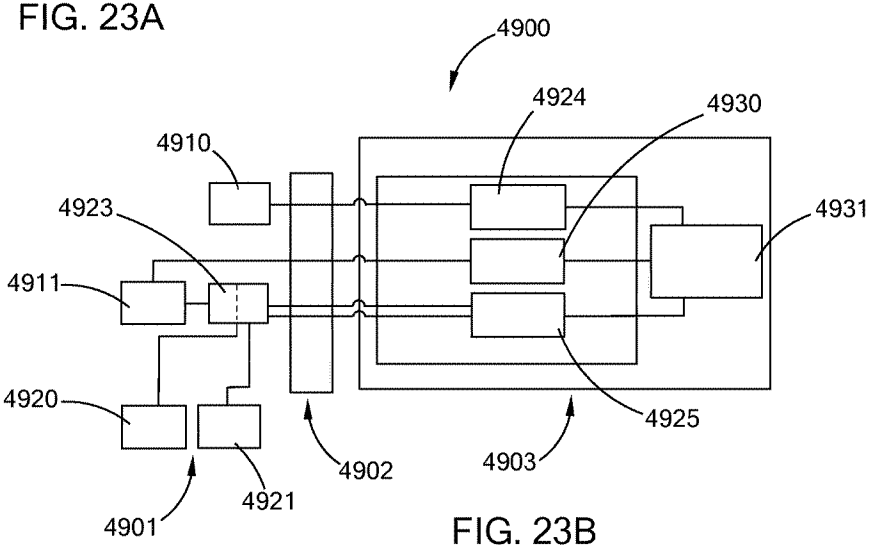
FIG. 23B is schematic view of an embodiment of a laser perforating tool in accordance with the present inventions.

Turning to FIGS. 23A and 23B there is shown schematic layouts for cutting and perforating systems using a two fluid dual annular laser jet. Thus, there is an uphole section 4901 of the system 4900 that is located above the surface of the earth, or outside of the borehole. There is a conveyance section 4902, which operably associates the uphole section 4901 with the downhole section 4903. The uphole section has a high power laser unit 4910 and a power supply 4911 and has a first fluid source 4920, e.g., a gas or liquid, and a second fluid source 4921, e.g., a liquid having a predetermined index of refraction. The fluids are fed into a dual reservoir 4922 (the fluids are not mixed and are kept separate as indicated by the dashed line), which may be pressurized and which feeds dual pumps 4923 (the fluids are not mixed and are kept separate as indicated by the dashed line). In operation the two fluids 4920, 4921 are pumped through the conveyance section 4902 to the downhole section 4903 and into the dual fluid jet nozzle 4926. In this embodiment the conveyance section 4902 is a tube, a bunched cable, or umbilical. For FIG. 23A the conveyance section 4902 would have two fluid lines and a high power optical fiber In the embodiment of FIG. 23B the conveyance section 4902 would have two fluid lines, an electric line and a high power optical fiber. In the embodiment of FIG. 23A the downhole section has an optics assembly 4924 and a nozzle 4925. The high power laser beam, along a beam path enters the optics 4924, where it may be shaped to a predetermined profile, and delivered into the nozzle 4926. In the embodiment of FIG. 23B a control head motor 4930 has been added and controlled motion laser jet 4931 has been employed in place of the laser jet 4926. Additionally, the reservoir 4922 may not be used as shown in the embodiment of FIG. 23B.

Turning to FIGS. 30A-30E there is shown an embodiment of a laser perforating tool 300 for making precise laser cuts along the axial direction of the borehole, such as for example slots. The laser perforating tool 300 has a first centralizer roller assembly 301, a first and second tractor centralizer section 302, 303 and a laser cutting section with a centralizer roller assembly 304. The controlled axial advancement of the laser head section 304 is shown through the progression of FIG. 30A, to 30B to 30C. The controlled and predetermined extension and movement of tractor sections 302, 303 relative to each other, and the roller sections 301, 304 is accomplished by hydraulics, or mechanical advancement devices such as screws.

Figure 24A:
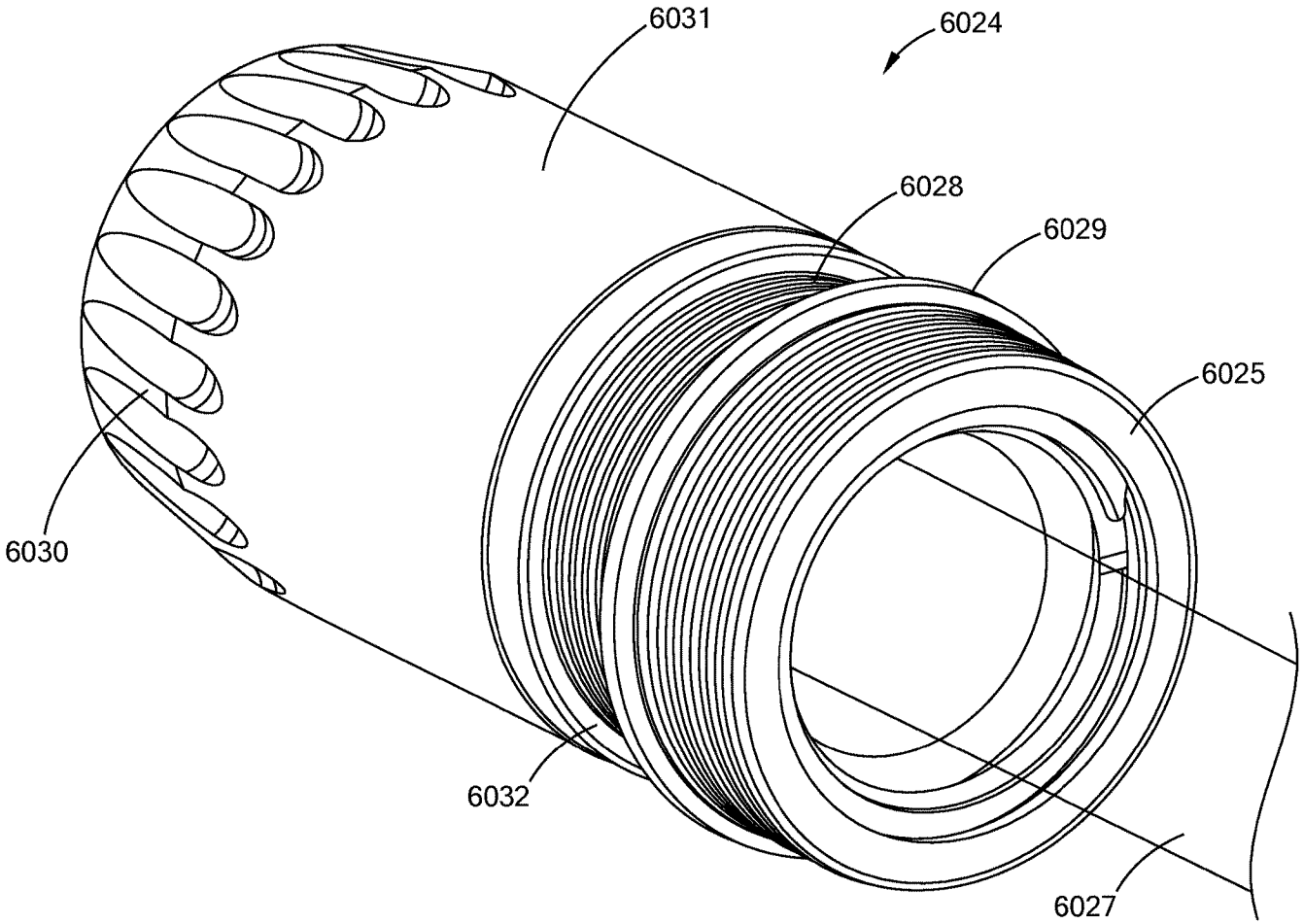
FIG. 24A is a perspective view of an embodiment of an optics assembly in accordance with the present inventions.

Turning to FIG. 24A to 24D there is shown an embodiment of an adjustable optics package that may be used in a laser hydraulic fracturing assembly and a laser perforating tool. FIG. 24A is a perspective view of the adjustable optics package 6024 with a laser beam 6027 being propagated, e.g., fired, shot, delivered, from the front (distal) end 6025 of the optics package 6024. The optics package 6025 has an adjustment body 6028 that has a fixed ring 6029. The adjustment body 6028 is adjustably, e.g., movably, associated with the main body 6031 of the optics package 6024, by threaded members. There is also a locking ring 6032 on the adjustment body 6028. The locking ring 6029 is engageable against the main body to lock the adjustment body 6028 into position.

Figure 24B:
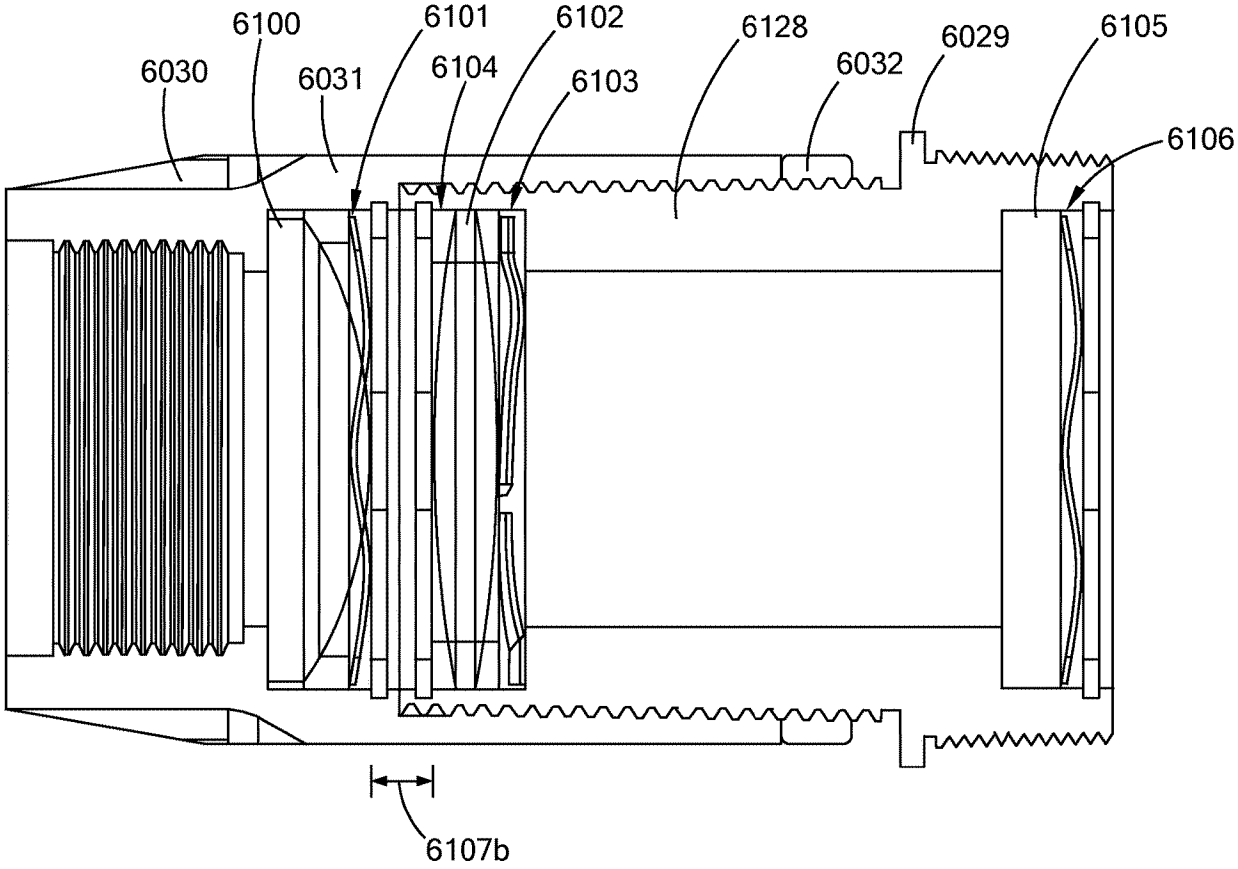
FIG. 24B is a cross sectional view of the embodiment of FIG. 24A.
Figure 24C:
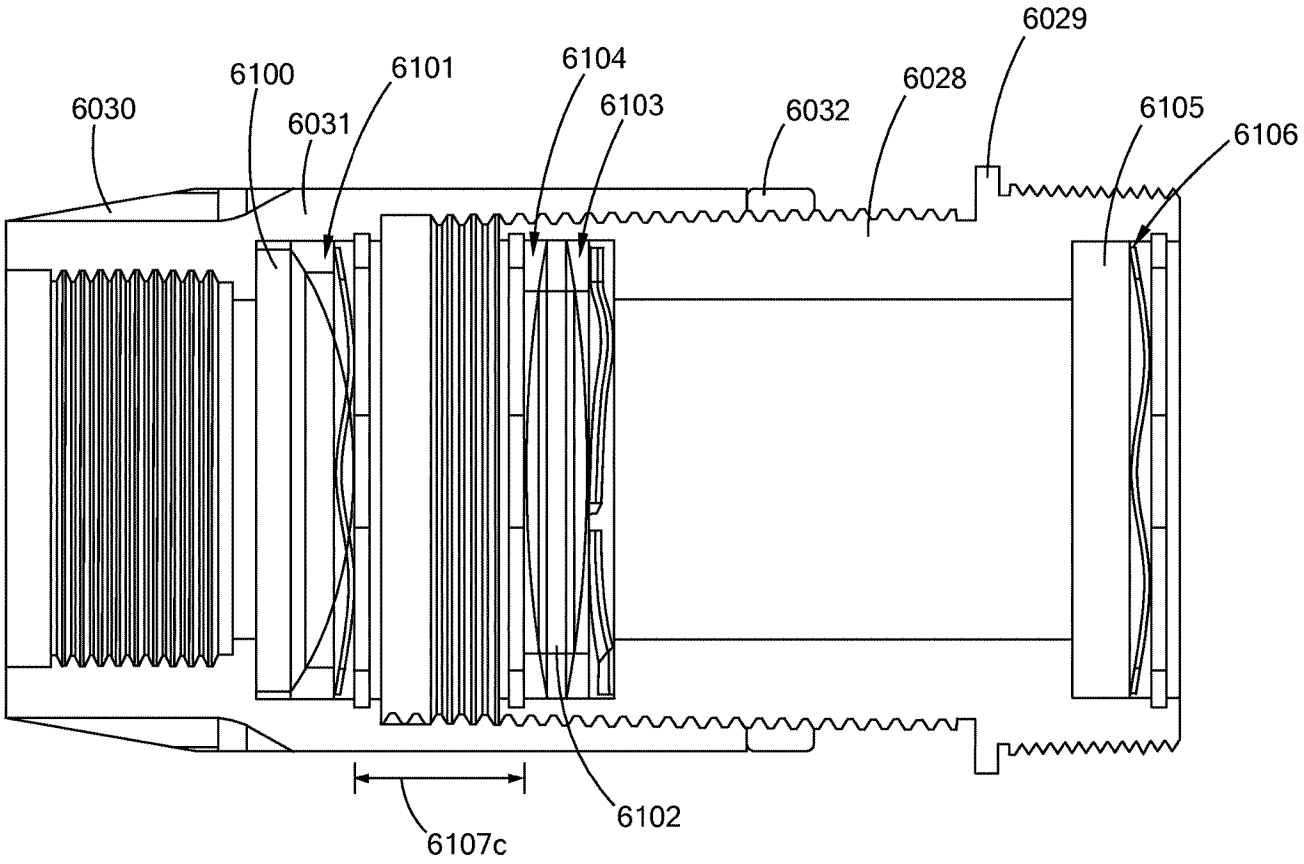
FIG. 24C is a cross sectional view of the embodiment of FIG. 24A.
Figure 24D:
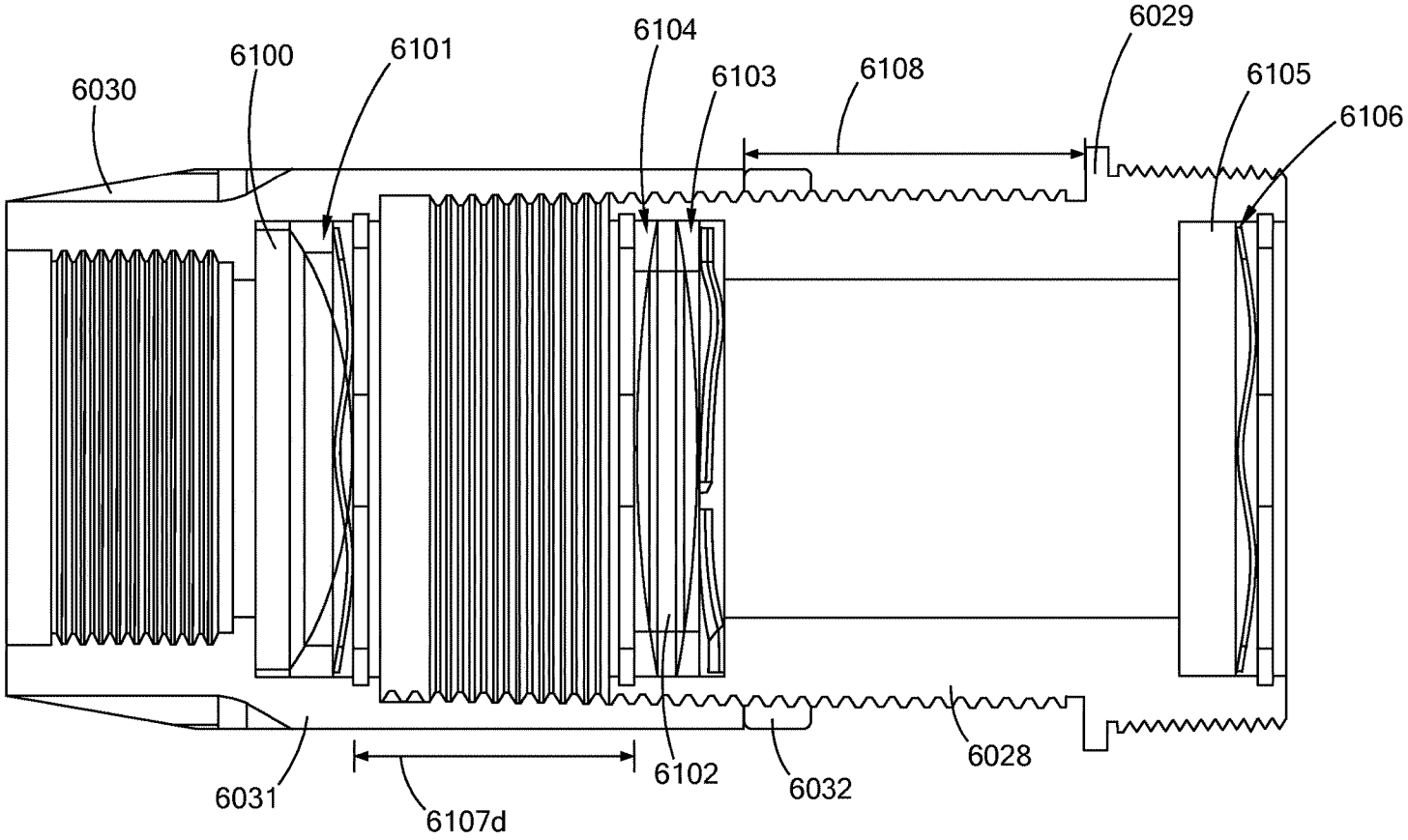
FIG. 24D is a cross sectional view of the embodiment of FIG. 24A.

Turning to FIGS. 24B to 24D, there are shown cross sectional views of the embodiment of FIG. 24A in different adjustment positions. Thus, there is provided a first focusing lens 6100, which is held in place in the main body 6031 by lens holding assembly 6101. Thus, lens 6100 is fixed, and does not change position relative to main body 6031. A second focusing lens 6102 is held in place in the adjustment body 6028 buy holding assemblies 6103, 6104. Thus, lens 6102 is fixed, and does not change position relative to the adjustment body 6028. Window 6105 is held in place in the front end 6025 of the adjustment body 6028 by holding assembly 6106. In this manner as the adjustment body 6028 is moved in and out of the main body 6031 the distance, e.g., 6107*b*, 6107*c*, 6107*d*, between the two lens 6100, 6102 changes resulting in the changing of the focal length of the optical system of the optics package 6024. Thus, the optical system of optics package 6024 can be viewed as a compound optical system.

In FIG. 24B the two lenses 6100, 6102 are at their closest position, i.e., the distance 6107*b* is at its minimum. In FIG. 24C the two lenses 6101, 6102 are at a middle distance, i.e., the distance 6107*c* is at about the mid point between the minimum distance and the maximum distance. In FIG. 24D the two lenses 6101, 6102 are at their furthest operational distance, i.e., the distance 6107*d* is the maximum distance that can operationally be active in the optics assembly. (It should be noted that although the adjustment body 6028 could be moved out a little further, e.g., there are a few threads remaining, to do so could compromise the alignment of the lenses, and thus, could be disadvantages to the performance of the optics package 6024.)

Figure 25:
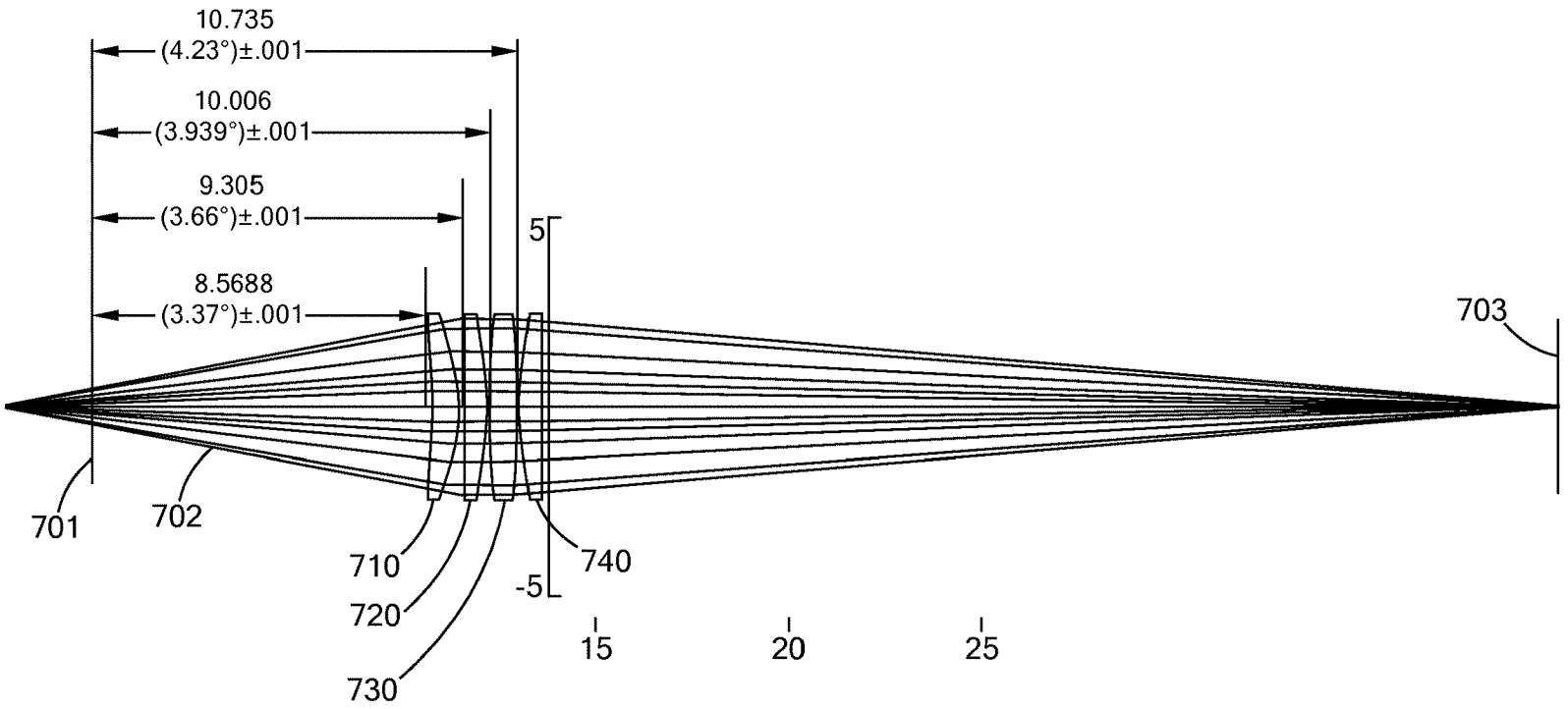
FIG. 25 is a schematic of an embodiment of an optical configuration in accordance with the present inventions.

Turning to FIG. 25, there is shown a schematic of an embodiment of an optical assembly for use in an optics package, having a launch face 701 from a connector, ray trace lines 702 show the laser beam exiting the face of the connector and traveling through four lens, lens 710, lens 720, lens 730, lens 740. In this embodiment lens 710 minimizes the aberrations for the lens 710-720 combination, which combination collimates the beam. Lens 730 and 740 are the focusing lenses, which focus the laser beam to a focal point on focal plane 703. Lens 740 minimizes the spherical aberrations of the 730-740 lens pair.

Differing types of lens may be used, for example in an embodiment Lens 730 has a focal length of 500 mm and lens 740 has a focal length of 500 mm, which provide for a focal length for the optics assembly of 250 mm. The NA of the connector face is 0.22. Lens 710 is a meniscus (f=200 mm). Lens 720 is a plano-convex (f=200 mm). Lens 730 is a plano-convex (f=500 mm). Lens 740 is a meniscus (f=500 mm). In another embodiment only one focusing lens is used, lens 740. Lens 730 has been removed from the optical path. As such, the focal length for the beam provided by this embodiment is 500 mm. In a further embodiment, lens 730 has a 1,000 mm focus and a diameter of 50.8 mm and lens 740 is not present in the configuration, all other lens and positions remain unchanged, providing for an optical assembly that has a focal length of 1,000 mm.

Figure 26A:
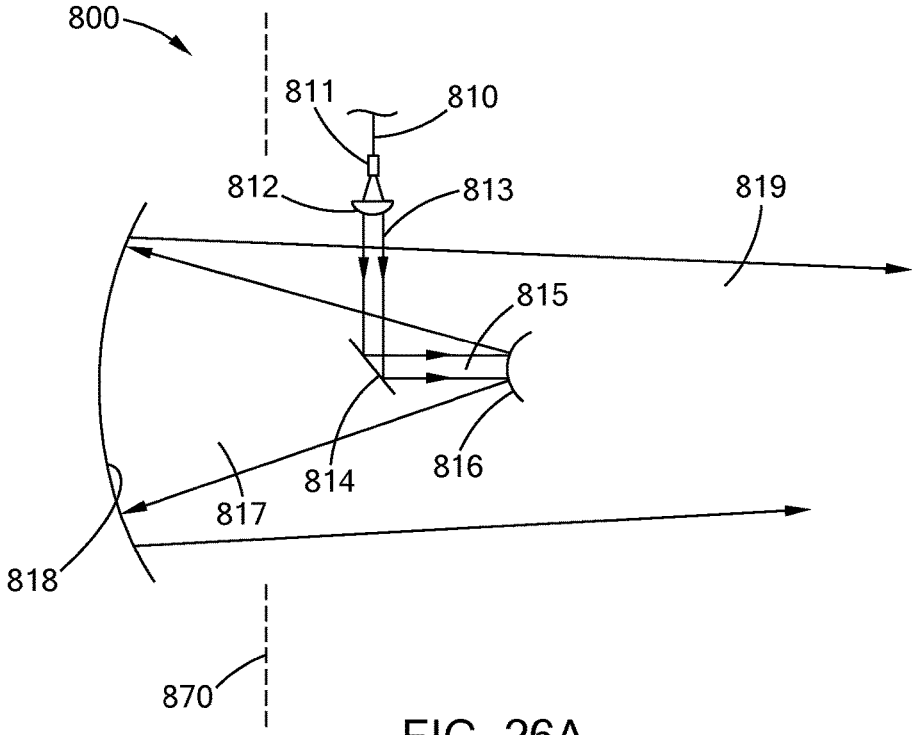
FIG. 26A is a schematic side view of an embodiment of an optical configuration in accordance with the present inventions.
Figure 26B:
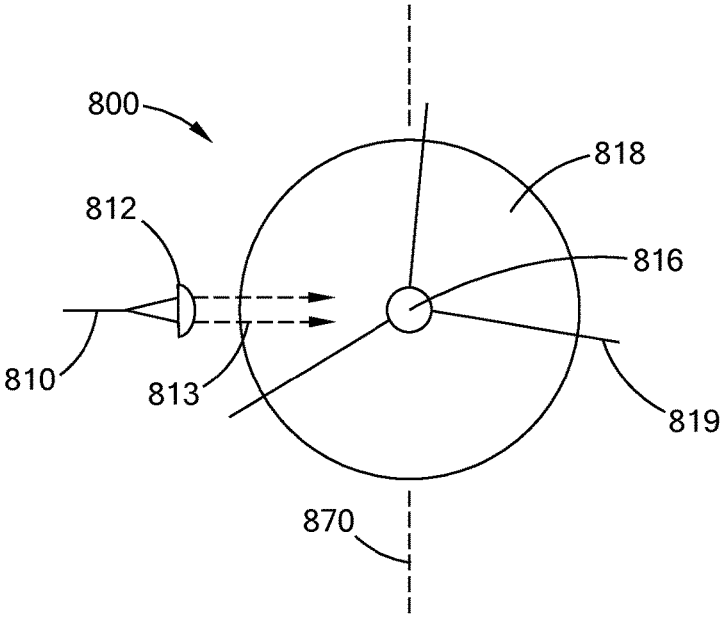
FIG. 26B is a schematic plan view of the embodiment of FIG. 26A.

Turning to FIGS. 26A and 26B there is shown an embodiment of a divergent, convergent lens optics assembly for providing a high power laser beam for creating perforation holes having depths, e.g., distances from the primary borehole, of greater than 10 feet, greater than about 20 feet, greater than about 50 feet, and greater than 100 feet.

FIG. 26A provides a side view of this optics assembly 800, with respect to the longitudinal axis 870 of the tool. FIG. 26B provides a front view of optics assembly 800 looking down the longitudinal axis 870 of the tool. As best seen in FIG. 26A, where there is shown a side schematic view of an optics assembly having a fiber 810 with a connector 811 launch a beam into a collimating lens 812. The collimating optic 812 directs the collimated laser beam along beam path 813 toward reflective element 814, which is a 45° mirror assembly. Reflective mirror 814 directs the collimated laser beam along beam path 815 to diverging mirror 816. Diverging mirror 816 directs the laser beam along diverging beam path 817 where it strikes primary and long distance focusing mirror 818. Primary mirror focuses and directs the laser beam a long perforating laser path 829 toward the casing, cement and/or formation (not shown) to be perforated. Thus, the two mirrors 816, 818, have their reflective surfaces facing each other. The diverging (or secondary) mirror 816 supports 819 are seen in FIG. 26B.

In an example of an embodiment of this optical assembly, the fiber may have a core of about 200 μm, and the NA of the connector 811 distal face is 0.22. The beam launch assembly (fiber 810/connector 811) launches a high power laser beam, having 20 kW of power in a pattern shown by the ray trace lines, to a secondary mirror 816. The diverging mirror 816 is located 11 cm (as measured along the total length of the beam path) from the launch or distal face of the beam launch assembly. The secondary mirror has a diameter of 2" and a radius of curvature 143 cm. For distances of about 100 feet the primary mirror 818 has a diameter of 18" and a radius of curvature of 135 cm. In this embodiment the primary mirror is shaped, based upon the incoming beam profile, to provide for a focal point 100 feet from the face the primary mirror. This configuration can provided a very tight spot in the focal plain, the spot having a diameter of 1.15 cm. Moving in either direction from the focal plane, along the beam waist, for about 4 feet in either direction (e.g., an 8 foot optimal cutting length of the laser beam) the laser beam spot size is about 2 cm. For cutting rock, it is preferable to have a spot size of about ¾" or less (1.91 cm or less) in diameter (for laser beam having from about 10 to 40 kW). In an example of an embodiment during use, the diverging mirror could have 2 kW/cm$^2$ and the primary mirror could have 32 W/cm$^2$ of laser power on their surfaces when performing a laser perforation operation.

Generally, the location and position of the beam waist of the laser beam can be varied and predetermined with respect to the borehole surface, e.g., casing or formation, in which the perforation hole is to be cut. By selecting the position of the beam waist different laser material processes may take place and different shape perforations may be obtained. Thus, and for example, for forming deep penetrations into the formation, the proximal end of the beam waist could be located at the borehole. Many other relative positions of the focal point, the laser beam optimum cutting portion, the beam waste, and the point where the laser beam path initially intersects the borehole surface may be used. Thus, for example, the focal point may be about 1 inch, about 2 inches, about 10 inches, about 15 inches, about 20 inches, or more into (e.g., away from the casing or borehole surface) or within the formation.

Figure 27:
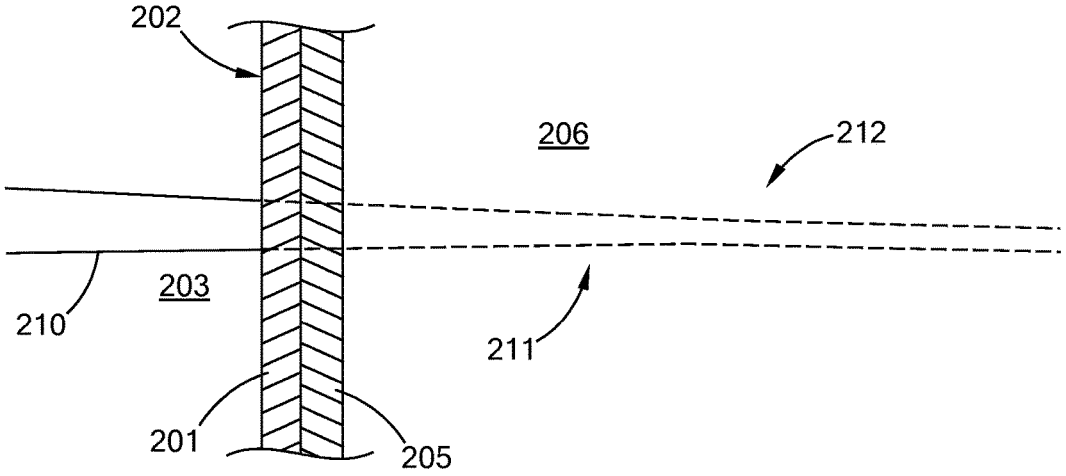
FIG. 27 is a schematic of an embodiment of a laser beam profile in accordance with the present inventions.

The laser beam waist in many applications is preferably in the area of the maximum depth of the cut. In this manner the hole opens up toward the face (front surface) of the borehole, which further helps the molten material to flow from, or be removed from, the perforation hole. Thus turning to FIG. 27 there is shown a casing 201 in a borehole 203 having a front or inner face 202. Between the casing 201 and the formation 206 is cement 205. A laser beam 210 that is launched from a laser perforation tool (not shown in this figure) travels along laser beam path 211 in a predetermined beam profile, which is provided by the laser optical assembly in the tool. The predetermined beam profile provides for a beam waist 212, which is positioned deep within the formation 206 behind the casing 201 and cement 205. Thus, the perforation hole may be about 5 inches, about 10 inches, about 15 inches, about 20 inches or more, or deeper into the formation. Additionally, damaged areas, that are typically present when explosives are used, such as loose rock and perforation debris along the bottom of the hole and a damaged zone extending annularly around the hole, preferably are not present in the laser perforation. Further this preferred positioning of the beam waist, deep within the formation, may also provide higher rates of penetration.

Figure 28A:
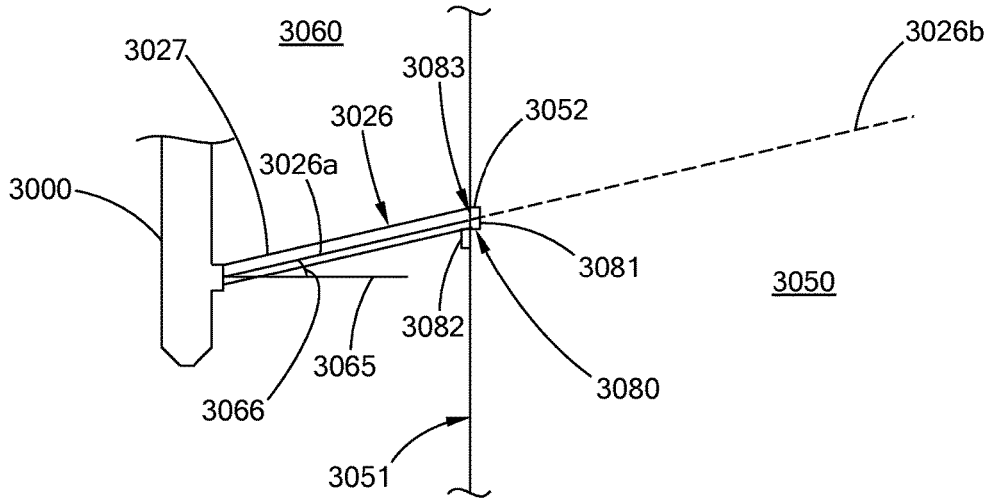
FIGS. 28A, 28B and 28C are schematic snap shots of an embodiment of a process in accordance with the present inventions.
Figure 28B:
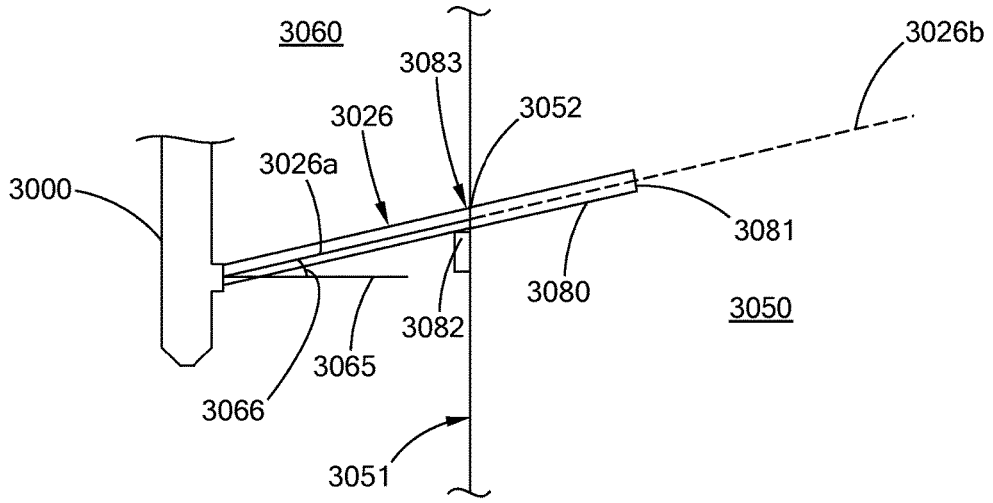
Figure 28C:
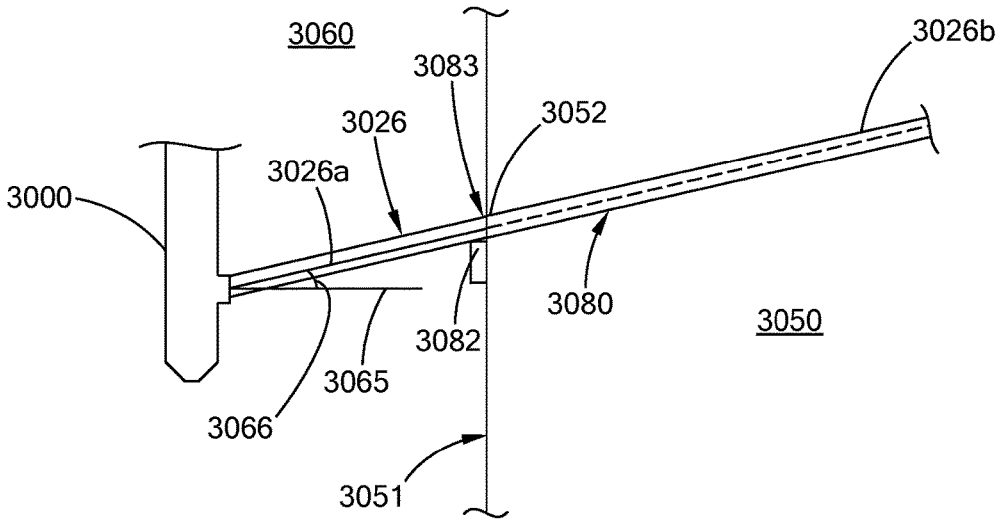

Turning to FIG. 28A through 28C there are provided side cross-sectional schematic snap shot views of an embodiment of a laser operation forming a hole, or perforation, into a formation. Thus, turning to FIG. 28A, in the beginning of the operation the laser tool 3000 is firing a laser beam 3027 along laser beam path 3026, and specifically along section 3026*a* of the beam path. Beam path section 3026*a* is in the wellbore free space 3060, this distance may be essential zero, but is shown as greater for the purpose of illustrating the process. Note, that wellbore free space refers to the fact that the laser has been launched from its last optical element and is no longer traveling in an optical fiber, a lens, a window or other optical element. This environment may be anything but free from fluids; and, if wellbore fluids are present other laser cutting and fluid management techniques can be used if needed. The laser beam path 3026 has a 16° beam path angle 3066 formed with horizontal line 3065. The laser beam path 3026 and the laser beam 3027 traveling along that beam path intersect the borehole face 3051 of the formation 3050 at spot 3052. In this embodiment the proximal end of the laser beam waist section is located at spot 3052. The hole or perforation 3080 is beginning to form, as it can be seen that the bottom, or distal, surface 3081 of the hole 3080 is below surface 3051, along beam path 3026*b*, and within the target material 3050. As can be seen from this figure the hole 3080 is forming with a downward slope from the bottom of the hole 3081 to the hole opening 3083. The molten target material 3082 that has flowed from the hole 3080 cools and accumulates below the hole opening 3083.

Turning to FIG. 28B the hole 3081 has become longer, advancing deeper into the formation 3050. In general, the hole advances along beam path 3026*a*. Thus, the bottom 3081 of the hole is on the beam path 3026*b* and deeper within the formation, e.g., further from the opening 3083, than it was in FIG. 28A.

Turning now to FIG. 28C the hole 3081 has been substantially advanced to the extent that the bottom of the hole is no longer visible in the figure. The amount of molten material 3082 that has flowed from the hole 3081 has continued to grow. In this embodiment the length of hole 3082 is substantially longer than the length of the beam waist. The diameter, or cross sectional size of the hole, however does not increase as might be expected in the area distal to the beam waist. Instead, the diameter remains constant, or may even slightly decrease. It is theorized, although not being bound by this theory, that this effect occurs because the optical properties of the hole, and in particular the molten and semi-molten inner surfaces of the hole, are such that they prevent the laser beam from expanding after it is past, i.e., distal to, the beam waist. Further, and again not being bound by this theory, the inner surfaces may absorb the expanding portions of the laser beam after passing through the waist, the inner surfaces may reflect the expanding portions of the laser beam, in effect creating a light pipe within the hole, or the overall conditions within the hole may create a waive guide, and combinations and variations of these. Thus, the depth or length of the hole can be substantially, and potentially may orders of magnitude greater than the length of the beam waist.

While an upward beam angle is used in the illustrative process of FIGS. 28A to 28C, perforations that are essentially horizontal or that have beam angles that are below horizontal, i.e., sloping downward from the hole opening or vertically downward from the hole opening, may also be made. In upward beam angle operations the need for a fluid assist to clear the perforation hole as it is advanced is greatly reduced, if not entirely eliminated. The perforation hole can advance without the need for any fluid assist, e.g., air or water to remove the molten or laser effected material from the hole.

A laser beam profile in which the laser beam energy is diverging, e.g., more energy is to the outside of the beam than in the center, may be used to make perforations that are below horizontal, including down. The laser beam having this profile creates a surface on the perforation side wall that redirects, e.g., has a channeling or focusing effect, some of the laser beams energy to the center of the beam pattern or spot on the bottom, e.g., far end, of the perforation hole.

The laser beam profile and energy delivery pattern may be used to create a modified surface, and/or structure at the point, or in the general area, where the perforation joins to the borehole, to strengthen the borehole in that area, which may provide additional benefits, for example, when performing hydraulic fracturing.

Additionally, the use of lasers, in comparison to explosive perforators and other perforation techniques that create shock waves, allows for the use down hole during perforating operations of shock sensitive instruments that provide the ability for real time, essentially real time, and monitoring with out the need to trip out and in, during perforating operations, as well as during fracturing operations. Thus, laser perforating tools and laser fracturing assemblies can included, or otherwise have associated with them shock sensitive instruments, such as for the precise measurement of flow, pressure or both, which instruments could not, survive, or reliably survive, down hole in the presence of conventional perforating operations.

Figure 29:
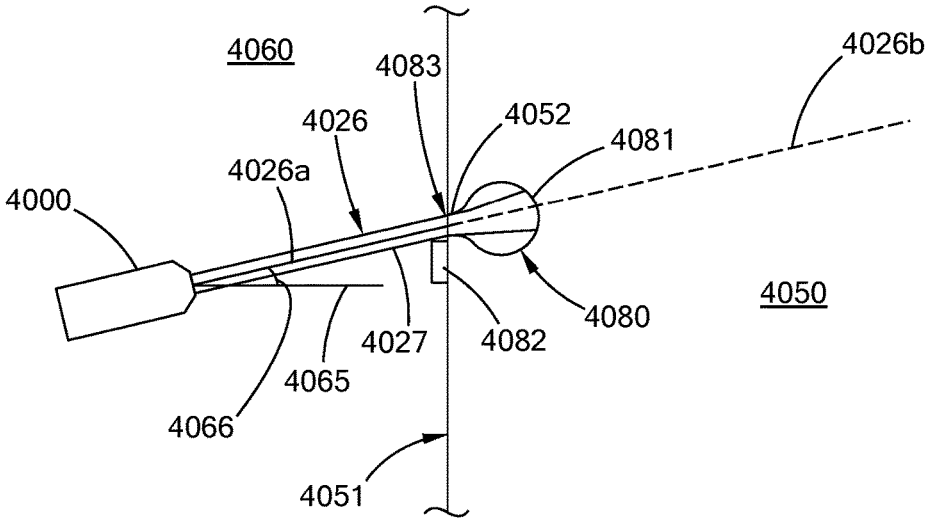
FIG. 29 is a schematic representation of an embodiment of a process in accordance with the present inventions.
Figure 30A:
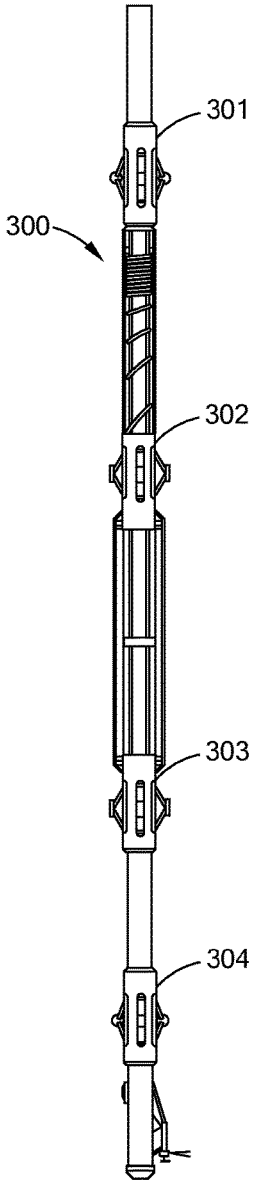
FIGS. 30A, 30B and 30C are snap shots of an embodiment of a laser perforating tool in operation in accordance with the present inventions.
Figure 30B:
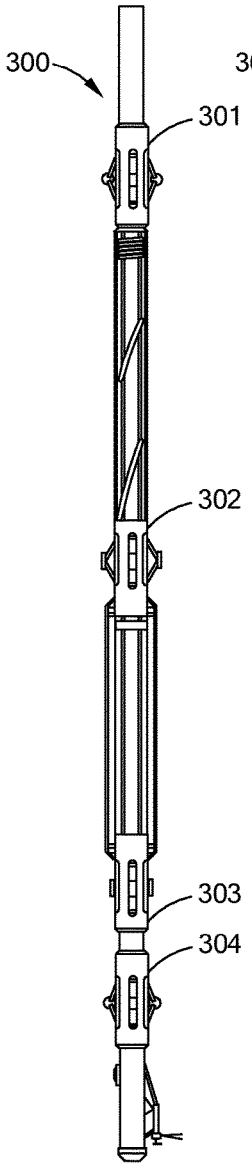
Figure 30C:
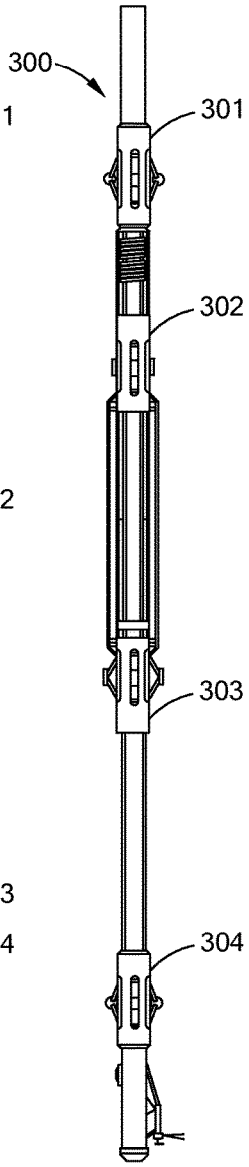
Figure 30D:
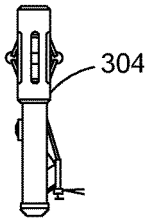
FIGS. 30D to 30F are perspective views of components of the laser perforation tool of FIGS. 30A to 30C.
Figure 30E:
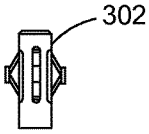
Figure 30F:
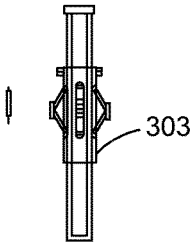

Turning to FIG. 29 there is provided a schematic showing an embodiment of a laser operation in which the distal end of the beam waist is positioned away from the work surface, e.g., borehole surface, of the target material, e.g., formation. The laser tool 4000 is firing a laser beam 4027 along laser beam path 4026, which may be considered as having two section 4026*a* and 4026*b*. Beam path section 4026*a* is in wellbore free space 4060, this distance may be essential zero, but is shown a greater for the purpose of illustrating the process, and beam path 4026*b* is within the target material 4050. Note, that wellbore free space refers to the fact that the laser has been launched from its last optical element and is no longer traveling in a lens or window. This environment may be anything but free from fluids; and, if wellbore fluids are present other fluid management techniques may be utilized. The laser beam path 4026 has a 22° beam path angle 4066 formed with horizontal line 4065. The laser beam path 4026 and the laser beam 4027 traveling along that beam path intersect the surface 4051 of target material 4050 at location 4052. In this embodiment the distal end 4064*b* of the laser beam waist section is not on location 4052 and is located away from surface 4051. In this embodiment the hole or perforation 4080 forms but then reaches a point where the bottom of the hole 4081 will not advance any further along the beam path 4026*b*, e.g., the hole stops forming and will not advance any deeper into the target material 4050. Further, unlike the operation of the embodiment in FIGS. 28A to 28C, the hole 4080 does not have a constant or narrowing diameter as one looks from the opening 4083 to the bottom 4081 of the hole 4080. The molten target material 4082 that has flowed from the hole 4080 cools and accumulates below the hole opening 4083. Based upon the laser beam power and other properties, this embodiment provides the ability to have precise and predetermined depth and shaped holes, in the target material and to do so without the need for measuring or monitoring devices. Once the predetermined depth is achieved, and the advancement process has stopped, regardless of how much longer the laser is fired the hole will not advance and the depth will not increase. Thus, the predetermined depth is essentially a time independent depth. This essentially automatic and predetermined stopping of the hole's advancement provides the ability to have cuts of automatic and predetermined depths, and well as, to section or otherwise remove the face of a rock formation at a predetermined depth in an essentially automatic manner.

Oriented perforations have long been desired by the art, and if properly accomplished viewed as a way to enhance the production from a well. The need to have oriented perforations and the benefits, if such oriented perforations could be obtained and optimized, are addressed and discussed in the art, such as for example, J. Almaguer, Orienting Perforation in the Right Direction, pp 16-31 (Oilfield Review, Spring 2002), US Patent Publication No. 2013/0032347; US Patent Publication No. 2005/0194146; US Patent Publication No. 2010/0269676; and U.S. Pat. No. 8,127,848, the entire disclosures of each of which are incorporated herein by reference. While espousing the benefits of oriented perforations these disclosures, and the art in general, has been unable to obtain or provide such benefits, and to do so on a consistent basis, because of the inherent limitations in current explosive based perforating devices and technologies. As can be seen from the above, by way of example, the art is moving toward more complex explosive configurations; but even these complex configurations are still unduly limited, costly, dangerous, time consuming to configure, and failing in many aspects when viewed against the present laser fracturing and perforating apparatus and methods and their capabilities.

Laser based oriented perforating minimizes flow restrictions and friction pressures during fracturing. It can provide wider fractures that permit, among other things, the use of larger sizes and higher concentrations of proppants along with lower viscosity, less damaging fluids to improve fracture conductivity. In weakly consolidated reservoirs or formations with large stress contrasts, the laser fracturing assemblies provide the ability to consistently obtain properly aligned perforations, which will maximize perforation-tunnel stability in the formation to provide several advantages, including for example mitigation of sand production.

In general, in determining a preferred laser hydraulic fracturing procedure and laser perforation geometry or volumetric removal, the maximum and minimum horizontal stresses and vertical stress from overburden can be viewed among other things as describing the in-situ stress conditions in oil and gas reservoirs. Hydraulic fractures initiate and propagate along a preferred fracture plane ("PFP"), which is the path of least resistance resulting from differences in direction and magnitude of formation stresses. In most cases, stress is greatest in the vertical direction, so the PFP is vertical and lies in the direction of the next greatest stress, e.g., the maximum horizontal stress. Thus, perforations that are not aligned with the maximum stress tend to produce complex flow paths near a wellbore during hydraulic fracturing treatments. Fluids and proppants must exit well bores, and then turn in the formation to align with the PFP. This "tortuosity" causes additional friction and pressure drops that increase pumping horsepower requirements and limit fracture width, which can result in premature screenout from proppant bridging and, consequently, less than optimal stimulation treatments. The present laser based fracturing, hydraulic fracturing, perforating and stimulation systems and methods minimize, reduce and preferably eliminate these undesirable results, and thus, can greatly reduce, if not eliminate tortuosity in the near, and potentially more distance well bore environment.

The laser systems and apparatus of the present inventions can provide for fractures and hydraulic fractures that propagate in the direction of maximum horizontal stress ("Sh"). When perforations are not oriented with the maximum stress, fractures travel from the tunnel base or tip around casing and cement, or turn out in the formation to align with the PFP. This realignment creates complex near-well bore flow paths, including multiple fracture initiation points; competing fractures possibly continuing far afield; micro-annulus pathways with pinch-point restrictions; and fracture wings that are curved or poorly aligned with the wellbore and perforations. These undesirable and costly down hole conditions can be reduced, mitigated and preferably eliminated with the present laser fracturing and perforating systems and methods.

EXAMPLES

The following examples are provided to illustrate various laser hydraulic fracturing operations of the present inventions. These examples are for illustrative purposes, and should not be viewed as, and do not otherwise limit the scope of the present inventions.

Example 1

Using the laser perforating tool a predetermined and oriented volumetric removal of casing and formation is provided down hole. The predetermined volumetric and oriented removal is oriented with the PFP. In this manner the laser volumetric removal allows hydraulic fracturing conditions that generate optimal fracture initiation, fracture propagation, proppant placement and final fracture geometry (e.g., width, length, height and conductivity) and minimize fluid flow right at the wellbore.

Example 2

In a weakly consolidated formation the laser fracturing assembly of the embodiment of FIG. 9 is used to minimize formation failure at the perforations and thus minimize sand production. Further, the laser volumetric removal, e.g., the perforation "tunnels," minimize collapse as reservoir rock supports more overburden as hydrocarbons are produced and pore pressure decreases. The laser volumetric removals are predetermined to be in the most stable directions with minimum stress contrasts to mitigate sand production by reducing flowing pressure drops, changing flow configurations and creating more even stress distributions around the well bore.

Example 3

Using the laser hydraulic fracturing assembly of the embodiment of FIG. 9 a predetermined and oriented volumetric removal of casing and formation is provided down hole. The predetermined volumetric and oriented removal is oriented with the PFP. After an initial flow of a pad of fracturing fluid, the laser cutting operation is adjusted, optimized and continued. In this manner the laser volumetric removal is optimized, based upon real time hydraulic fracturing data, to allow hydraulic fracturing conditions that generate optimal fracture initiation, fracture propagation, proppant placement and final fracture geometry (e.g., width, length, height and conductivity) and minimize fluid flow right at the wellbore.

Example 4

In a well containing multiple tubulars a laser perforation is performed. The laser perforating device is located in the well bore, in the tubular to be perforated. The laser head is aimed such that the laser beam path does not contact the other tubular in the well. This orientation can be accomplished by mechanical means or by sensors. Preferably, a lower power laser beam is used as sensing device or laser range finder to confirm that the laser beam path is properly directed. The laser perforation is then commenced.

Example 5

Figure 31:
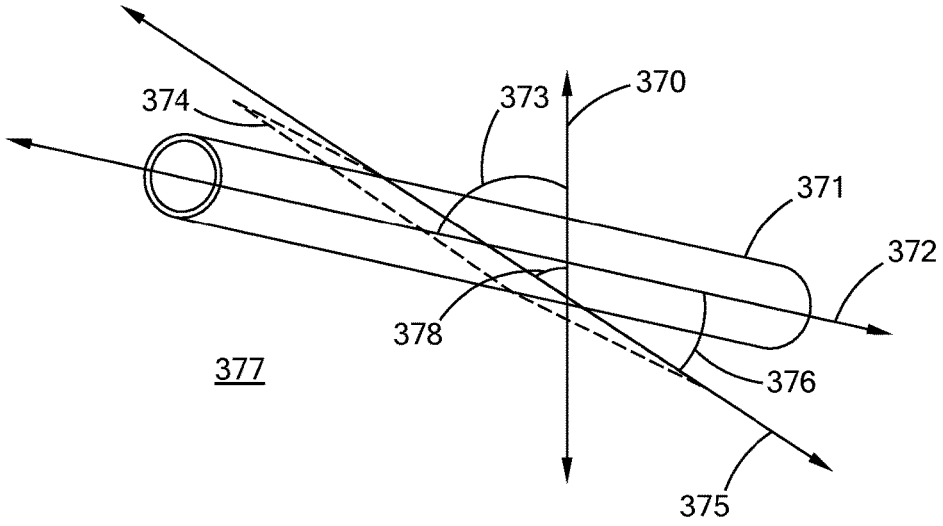
FIG. 31 is a schematic perspective view of an embodiment of a casing in a formation for laser perforating and fracturing in accordance with the present inventions.

Turning to FIG. 31 there is shown a section of a well bore casing 371 in a formation 377. The casing 371 has an axis 372 that is at an angle 373 from vertical 370. The casing 371 is located in formation 377, which has a preferred fracture plane 374 of a hydrocarbon containing formation, which intersects the casing 371. The fracture plane 374 has an axis 375, which forms an angle 376 between the fracture plane axis 375 and the casing axis 372. The angle 378 of the fracture plane from vertical 370 is less than the angle 373 of the casing from vertical 370. It being understood that the angle of the fracture plane from vertical may be greater than, equal to, or less than the angle of the casing from vertical. The orientations of these axes may be at different orientations with respect to the vertical axis, e.g., if viewed as positions on the face of a clock, they may be at different locations on the face of the clock. A custom laser perforation pattern along the axis 375 of the preferred fracture plane 374 is delivered and the formation is hydraulically fractured through those laser perforations.

Example 6

Turning to FIG. 31 there is shown a section of a well bore casing 371 in a formation 377. The casing 371 has an axis 372 that is at an angle 373 from vertical 370. The casing 371 is located in formation 377, which has a preferred fracture plane 374 of a hydrocarbon containing formation, which intersects the casing 371. The fracture plane 374 has an axis 375, which forms an angle 376 between the fracture plane axis 375 and the casing axis 372. The angle 378 of the fracture plane from vertical 370 is less than the angle 373 of the casing from vertical 370. It being understood that the angle of the fracture plane from vertical may be greater than, equal to, or less than the angle of the casing from vertical. The orientations of these axes may be at different orientations with respect to the vertical axis, e.g., if viewed as positions on the face of a clock, they may be at different locations on the face of the clock. Using a laser fracturing assembly of the embodiment of FIG. 2 a preliminary laser perforation pattern is delivered into the formation. A mini-hydraulic fracture is then performed and the pressure and flow characteristics of that fracture are evaluated. From this information, it is determined that significant tortuosity is present. The angle and direction of the laser perforation is adjusted and a second preliminary laser perforation pattern is delivered into the formation. A second mini-hydraulic fracture is then performed and the pressure and flow characteristics of that fracture are evaluated. This procedure of laser perforation, mini-fracture and adjustment is continued until the tortuosity is significantly reduced, and preferably eliminated, by the deliver of the laser perforations and hydraulic fracturing along the axis 375 of the preferred fracture plane 374.

Example 7

Figure 32:
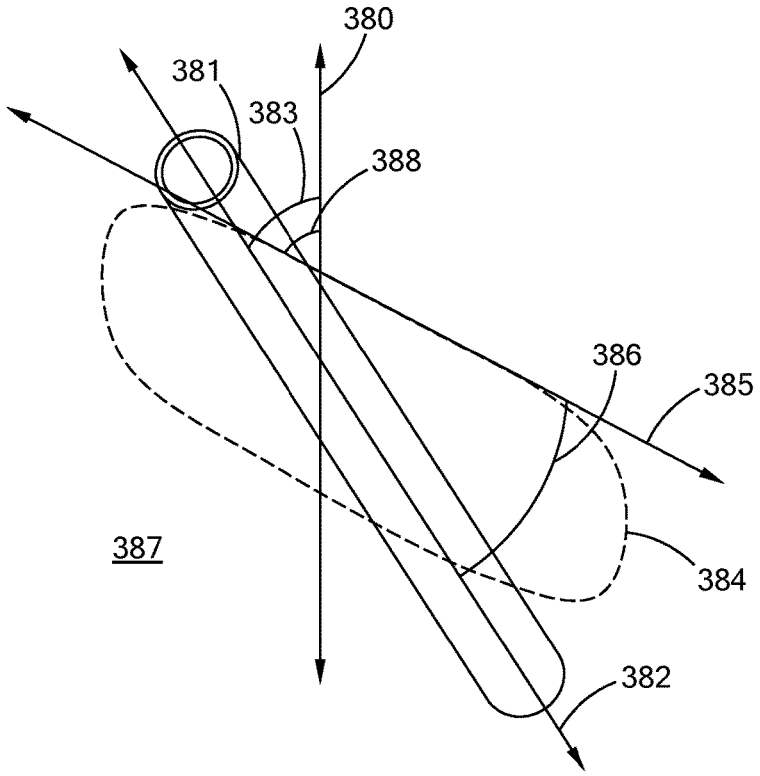
FIG. 32 is a schematic perspective view of an embodiment of a casing in a formation for laser perforating and fracturing in accordance with the present inventions.

Turning to FIG. 32 there is shown a section of a well bore casing 381 in a formation 387. The casing 381 has an axis 382 that is at an angle 383 from vertical 380. The casing 381 is located in formation 387, which has a preferred fracture plane 384 of a hydrocarbon containing formation, which intersects the casing 381. The fracture plane 384 has an axis 385, which forms an angle 386 between the fracture plane axis 385 and the casing axis 382. The angle 388 of the fracture plane from vertical 380 is less than the angle 383 of the casing from vertical 380. It being understood that the angle of the fracture plane from vertical may be greater than, equal to, or less than the angle of the casing from vertical. The orientations of these axes may be at different orientations with respect to the vertical axis, e.g., if viewed as positions on the face of a clock, they may be at different locations on the face of the clock. A custom laser perforation pattern essentially along the axis 385 of the preferred fracture plane 384 is delivered and the formation is hydraulically fractured through those laser perforations.

Example 8

Turning to FIG. 32 there is shown a section of a well bore casing 381 in a formation 387. The casing 381 has an axis 382 that is at an angle 383 from vertical 380. The casing 381 is located in formation 387, which has a preferred fracture plane 384 of a hydrocarbon containing formation, which intersects the casing 381. The fracture plane 384 has an axis 385, which forms an angle 386 between the fracture plane axis 385 and the casing axis 382. The angle 388 of the fracture plane from vertical 380 is less than the angle 383 of the casing from vertical 380. It being understood that the angle of the fracture plane from vertical may be greater than, equal to, or less than the angle of the casing from vertical. The orientations of these axes may be at different orientations with respect to the vertical axis, e.g., if viewed as positions on the face of a clock, they may be at different locations on the face of the clock. Using a laser fracturing assembly of the embodiment of FIG. 9 a preliminary laser perforation pattern is delivered into the formation. A mini-hydraulic fracture is then performed and the pressure and flow characteristics of that fracture are evaluated. From this information, it is determined that significant tortuosity is present. The angle and direction of the laser perforation is adjusted and a second preliminary laser perforation pattern is delivered into the formation. A second mini-hydraulic fracture is then performed and the pressure and flow characteristics of that fracture are evaluated. This procedure of laser perforation, mini-fracture and adjustment is continued until the tortuosity is significantly reduced, and preferably eliminated, by the deliver of the laser perforations and hydraulic fracturing along the axis 385 of the preferred fracture plane 384.

Example 9

Figure 33:
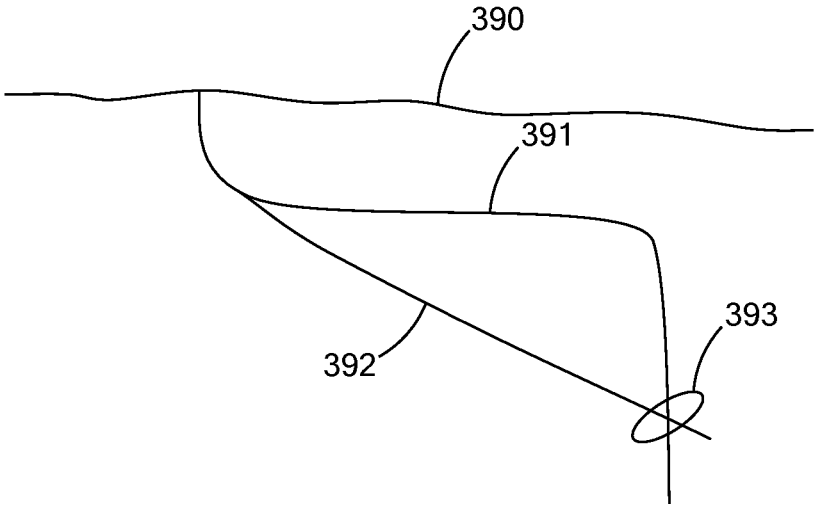
FIG. 33 is a schematic view of an embodiment of a borehole path in a formation for laser perforating and fracturing in accordance with the present inventions.

The critical path of drilling a well is reduced, and the measured depth of the well is reduced by the ability to have laser hydraulic fracturing. Turning to FIG. 33 there is shown a first borehole 391 below the surface 390 of the earth. The borehole 391 follows a path that is designed to intersect a hydrocarbon containing reservoir, having a preferred fracture plane 393, at an angle that accommodates the inherent limitations in explosive based perforations. Because of the greater flexibility, control and predictability of laser perforation and laser hydraulic fracturing the borehole can follow an entirely different path, and can be drilled in a more direct path 392, reducing the critical path to completing the well, and reducing the total measured depth of the well. The laser perforation can be directed to create perforation along the preferred fracture plane of the formation from essentially any angle that the borehole may intersect that plane.

Example 10

In a carbonate oil reservoir as the formation has been depleted pay zones having characteristics of a porosity of 4.8% and a permeability of 2 mD are present. A well bore is drilled, and custom laser perforations are made and the well is hydraulically fractured.

Example 11

In a shale gas reservoir the formation has porosity and permeability of about 3.5% and 300 nD (nanodarcies). A horizontal well is drilled having a TVD of 8,800 feet and a MD of 16,800 feet. The well is laser hydraulically fractured with 5 stages of adaptive laser perforations, to significantly reduce any near well bore tortuosity. After the laser pattern is optimized, and completed, the well is fractured with a slick water hydraulic fracture—about 2,600 gal./min., and about 2,000 tons of sand per 740,000 gals per stage.

Example 12

In a shale reservoir the formation has a porosity and permeability of about 3 to 5% and <500 nD. A horizontal well is drilled having a TVD of 5,500 feet and a MD of 15,700 feet. The well is laser hydraulically fractured with 5 stages of custom volumetric removal laser perforations, using the pattern of the embodiment of FIG. 8. The well is fractured with a slick water hydraulic fracture—about 3,500 gal./min., and about 3,000 tons of sand per 7,000,000 gals for all stages.

Example 13

A oil field for a shale gas reservoir having a porosity and permeability of about 4.5% and 350 nD is planned. A laser hydraulic fracturing model is developed for the production of hydrocarbons from the field. Well placement is increased, and total number of wells is reduced, when compared to placement and numbers by using conventional explosive perforation and fracturing techniques.

Example 14

A testing mini-fracture is performed on a tight shale gas formation having a horizontal borehole with a TVD of 10,000 feet and a MD of 15,000 feet. A laser perforating tool is positioned in the borehole and a series of laser perforation at preset diameters and about 3 inches deep spaced at 12 inch intervals. The diameters of the holes are varied based upon the radial position of the hole, e.g., 0°, 15°, 30°, 45°, etc., each have a unique diameter. The angle of the laser beam path with respect to the axis of the borehole may also be varied to determine the PFP. In this manner a series of mini-fractures for each radial position can be performed, with the perforations being selectively plugged with balls or sealed using the welding capability of the laser, to make certain that known data is being obtained during a particular mini-fracture. In this manner a laser perforation pattern can be devised that will minimize, and preferably reduce near well bore tortuosity.

Example 15

A testing mini-fracture is performed on a tight shale gas formation having an essentially vertical borehole with a TVD of 15,000 feet and a MD of 16,000 feet. A laser perforating tool is positioned in the borehole and a series of laser perforation at preset diameters and about 3 inches deep spaced at 12 inch intervals. The diameters of the holes are varied based upon the radial position of the hole, e.g., 0°, 15°, 30°, 45°, etc., each have a unique diameter. The angle of the laser beam path with respect to the axis of the borehole may also be varied to determined the PFP. In this manner a series of mini-fractures for each radial position can be performed, with the perforations being selectively plugged with balls or sealed using the welding capability of the laser, to make certain that known data is being obtained during a particular mini-fracture. In this manner a laser perforation pattern can be devised that will minimize, and preferably reduce near well bore tortuosity.

Example 16

In laser perforating procedure a series of about 50 laser perforations are made in the casing and into the formation, creating a series of 50 volumetric removals having essentially a cylindrical geometric shape. The diameter of each of the 50 laser created holes, has a diameter of "x", and these diameters very consistent, e.g., having a variation in diameter of less than about 90%, less than about 95%, less than about 98% and preferably less than about 99%.

Example 17

In a laser hydraulic fracturing procedure, an adaptive laser perforating method is employed to develop an optimized laser perforating pattern to minimize near well bore tortuosity. The laser pattern is delivered to the well, and substantially all of the laser perforations, are operable, i.e., they function as channels for the flow of fracturing fluid into the preferred fracturing plane of the formation.

Example 18a

In well bore that has been fractured through perforations is in need of being refractured. The perforations are approximately ¼ inch wide and 2 feet long. A down hole laser patching and welding process, as disclosed and taught in Ser. No. 61/798,875, the entire disclosure of which is incorporated herein by reference, is used to fill and plug the perforation slits with metal. The casing is then reperforated and refractured.

Example 18b

In well bore that has been fractured through perforations is in need of being refractured. The perforations are approximately ¼ inch wide and 2 feet long. A down hole laser patching and welding process, as disclosed and taught in Ser. No. 61/798,875, the entire disclosure of which is incorporated herein by reference, is used to fill and plug the perforation slits with metal. The casing is then reperforated with the downhole laser and refractured.

Example 19

In a shale reservoir the formation has a porosity and permeability of about 3 to 5% and <500 nD. A horizontal well is drilled having a TVD of 5,500 feet and a MD of 15,700 feet. The well is laser hydraulically fractured with 5 stages of custom volumetric removal laser perforations, using the pattern of the embodiment of FIG. 9. Each stage has two disc cut into the 5" casing present in the well. These volumetric removal discs are ¼" in length and remove material into the formation to a depth of about 4" beyond the outer casing wall. Thus the volumetrically removed discs have a length of about ¼" and a radius of about 6½". The well is fractured with a fracturing fluid using proppant.

Example 20

In a shale reservoir the formation has a porosity and permeability of about 5% and <700 nD. A horizontal well is drilled having a TVD of 5,000 feet and a MD of 15,000 feet. The well is laser hydraulically fractured with 3 stages of custom volumetric removal laser perforations, using a volumetric removal pattern that creates perforation holes that are cylindrical; and then hydraulically fractured. The lip (configuration of the opening with respect to the casing and cement) of the perforations and diameter of the perforation is matched and predetermined for the particular type of proppant being used. In this manner, screen outs, abrasion, plugging and burrs are reduced, and preferably eliminated.

Example 21a

Figure 35:
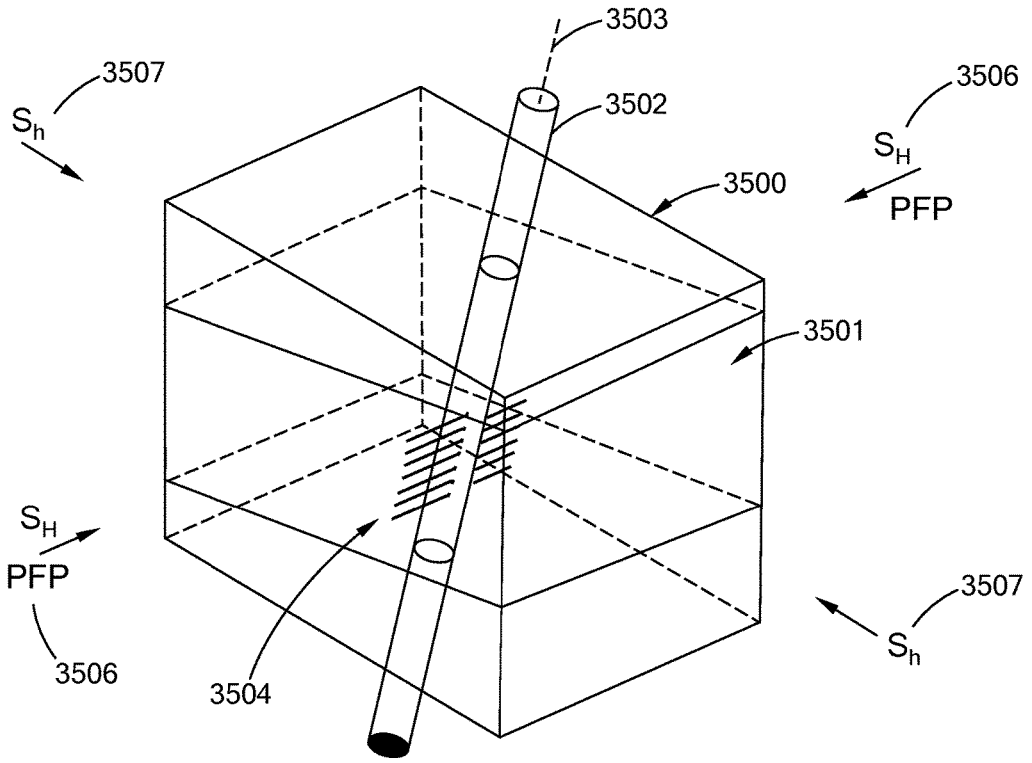
FIG. 35 is a perspective cross sectional view of an embodiment of laser perforations in accordance with the present inventions.

Turning to FIG. 35 there is provided a cross sectional view of a section of a formation 3500 (it being understood that the section is part of the earth below the surface). The formation 3500 has a zone of interest 3501, which may be a pay zone containing hydrocarbons. The formation 3500 has a maximum direction of stress (SH), which is shown by arrows 3506, and is a preferred fracture plane (PFP). The formation 3500 has a minimum direction of stress (Sh), which is shown by arrows 3507. The formation 3500 has a borehole 3502, which has a borehole axis 3503, extends through the formation 3500 and through the zone of interest 3501. The axis 3503 is at an angle and orientation with the zone of interest 3501 and the PFP 3506. Laser perforations 3504 extend out from the borehole in the PFP 3506 and provide a custom laser perforation geometry that enhances the flow of hydrocarbons into the borehole. The laser perforations 3504 are in the PFP 3506, follow the PFP 3506, and are parallel with the PFP 3506.

Example 21b

Turning to FIG. 35 the zone of interest 3501 is hydraulically fractured by flowing under pressure fracturing fluid through the perforations 3504 into the zone of interest 3501, which fractures the zone of interest.

Example 22a

Figure 36:
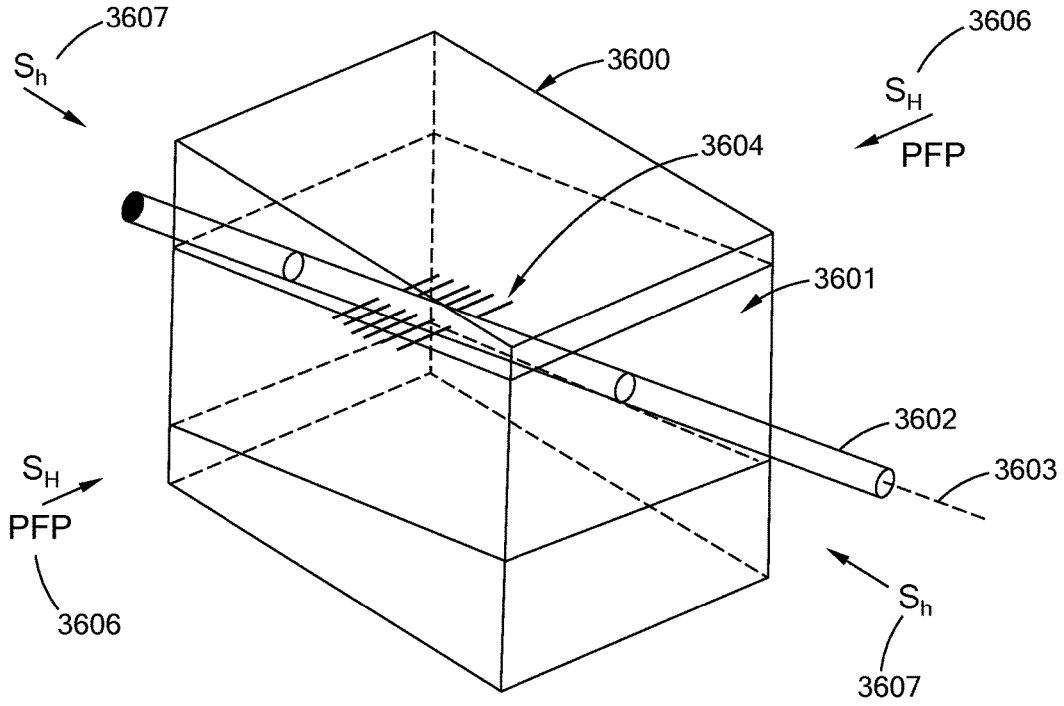
FIG. 36 is a perspective cross sectional view of an embodiment of laser perforations in accordance with the present inventions.

Turning to FIG. 36 there is provided a cross sectional view of a section of a formation 3600 (it being understood that the section is part of the earth below the surface). The formation 3600 has a zone of interest 3601, which may be a pay zone containing hydrocarbons. The formation 3600 has a maximum direction of stress (SH), which is shown by arrows 3606, and is a preferred fracture plane (PFP). The formation 3600 has a minimum direction of stress (Sh), which is shown by arrows 3607. The formation 3600 has a borehole 3602, which has a borehole axis 3603, extends through the formation 3600 and through the zone of interest 3601. The axis 3603 is at an angle and orientation with the zone of interest 3601 and the PFP 3606. Laser perforations 3604 extend out from the borehole in the PFP 3606 and provide a custom laser perforation geometry that enhances the flow of hydrocarbons into the borehole. The laser perforations 3604 are in the PFP 3606.

Example 22b

Turning to FIG. 36 the zone of interest 3601 is hydraulically fractured by flowing under pressure fracturing fluid through the perforations 3604 into the zone of interest 3601, which fractures the zone of interest.

Example 23a

Figure 37:
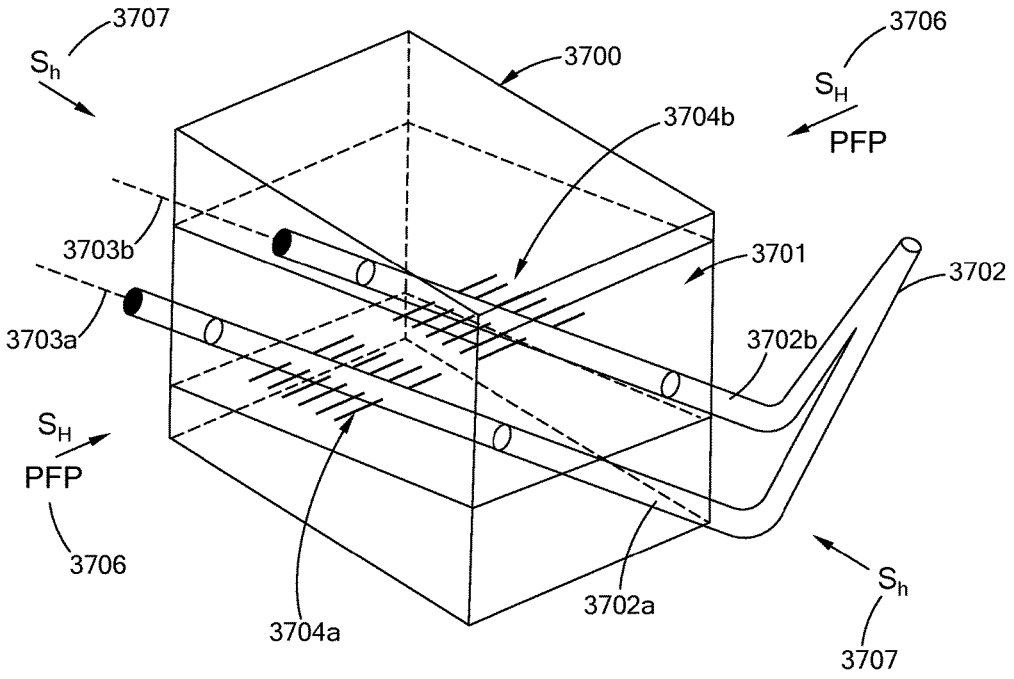
FIG. 37 is a perspective cross sectional view of an embodiment of laser perforations in accordance with the present inventions.

Turning to FIG. 37 there is provided a cross sectional view of a section of a formation 3700 (it being understood that the section is part of the earth below the surface). The formation 3700 has a zone of interest 3701, which may be a pay zone containing hydrocarbons. The formation 3700 has a maximum direction of stress (SH), which is shown by arrows 3706, and is a preferred fracture plane (PFP). The formation 3700 has a minimum direction of stress (Sh), which is shown by arrows 3707. The formation 3700 has a borehole 3702, which branches into two boreholes 3702*a*, 3702*b* each having has a borehole axis 3703*a*, 3703*b*, these two boreholes 3702*a*, 3702*b*, extend through the formation 3700 and through the zone of interest 3701. The axes 3703*a*, 3703*b*, are at an angle and orientation with the zone of interest 3701 and the PFP 3706. Laser perforations 3704*a*, 3704*b*, extend out from the boreholes 3702*a*, 3702*b*, in the PFP 3706 and provide a custom laser perforation geometry that enhances the flow of hydrocarbons into the borehole. The laser perforations 3704*a*, 3704*b* follow the PFP 3506.

Example 23b

Turning to FIG. 37 the zone of interest 3701 is hydraulically fractured by flowing under pressure fracturing fluid through the perforations 3704*a*, 3704*b*, into the zone of interest 3701, which fractures the zone of interest.

In addition to the foregoing examples, laser perforating and fracturing systems and tools and operations may find considerable uses in other unconventional or difficult to produce from formations. For example, in shales for unconventional extraction of gas and oil there is no permeability. The current operations to access this rock and make it productive are to drill a 6 to 12 inch diameter borehole, thousands of feet long with a mechanical rig and bit, and then perforate on the order of inches using explosives. Once the perforations are formed thousands of gallons of high pressure fluid and proppant are used to open the pores to increase permeability.

The high power laser perforating tools can greatly improve on the conventional operation by creating a custom geometry (e.g. shape, length, entrance area, thickness) with a laser. This custom geometry can stem off a main borehole in any orientation and direction, which in turn will initiate a fracture that is more productive than existing conventional methods, by exposing more rock and positioning the fractures in optimum stress planes.

Generally, fracturing in rocks at depth is suppressed by the confining pressure, from the weight of the rocks and earth above. The force of the overlying rocks is particularly suppressive of fracturing in the situation of tensile fractures, e.g., Mode 1 fractures. These fractures require the walls of the fracture to move apart, working against this confining pressure. Hydraulic fracturing or fracing is used to increase the fluid communication between the borehole and the formation. Thus, it can restore, maintain, and increase the rate at which fluids, such as petroleum, water, and natural gas are produced from reservoirs in formations. Thus, it has long been desirable to create conductive fractures in the rock, which can be pivotal to extract gas from shale reservoirs because of the extremely low natural permeability of shale, which is measured in the microdarcy to nanodarcy ranges. These fractures provide a conductive path connecting a larger volume of the reservoir to the borehole.

The custom geometry that can be created with laser perforating can provide enhanced, more predictable, and more controllable predetermined conductive paths that result from hydraulic fracturing. Thus, the laser perforation custom geometry can increase the efficiency of hydraulic fracturing and hydrocarbon production from a well.

The fluids used to perform hydraulic fracture can range from very simple, e.g., water, to very complex. Additionally, these fluids, e.g., fracing fluids or fracturing fluids, typically carry with them proppants; but not in all cases, e.g., when fracing carbonate formations with acids. Proppants are small particles, e.g., grains of sand, aluminum shot, sintered bauxite, ceramic beads, resin coated sand or ceramics, that are flowed into the fractures and hold, e.g., "prop" or hold open the fractures when the pressure of the fracturing fluid is reduced and the fluid is removed to allow the resource, e.g., hydrocarbons, to flow into the well. In this manner the proppants hold open the fractures, keeping the channels open so that the hydrocarbons can more readily flow into the well. Additionally, the fractures greatly increase the surface area from which the hydrocarbons can flow into the well. Typically fracturing fluids, used for example in shale gas stimulations, consist primarily of water but also have other materials in them. The number of other materials, e.g., chemical additives used in a typical fracture treatment varies depending on the conditions of the specific well being fractured. Generally, for shale gas, a typical fracture treatment will use very low concentrations of from about 2 to about 15 additives. Each component serves a specific, engineered purpose to meet anticipated well and formation conditions.

Generally the he predominant fluids being used for fracture treatments in the shale plays are water-based fracturing fluids mixed with friction-reducing additives, e.g., slick water, or slick water fracs. Overall the concentration of additives in most slick water fracturing fluids is generally about 0.5% to 2% with water making up 98% to 99.5%. The addition of friction reducers allows fracturing fluids and proppant to be pumped to the target zone at a higher rate and reduced pressure than if water alone were used.

In addition to friction reducers, other such additives may be, for example: biocides to prevent microorganism growth and to reduce biofouling of the fractures; oxygen scavengers and other stabilizers to prevent corrosion of metal pipes; and acids that are used to remove drilling mud damage within the near-wellbore.

Further these chemicals and additives could be one or more of the following, and may have the following uses or address the following needs: diluted Acid (≈15%), e.g., hydrochloric acid or muriatic acid, which may help dissolve minerals and initiate cracks in the rock; a biocide, e.g., Glutaraldehyde, which eliminates bacteria in the water that produce corrosive byproducts; a breaker, e.g., ammonium persulfate, which allows a delayed break down of the gel polymer chains; a corrosion inhibitor, e.g., N,n-dimethyl formamide, which prevents the corrosion of pipes and equipment; a crosslinker, e.g., borate salts, which maintains fluid viscosity as temperature increases; a friction reducer; e.g., polyacrylamide or mineral oil, which minimizes friction between the fluid and the pipe; guar gum or hydroxyethyl cellulose, which thickens the water in order to help suspend the proppant; an iron control, e.g., citric acid, which prevents precipitation of metal oxides; potassium chloride, which creates a brine carrier fluid; an oxygen scavenger, e.g., ammonium bisulfite, which removes oxygen from the water to reduce corrosion; a pH adjuster or buffering agent, e.g., sodium or potassium carbonate, which helps to maintain the effectiveness of other additives, such as, e.g., the crosslinker; scale inhibitor, e.g., ethylene glycol, which prevents scale deposits in pipes and equipment; and a surfactant, e.g., isopropanol, which is used to increase the viscosity of the fracture fluid.

The ability to cut custom and smooth perforation opens, as well as custom geometries, e.g., cuts into and following the PFP, provides the ability to reduce the dependency, need for, and thus the amount of chemicals used in a fracturing fluid. Thus, in a slick water fractures, but of more importance in the more chemically complex fracturing jobs, the use of laser perforation and laser fracturing can reduce, and preferably greatly reduce, the amount, the number and both, of the chemical additives used, or that are needed in the fracing fluid for a particular fracturing job.

Laser perforated custom geometries for hydraulic fracturing have many advantages in all well types, and particularly have advantages in horizontal drilling, which involves wellbores where the borehole is completed as a "lateral" that extends parallel to the hydrocarbon containing rock layer. For example, lateral boreholes can extend 1,500 to 5,000 feet (460 to 1,500 m) in the Barnett Shale basin in Texas, and up to 10,000 feet (3,000 m) in the Bakken formation in North Dakota. In contrast, a vertical well only accesses the thickness of the rock layer, typically 50-300 feet (15-91 m). Additionally, mechanical drilling, however, typically causes damage to the pore space, e.g., formation structure, at the near well bore area, including at the wellbore wall, reducing the permeability at and near the wellbore. This reduces flow into the borehole from the surrounding rock formation, and partially seals off the borehole from the surrounding rock. Custom geometries, from the laser perforation, enable hydraulic fracturing in these wells to restore and potentially increase permeability and the productivity of the well.

Thus, the laser perforating tools, and laser energy distribution patterns, which can provide custom geometries for hydraulically fracturing operations, have the potential to greatly increase hydrocarbon production, especially form unconventional sources.

Downhole tractors and other types of driving or motive devices may be used with the laser tools. These devices can be used to advance the laser tool to a specific location where a laser process, e.g., a laser cut is needed, or they can be used to move the tool, and thus the laser head and beam path to deliver a particular pattern to make a particular cut. It being understood that the arrangement and spacing of these components in the tools and systems may be changed, and that additional and different components may be used or substituted in, for example, such as a MWD/LWD section.

The high power laser fluid jets, laser heads and laser delivery assemblies disclosed and taught in US Patent Application Publ. No. 2012/0074110, the entire disclosure of which is incorporated herein by reference, may be used with, in, for, and as a part of the laser perforating tools, systems and methods of the present inventions. Laser fluid jets, and their laser tools and systems may provide for the creation of perforations in the borehole that can further be part of, or used in conjunction with, recovery activities such as geothermal wells, EGS (enhanced geothermal system, or engineered geothermal system), hydraulic fracturing, microfracturing, recovery of hydrocarbons from shale and any other rock formations, oriented perforation, oriented fracturing and predetermined perforation patterns. Moreover, the present inventions provide the ability to have precise, varied and predetermined shapes for perforations, and to do so volumetrically, in all dimensions, i.e. length, width, depth and angle with respect to the borehole.

Thus, the present inventions provide for greater flexibility in determining the shape and location of perforations, than the conical perforation shapes that are typically formed by explosives or the holes created by pumping solids in a stream of fluid at high pressure. For example, perforations in the geometric shape of slots, squares, rectangles, ellipse, and polygons that do not diminish in area as the perforation extend into the formation, that expand in area as the perforation extends into the formation, or that decrease in area, e.g., taper, as the perforation extends into the formation are envisioned. Further, the locations of the perforation along the borehole can be adjusted and varied while the laser tool is downhole; and, as logging, formation, flow, pressure and measuring data is received. Thus, the present inventions provide for the ability to precisely position additional perforations without the need to remove the perforation tool from the borehole.

Accordingly, there is provided a procedure where a downhole tool having associated with it a logging and/or measuring tool and a fluid laser jet tool is inserting into a borehole. The laser tool is located in a desired position in the borehole (based upon real-time data, based upon data previously obtained, or a combination of both types of data) and a first predetermined pattern of perforations is created in that location. After the creation of this first set of perforations additional data from the borehole is obtained, without the removal of the laser tool, and based upon such additional data, a second pattern for additional perforations is determined (different shapes or particular shapes may also be determined) and those perforations are made, again without removal of the laser tool from the well. This process can be repeated until the desired flow, or other characteristics of the borehole are achieved.

Thus, by way of example and generally, in an illustrative hydraulic fracturing operation water, proppants, e.g., sand, acids (with or without proppants) and additives are pumped at very high pressures down the borehole. These liquids flow through perforated sections of the borehole, and into the surrounding formation, fracturing the rock and injecting the proppants into the cracks, to keep the crack from collapsing and thus, the proppants, as their name implies, hold the cracks open. During this process operators monitor and gauge pressures, fluids and proppants, studying how they react with and within the borehole and surrounding formations. Based upon this data typically the density of sand to water is increased as the frac progresses. This process may be repeated multiple times, in cycles or stages, to reach maximum areas of the wellbore. When this is done, the wellbore is temporarily plugged between each cycle to maintain the highest water pressure possible and get maximum fracturing results in the rock. These so called frac-plugs or sliding sleeves are drilled or removed from the wellbore and the well is tested for results. When the desired results have been obtained the water pressure is reduced and fluids are returned up the wellbore for disposal or treatment and re-use, leaving the sand in place to prop open the cracks and allow the hydrocarbons to flow. Further, such hydraulic fracturing can be used to increase, or provide the required, flow of hot fluids for use in geothermal wells, and by way of example, specifically for the creation of enhanced (or engineered) geothermal systems ("EGS").

The present invention provides the ability to greatly improve upon explosive based fracing processes, described above. Thus, with the present invention, preferably before the pumping of the fracing components begins, a very precise and predetermined perforating pattern can be placed in the borehole. For example, the shape, size, location and direction of each individual perforation can be predetermined and optimized for a particular formation and borehole. The direction of the individual perforation can be predetermined to coincide with, complement, or maximize existing fractures in the formation. Thus, although is it is preferred that the perforations are made prior to the introduction of the fracing components, these steps maybe done at the same time, partially overlapping, or in any other sequence that the present inventions make possible. Moreover, this optimization can take place in real-time, without having to remove the laser tool of the present invention form the borehole. Additionally, at any cycle in the fracturing process the laser tool can be used to further maximize the location and shape of any additional perforations that may be desirable. The laser tool may also be utilized to remove the frac-plugs.

A single high power laser may be utilized in or with these systems, tools and operations, or there may be two or three high power lasers, or more. High power solid-state lasers, specifically semiconductor lasers and fiber lasers are preferred, because of their short start up time and essentially instant-on capabilities. The high power lasers for example may be fiber lasers, disk lasers or semiconductor lasers having 5 kW, 10 kW, 20 kW, 50 kW, 80 kW or more power and, which emit laser beams with wavelengths in the range from about 455 nm (nanometers) to about 2100 nm, preferably in the range about 400 nm to about 1600 nm, about 400 nm to about 800 nm, 800 nm to about 1600 nm, about 1060 nm to 1080 nm, 1530 nm to 1600 nm, 1800 nm to 2100 nm, and more preferably about 1064 nm, about 1070-1080 nm, about 1360 nm, about 1455 nm, 1490 nm, or about 1550 nm, or about 1900 nm (wavelengths in the range of 1900 nm may be provided by Thulium lasers). An example of this general type of fiber laser is the IPG YLS-20000. The detailed properties of which are disclosed in US patent application Publication Number 2010/0044106. Thus, by way of example, there is contemplated the use of four, five, or six, 20 kW lasers to provide a laser beam having a power greater than about 60 kW, greater than about 70 kW, greater than about 80 kW, greater than about 90 kW and greater than about 100 kW. One laser may also be envisioned to provide these higher laser powers.

The conveyance structure may be an optical fiber in a metal tube with carbon fiber weave outer wrap, coiled tubing, a tube within the coiled tubing, jointed drill pipe, jointed drill pipe having a pipe within a pipe, or may be any other type of line structure, that has a high power optical fiber associated with it. For example, the conveyance structure may be a high power optical fiber, having a core diameter of more than 250 microns, and preferably more than 500 microns, surround by a reduced friction protective layer, e.g., a gel or Teflon tube, which is then encased within a metal tube, e.g., a stainless steel tube, which is supported with carbon fibers, e.g., wrapped with a braded carbon fiber or similar composite weave, and impregnated or coated with a strong, abrasion resistant material. As used herein the term line structure should be given its broadest meaning, unless specifically stated otherwise, and would include without limitation: wireline; coiled tubing; slick line; logging cable;

cable structures used for completion, workover, drilling, seismic, sensing, and logging; cable structures used for subsea completion and other subsea activities; umbilicals; cables structures used for scale removal, wax removal, pipe cleaning, casing cleaning, cleaning of other tubulars; cables used for ROV control power and data transmission; lines structures made from steel, wire and composite materials, such as carbon fiber, wire and mesh; line structures used for monitoring and evaluating pipeline and boreholes; and would include without limitation such structures as Power & Data Composite Coiled Tubing (PDT-COIL) and structures such as Smart Pipe® and FLATpak®. Conveyance structures would include without limitation all of the high power laser transmission structures and configurations disclosed and taught in the following US Patent Applications Publication Nos.: 2010/0044106; 2010/0215326; 2010/0044103; 2012/0020631; 2012/0068086; and 2012/0266803, the entire disclosures of each of which are incorporated herein by reference.

The various embodiments of high power laser hydraulic fracturing assemblies, perforating tools, systems and methods set forth in this specification may be used with each other, and the components of one embodiment may be used with, interchanged with, or as a part of the components of other embodiments. The various embodiments of high power laser hydraulic fracturing assemblies, perforating tools, systems and methods set forth in this specification may be used various high power laser systems and conveyance structures and systems, in addition to those embodiments of the figures and embodiments in this specification. For example, they may use, or be used in, or with, the systems, lasers, optics, tools and methods disclosed and taught in the following US patent applications and patent application publications: Publication No. 2010/0044106; Publication No. 2010/0215326; Publication No. 2012/0275159; Publication No. 2010/0044103; Publication No. 2012/0267168; Publication No. 2012/0020631; Publication No. 2013/0011102; Publication No. 2012/0217018; Publication No. 2012/0217015; Publication No. 2012/0255933; Publication No. 2012/0074110; Publication No. 2012/0068086; Publication No. 2012/0273470; Publication No. 2012/0067643; Publication No. 2012/0266803; Publication No. 2013/0011102; Ser. No. 13/868,149; Ser. No. 13/782,869; Ser. No. 61/798,597; Ser. No. 61/734,809; and Ser. No. 61/786,763, the entire disclosure of each of which are incorporated herein by reference.

The inventions may be embodied in other forms than those specifically disclosed herein without departing from its spirit or essential characteristics. The described embodiments are to be considered in all respects only as illustrative and not restrictive.

What is claimed:

1. A method of laser adaptive fracturing for use in the production of hydrocarbons from a formation, the method comprising:

a. identifying a stress in the formation in an area of the formation adjacent to a location along a borehole, the borehole having an axis; determining an axis for a preferred fracture plane of the formation, based in part upon the identified stress; the borehole axis and the preferred fracture plane axis defining an angle;

b. positioning a laser perforating tool in the borehole at the location;

c. the laser perforating tool configured to have a first laser beam path, the laser beam path extending in a direction toward the preferred fracture plane and at the angle;

d. delivering a high power laser beam having 5 kW to 80 kW of power along a laser beam path, whereby the laser beam creates a laser perforation;

e. performing a first mini-fracture and determining a first near bore hole tortuosity;

f. based upon the first near bore hole tortuosity adjusting the direction and the angle of the laser beam path, to provided a second laser beam path, wherein the adjusted direction and angle are to reduce near bore hole tortuosity;

g. delivering the laser beam along the second laser beam path, whereby the laser beam creates a second laser perforation;

h. performing a second mini-fracture and determining a second near bore hole tortuosity;

i. repeating steps e. to h. to determine a final laser beam delivery path direction and angle and delivering the laser beam along the final laser beam delivery path to create a final laser perforation;

j. flowing a fracturing fluid under pressure down the borehole, through the final laser perforation and into the formation, whereby the formation is hydraulically fractured with minimal near bore hole tortuosity.

2. The method of claim 1, wherein the location along the borehole is not less than 5,000 feet measured depth and the laser beam has a power of not less than 10 kW.

3. The method of claim 2, wherein the identified stress comprises a preferred stress plane and the laser beam path is positioned in the preferred stress plane.

4. The method of claim 2, wherein the laser perforating tool comprises a tractor section, and a laser cutting head section.

5. The method of claim 4, wherein the laser perforating tool is located within a laser hydraulic fracturing apparatus, and the laser hydraulic fracturing apparatus comprising a packer assembly.

6. The method of claim 2, wherein the laser perforating tool comprises a tractor section, a laser cutting head section, and a means to axially extend the laser cutting head section.

7. The method of claim 1, wherein the location along the borehole is not less than 10,000 feet measured depth and the laser beam has a power of not less than 10 kW.

8. The method of claim 7, wherein the identified stress comprises a preferred stress plane and the laser beam path is positioned in and parallel with the preferred stress plane.

9. The method of claim 1, wherein the location along the borehole is not less than 5,000 feet measured depth and the laser beam has a power of not less than 15 kW.

10. The method of claim 1, the laser beam has a power of not less than 15 kW.

11. The method of claim 1, wherein the laser beam path follows the preferred stress plane.

12. The method of claim 1, wherein the laser beam path is positioned in the preferred stress plane.

13. The method of claim 12, wherein the laser perforating tool comprises a tractor section, and a laser cutting head section.

14. The method of claim 1, wherein the laser beam path is positioned in and parallel with the preferred stress plane.

15. The method of claim 1, wherein the identified stress comprises a preferred stress plane and the laser beam path follows the preferred stress plane.

16. The method of claim 1, wherein the laser perforating tool comprises a tractor section, and a laser cutting head section.

17. The method of claim 1, wherein the laser perforating tool comprises a tractor section, a laser cutting head section, and a means to axially extend the laser cutting head section.

18. The method of claim 17, wherein the means to axially extend the laser cutting section comprises a motor a controller and an advancement screw.

19. The method of claim 17, wherein the laser perforating tool is located within a laser hydraulic fracturing apparatus, and the laser hydraulic fracturing apparatus comprising a packer assembly.

20. The method of claim 1, wherein the material removed consists of the formation.

21. The method of claim 1, wherein the material removed comprises a coiled tubing.

22. The method of claim 1, wherein the material removed comprises a casing and the formation.

23. The method of claim 1, wherein the material removed consists of a casing.

24. The method of claim 1, wherein the material removed comprises a casing, a cement, and the formation.

25. The method of claim 1, wherein shock sensitive instruments are positioned downhole during laser beam delivery and provide information regarding downhole conditions.

26. The method of claim 1, wherein shock sensitive instruments are positioned downhole during laser beam delivery and provide information regarding the perforations.

27. The method of claim 1, wherein shock sensitive instruments are positioned downhole during laser beam delivery and provide essentially real time information regarding the formation.

28. A method for use in the production of hydrocarbons from a formation, the method comprising:

a. identifying stresses in the formation in an area of the formation adjacent to a location along a borehole;

b. positioning a laser perforating tool in the borehole at the location;

c. delivering a high power laser beam having at least 5 kW to 80 kW of power in a predetermined laser beam pattern, the laser beam pattern position based at least in part upon the stresses in the formation; whereby the laser beam volumetrically removes a material in the shape of the laser beam pattern creating a laser perforation; and, d. flowing a fracturing fluid under pressure down the borehole, through the laser perforation and into the formation, whereby the formation is hydraulically fractured, e. wherein the laser perforating tool is located within a laser hydraulic fracturing apparatus, the laser hydraulic fracturing apparatus comprising a packer assembly; the packer assembly comprising a sleeve, defining a length, and having a plurality of spaced apart packers distributed along the length of the sleeve, wherein at least one of the packers is configured to expand inwardly against the laser perforating tool, and at least one packer is configured to extend outwardly against the borehole.

29. The method of claim 28, wherein the material removed consists of the formation.

30. The method of claim 29, wherein the volumetric removal is in the shape of a disc having a volume removed of not less than 1 cubic inches.

31. The method of claim 28, wherein the material removed comprises a casing and the formation.

32. The method of claim 31, wherein the volumetric removal is in the shape of a disc having a volume removed of not less than 1 cubic inches.

33. The method of claim 31, wherein the volumetric removal is in the shape of a disc having a volume removed of not less than 7 cubic inches.

34. The method of claim 31, wherein the volumetric removal is in the shape of a rectangular slot having a volume removed of not less than 100 cubic inches.

35. The method of claim 28, wherein the material removed consists of a casing.

36. The method of claim 28, wherein the material removed comprises a casing, a cement, and the formation.

37. The method of claim 36, wherein the volumetric removal is in the shape of a disc having a volume removed of not less than 1 cubic inches.

38. The method of claim 28, wherein the location along the borehole is not less than 5,000 feet measured depth and the laser beam has a power of not less than 10 kW.

39. The method of claim 38, wherein the identification of stress in the formation comprises using laser adaptive fracturing.

40. The method of claim 39, wherein the laser adaptive fracturing comprises creating a first laser perforation, performing a mini-fracture through the laser perforation, and evaluating the mini-fracture to identify a formation condition.

41. The method of claim 38, wherein the identified stress comprises a preferred stress plane and the laser beam pattern is positioned in the preferred stress plane.

42. The method of claim 41, wherein the laser perforating tool comprises a tractor section, and a laser cutting head section.

43. The method of claim 38, wherein the laser perforating tool comprises a tractor section, and a laser cutting head section.

44. The method of claim 38, wherein the laser perforating tool comprises a tractor section, a laser cutting head section, and a means to axially extend the laser cutting head section.

45. The method of claim 38, wherein the volumetric removal is positioned in and parallel with the stress plane.

46. The method of claim 38, wherein the fracturing fluid is slick water.

47. The method of claim 38, wherein the location in the borehole is substantially horizontal.

48. The method of claim 38, wherein the volumetric removal is in the shape of a disc having a volume removed of not less than 1 cubic inches.

49. The method of claim 38, wherein the volumetric removals are in the shape of a disc, each disc having a volume not less than removed of 7 cubic inches.

50. The method of claim 38, wherein the volumetric removal is in the shape of a disc having a volume removed of not less than 100 cubic inches.

51. The method of claim 38, comprising a plurality of volumetric removals comprising at least six discrete shapes.

52. The method of claim 38, comprising a plurality of volumetric removals comprises at least four discrete shapes; and wherein the removed volume for each shape is not less than 7 cubic inches.

53. The method of claim 38, wherein the volumetric removals are each in the shape of a rectangular slot.

54. The method of claim 38, wherein the volumetric removal is in the shape of a rectangular slot having a volume removed of not less than 100 cubic inches.

55. The method of claim 38, wherein the volumetric removal is in the shape of a rectangular slot having a volume removed of not less than 150 cubic inches.

56. The method of claim 28, wherein the identification of stress in the formation comprises using laser adaptive fracturing.

57. The method of claim 56, wherein the laser adaptive fracturing comprises creating a first laser perforation, performing a mini-fracture through the laser perforation, and evaluating the mini-fracture to identify a formation condition.

58. The method of claim 28, wherein the identified stress comprises a preferred stress plane and the laser beam pattern follows the preferred stress plane.

59. The method of claim 28, wherein the identified stress comprises a preferred stress plane and the laser beam pattern is positioned in and parallel with the preferred stress plane.

60. The method of claim 28, wherein the laser perforating tool comprises a tractor section, and a laser cutting head section.

61. The method of claim 28, wherein the fracturing fluid is slick water.

62. The method of claim 28, wherein the location in the borehole is substantially vertical.

63. The method of claim 28, wherein the borehole has a TVD of not less than 5,000 ft, a MD of 15,000 ft, and a substantially horizontal section having a length of 5,000 ft.

64. The method of claim 28, wherein the volumetric removal is in the shape of a disc, each having a volume removed not less than 1 cubic inches.

65. The method of claim 28, wherein the volumetric removal is in the shape of a disc having a volume removed of not less than 50 cubic inches.

66. The method of claim 28, comprising a plurality of volumetric removals.

67. The method of claim 28, comprising a plurality of volumetric removals comprising at least four discrete shapes.

68. The method of claim 28, comprising a plurality of volumetric removals comprises at least four discrete shapes; and wherein the removed volume for each shape is not less than 1 cubic inches.

69. The method of claim 28, wherein at least of of volumetric removal is in the shape of a rectangular slot.

70. The method of claim 28, wherein the shape of the laser beam pattern is predetermined at least in part to reduce near borehole tortuosity.

71. The method of claim 28, wherein the position of the laser beam pattern is based at least in part to reduce near borehole tortuosity.

72. The method of claim 28, wherein the shape of the laser beam patterns is predetermined at least in part to reduce near borehole tortuosity and the position of the laser beam patterns is based at least in part to reduce near well bore tortuosity.

73. The method of claim 28, wherein the shape of the laser beam pattern at least in part reduces near borehole tortuosity.

74. The method of claim 28, wherein the position of the laser beam pattern at least in part reduces near borehole tortuosity.

75. The method of claim 28, wherein the shape of the laser beam pattern at least in part essentially eliminates near borehole tortuosity.

76. A method of producing hydrocarbons from a formation, the method comprising:

a. identifying a stress in the formation in an area of the formation adjacent to a location along a borehole;

b. positioning a laser perforating tool in the borehole at the location, the location along the borehole at not less than 5,000 feet measured depth;

c. determining the position of a laser beam path, the laser beam path position based at least in part upon the stress in the formation, the laser beam path following a preferred stress plane; and, d. delivering a high power laser beam having 5 kW of power along a laser beam path, whereby the laser beam creates a laser perforation, e. wherein the laser perforating tool is located within a laser hydraulic fracturing apparatus, the laser hydraulic fracturing apparatus comprising a packer assembly; the packer assembly comprising a sleeve, defining a length, and having a plurality of spaced apart packers distributed along the length of the sleeve, wherein at least one of the packers is configured to expand inwardly against the laser perforating tool, and at least one packer is configured to extend outwardly against the borehole.

77. A method for use in the production of hydrocarbons from a formation, the method comprising:

a. identifying stresses in the formation in an area of the formation adjacent to a location along a borehole;

b. positioning a laser perforating tool in the borehole at the location; and, c. delivering a high power laser beam having at least 5 kW to 80 kW of power in a predetermined laser beam pattern, the laser beam pattern position based at least in part upon the stresses in the formation; whereby the laser beam volumetrically removes a material in the shape of the laser beam pattern creating a laser perforation, d. wherein the laser perforating tool is located within a laser hydraulic fracturing apparatus, the laser hydraulic fracturing apparatus comprising a packer assembly; the packer assembly comprising a sleeve, defining a length, and having a plurality of spaced apart packers distributed along the length of the sleeve, wherein at least one of the packers is configured to expand inwardly against the laser perforating tool, and at least one packer is configured to extend outwardly against the borehole.

78. The method of claim 77, wherein the material removed consists of the formation.

79. The method of claim 77, wherein the material removed comprises a casing and the formation.

80. The method of claim 77, wherein the material removed comprises a casing, a cement, and the formation.

81. The method of claim 77, wherein the material removed comprises a first tubular and a second tubular.

82. The method of claim 77, wherein the first and second tubulars are coaxial.

83. The method of claim 77, wherein the location along the borehole is at not less than 5,000 feet measured depth and the laser beam has a power of not less than 10 kW.

84. The method of claim 77, wherein the identification of stress in the formation comprises using laser adaptive fracturing.

85. The method of claim 77, wherein the volumetric removal is in the shape of a disc having a volume removed of not less than 100 cubic inches.

86. The method of claim 77, comprising a plurality of volumetric removals.

87. The method of claim 77, comprising a plurality of volumetric removals comprising at least four discrete shapes.

88. The method of claim 77, wherein the position of the laser beam pattern at least in part reduces near borehole tortuosity.

89. The method of claim 77, wherein shock sensitive instruments are positioned downhole during laser beam delivery and provide information regarding downhole conditions.

90. The method of claim 77, wherein shock sensitive instruments are positioned downhole during laser beam delivery and provide information regarding the perforations.

91. The method of claim 77, wherein shock sensitive instruments are positioned downhole during laser beam delivery and provide essentially real time information regarding the downhole formation.

* * * * *